US008815480B2

(12) United States Patent
Sonobe et al.

(10) Patent No.: US 8,815,480 B2
(45) Date of Patent: Aug. 26, 2014

(54) ELECTROPHOTOGRAPHIC PHOTORECEPTOR, PROCESS CARTRIDGE, AND IMAGE FORMING APPARATUS

(75) Inventors: Kenya Sonobe, Kanagawa (JP); Katsumi Nukada, Kanagawa (JP); Wataru Yamada, Kanagawa (JP); Takatsugu Doi, Kanagawa (JP); Tsuyoshi Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 311 days.

(21) Appl. No.: 13/089,993

(22) Filed: Apr. 19, 2011

(65) Prior Publication Data

US 2012/0100472 A1 Apr. 26, 2012

(30) Foreign Application Priority Data

Oct. 22, 2010 (JP) ..... 2010-237868

(51) Int. Cl.

| | |
|---|---|
| ***G03G 15/00*** | (2006.01) |
| ***G03G 5/147*** | (2006.01) |
| ***G03G 5/06*** | (2006.01) |
| ***G03G 5/07*** | (2006.01) |

(52) U.S. Cl.

CPC ..... *G03G 5/14791* (2013.01); *G03G 5/14747* (2013.01); *G03G 5/0607* (2013.01); *G03G 5/0612* (2013.01); *G03G 5/0609* (2013.01); *G03G 5/076* (2013.01); *G03G 5/0614* (2013.01); *G03G 5/14786* (2013.01); *G03G 5/14795* (2013.01); *G03G 5/075* (2013.01); *G03G 5/0605* (2013.01); *G03G 2215/00957* (2013.01)

USPC ..... 430/58.7; 430/56; 430/73

(58) Field of Classification Search

USPC ..... 430/56–96

See application file for complete search history.

(56) References Cited

U.S. PATENT DOCUMENTS

| | | | | |
|---|---|---|---|---|
| 5,427,880 | A | 6/1995 | Tamura et al. | |
| 5,670,283 | A * | 9/1997 | Kato et al. | 430/46.4 |
| 2005/0282075 | A1 | 12/2005 | Ikuno et al. | |

(Continued)

FOREIGN PATENT DOCUMENTS

| | | | |
|---|---|---|---|
| CN | 101175713 | A | 5/2008 |
| CN | 101334593 | A | 12/2008 |

(Continued)

OTHER PUBLICATIONS

Kamachi et al; "Radical Polymerization Handbook from Basics to New Developments," Aug. 10, 1999, pp. 38-48 1st edition; NTS Inc, Tokyo Japan (with translation).

(Continued)

*Primary Examiner* — Mark F Huff
*Assistant Examiner* — Rashid Alam
(74) *Attorney, Agent, or Firm* — Oliff PLC

(57) ABSTRACT

To provide an electrophotographic photoreceptor including the outermost surface layer formed from a cured film of a composition containing a compound having a chain polymerizable functional group and a charge transportable skeleton in a molecule and a chain transfer agent having a sulfur atom in a molecule, in which the reaction rate of the compound having a chain polymerizable functional group and a charge transportable skeleton in a molecule is about 90% to about 100% and the charge mobility of the cured film at an electric field intensity of $1.0\times10^5$ v/cm is from about $5.0\times10^{-7}$ $cm^2/Vs$ to about $1.0\times10^{-4}$ $cm^2/Vs$.

18 Claims, 6 Drawing Sheets

(56) References Cited

U.S. PATENT DOCUMENTS

| | | | | |
|---|---|---|---|---|
| 2007/0231721 | A1 | 10/2007 | Nukada et al. | |
| 2009/0004583 | A1* | 1/2009 | Nukada et al. | 430/58.5 |
| 2010/0119260 | A1* | 5/2010 | Egawa et al. | 399/159 |
| 2011/0287353 | A1* | 11/2011 | Horiuchi et al. | 430/58.35 |

FOREIGN PATENT DOCUMENTS

| | | | |
|---|---|---|---|
| CN | 101762995 | A | 6/2010 |
| JP | A-07-072640 | | 3/1995 |
| JP | A-09-302011 | | 11/1997 |
| JP | A-2000-169531 | | 6/2000 |
| JP | A-2004-012986 | | 1/2004 |
| JP | A-2006-010757 | | 1/2006 |
| JP | A-2007-264214 | | 10/2007 |
| JP | A-2007-322483 | | 12/2007 |

OTHER PUBLICATIONS

Mar. 31, 2014 Office Action issued in Chinese Patent Application No. 201110125503.8 (with translation).

* cited by examiner

ELECTROPHOTOGRAPHIC PHOTORECEPTOR, PROCESS CARTRIDGE, AND IMAGE FORMING APPARATUS

CROSS-REFERENCE

This application is based on and claims priority under 35 USC 119 from Japanese Patent Application No. 2010-237868 filed on Oct. 22, 2010.

BACKGROUND

1. Technical Field

The present invention relates to an electrophotographic photoreceptor, a process cartridge, and an image forming apparatus.

2. Related Art

In a so-called xerographic image forming apparatus, an electrophotographic photoreceptor is used as a component for forming an electrostatic latent image by charging the surface thereof by a charging unit, and, after charging, selectively eliminating static electricity by image exposure. At present, an organic electrophotographic photoreceptor is used in most cases.

SUMMARY

According to an aspect of the invention, there is provided an electrophotographic photoreceptor having the outermost surface layer formed from a cured film of a composition containing a compound having a chain polymerizable functional group and a charge transportable skeleton in a molecule and a chain transfer agent having sulfur atoms in a molecule, wherein a reaction rate of a compound having a chain polymerizable functional group and a charge transportable skeleton in a molecule is from 90% (or about 90%) to 100% (or about 100%) and the charge mobility of the cured film at an electric field intensity of $1.0\times10^5$ v/cm is from $5.0\times10^{-7}$ $cm^2/Vs$ (or about $5.0\times10^{-7}$ $cm^2/Vs$) to $1.0\times10^{-4}$ $cm^2/Vs$ (or about $1.0\times10^{-4}$ $cm^2/Vs$).

BRIEF DESCRIPTION OF THE DRAWINGS

Exemplary embodiments of the present invention will be described in detail based on the following figures, wherein.

DETAILED DESCRIPTION

[Electrophotographic Photoreceptor]

Figure 1:
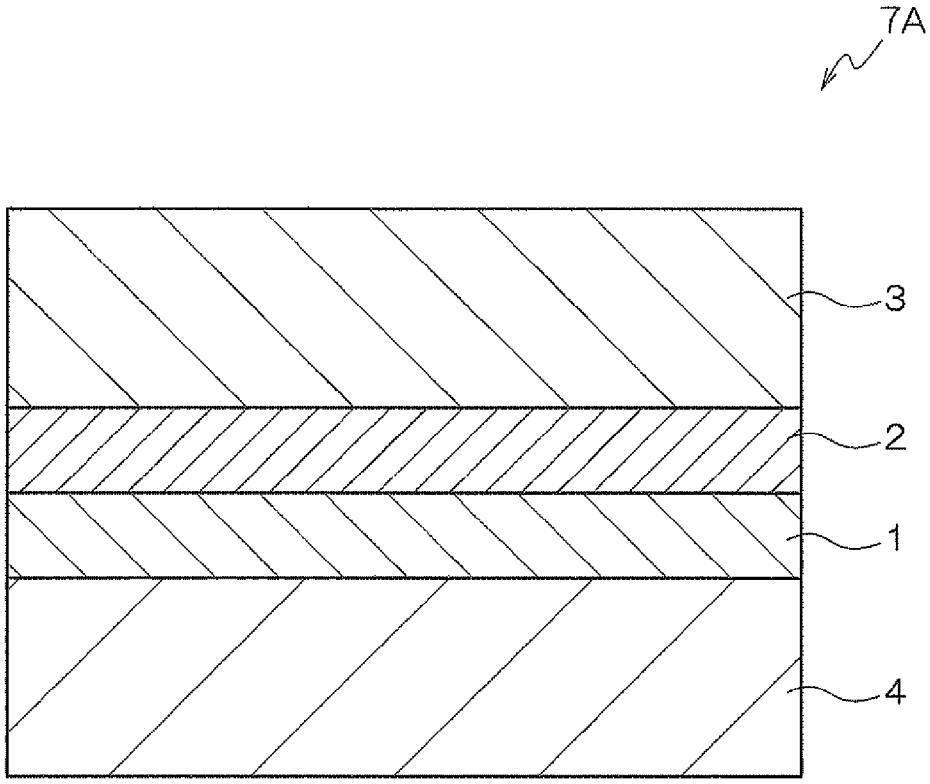
FIG. 1 is a diagram illustrating a partially schematic cross sectional view of an electrophotographic photoreceptor according to an exemplary embodiment of the present invention.

According to an exemplary embodiment of the invention, an electrophotographic photoreceptor according to an exemplary embodiment of the invention is an electrophotographic photoreceptor having the outermost surface layer constituted by a cured film of a composition containing a compound having a chain polymerizable functional group and a charge transportable skeleton in a molecule and a chain transfer agent having sulfur atoms in a molecule, in which the reaction rate (hereinafter referred to as a curing reaction rate) of the compound having a chain polymerizable functional group and a charge transportable skeleton in a molecule is from 90% (or about 90%) to 100% (or about 100%) and the charge mobility at an electric field intensity of $1.0\times10^5$ v/cm is from $5.0\times10^{-7}$ $cm^2/Vs$ (or about $5.0\times10^{-7}$ $cm^2/Vs$) to $1.0\times10^{-4}$ $cm^2/Vs$ (or about $1.0\times10^{-4}$ $cm^2/Vs$).

Herein, the chain transfer agent is an additive known as an agent for suppressing, in a general chain polymerization reaction, the polymerization degree and controlling the polymerization. Examples include additives for stopping the chain polymerization by chain transfer of hydrogen radicals by a hydrogen abstraction reaction or additives that stop the chain polymerization reaction by generating radicals due to heat by the additives themselves, and adding the same to the terminal of the chain polymerization.

In the electrophotographic photoreceptor according to this exemplary embodiment, the mechanical strength is excellent and the generation of image density unevenness due to repeated use is suppressed by structuring the same as described above using a chain transfer agent having sulfur atoms in a molecule among chain transfer agents.

The reason is not certain but the following reasons are presumed.

It is thought that, when a compound having a chain polymerizable functional group and a charge transportable skeleton in the molecule and a chain transfer agent having a sulfur atom in the molecule are used in combination, a curing reaction (chain polymerization reaction) is realized while greatly reducing the use of a catalyst such that there are fewer catalyst residues that can become impurities in the cured film that is obtained, compared with a case in which a compound having a chain polymerizable functional group and a charge transportable skeleton in the molecule and a chain transfer agent having a sulfur atom in the molecule are not used in combination.

Herein, examples of the catalyst include an azo initiator or a peroxide initiator described below. In this exemplary embodiment, by adjusting the amount of the catalyst used so as to be from 0.1% by weight to 5% by weight based on the total solid content, for example, the curing reaction is sufficiently promoted.

Under the chemically severe conditions of the radical reaction, a side reaction peculiar to the radical reaction, i.e., degradation of the compound having a chain polymerizable functional group and a charge transportable skeleton in the molecule as a result of the attack of radical species on the compound, proceeds due to the difficulty of controlling the reaction, which tends to impair the intrinsic electrical characteristics. However, it is thought that, by the use of a chain transfer agent having a sulfur atom in the molecule, a chain polymerizable reactive group that contributes to the curing reaction reacts preferentially while suppressing the side reaction.

The cured film having a curing reaction rate and charge mobility in the ranges mentioned above is preferably a cured film that is cured by causing radical polymerization by heat treatment. This is based on the following reaction mechanism. More specifically, it is thought that, according to a curing method including a radical polymerization by heat treatment, molecule movement of the chain transfer agent having a sulfur atom in the molecule is activated. Therefore, it is thought that the contact frequency and the contact opportunity between the chain transfer agent having a sulfur atom in the molecule and the chain polymerizable functional group in the compound having a chain polymerizable functional group and a charge transportable skeleton in the molecule increase.

Herein, examples of the method for causing radical polymerization include methods using thermal electron beam irradiation or light irradiation in addition to the method using heat treatment. However, in the curing of the composition containing a chain transfer agent having a sulfur atom in the molecule with a compound having a chain polymerizable functional group and a charge transportable skeleton in the molecule, it tends to be difficult to obtain a cured film having a curing reaction rate and charge mobility in the ranges mentioned above.

Therefore, it is considered that, in the outermost surface layer constituted by the cured film, the electrical characteristics (e.g., charge transportability, chargeability, and residual potential) increase and the characteristics are maintained even when repeatedly used.

It is considered from the above description that, in the electrophotographic photoreceptor of this exemplary embodiment, the mechanical strength becomes excellent and the generation of image density unevenness due to repeated use is suppressed by structuring the same as described above.

Moreover, it is considered that, in the electrophotographic photoreceptor of this exemplary embodiment, a reduction in the resolution due to repeated use is also suppressed by structuring the same as described above.

In addition, it is considered that, in the electrophotographic photoreceptor of this exemplary embodiment, the mechanical strength of the outermost surface layer increases and the wear resistance and the scratch resistance become excellent.

Thus, an image forming apparatus and a process cartridge having an electrophotographic photoreceptor of this exemplary embodiment obtain an image in which the generation of image density unevenness due to repeated use is suppressed. Moreover, a reduction in the resolution due to repeated use is also suppressed and the mechanical strength of the outermost surface layer of the electrophotographic photoreceptor increases, and thus the extension of life is also realized.

Herein, the electrophotographic photoreceptor of this exemplary embodiment specifically refers to an electrophotographic photoreceptor having a conductive base, a photosensitive layer provided on the conductive base, and, as required, a protective layer provided on the photosensitive layer and has an outermost surface layer constituted by the cured film as the outermost surface layer provided at the most distant position from the conductive base among the layers provided on the conductive base, for example.

The outermost surface layer is preferably provided particularly as a layer that functions as a protective layer or a layer that functions as a charge transporting layer.

When the outermost surface layer is a layer that functions as a protective layer, a constitution is mentioned in which a photosensitive layer and a protective layer as the outermost surface layer are provided on a conductive base and the protective layer is constituted by the cured film of the composition described above.

In contrast, when the outermost surface layer is a layer that functions as a charge transporting layer, a constitution is mentioned in which a charge generating layer and a charge transporting layer as the outermost surface layer are provided on a conductive base and the charge transporting layer is constituted by the cured film of the composition.

Hereinafter, the electrophotographic photoreceptor according to this exemplary embodiment will be described in detail with reference to the drawings. In the drawings, the same or corresponding components are designated with the same reference numerals and repetitive description is omitted.

Figure 2:
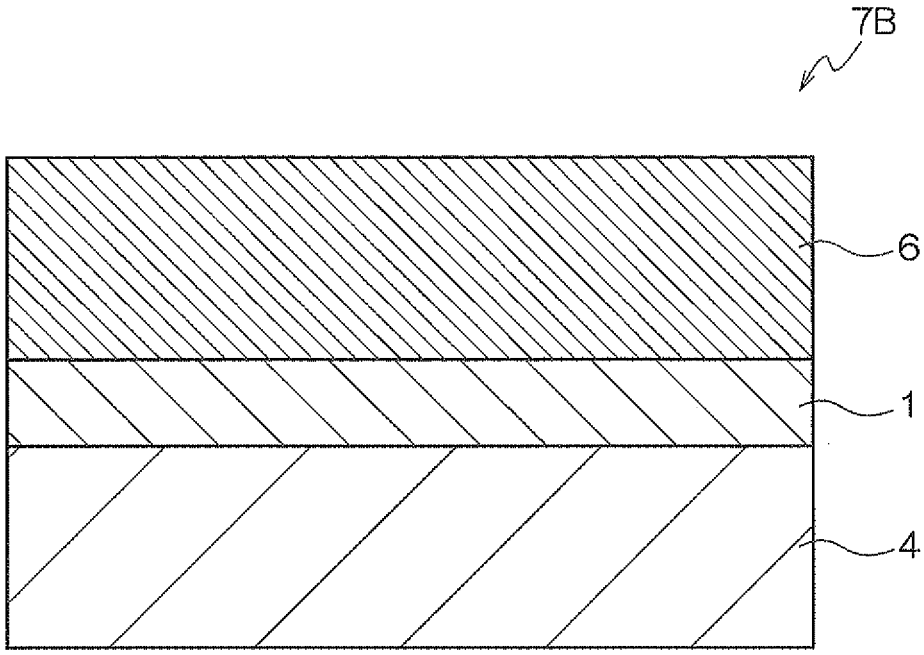
FIG. 2 is a diagram illustrating a partially schematic cross sectional view of an electrophotographic photoreceptor of another exemplary embodiment of the present invention.
Figure 3:
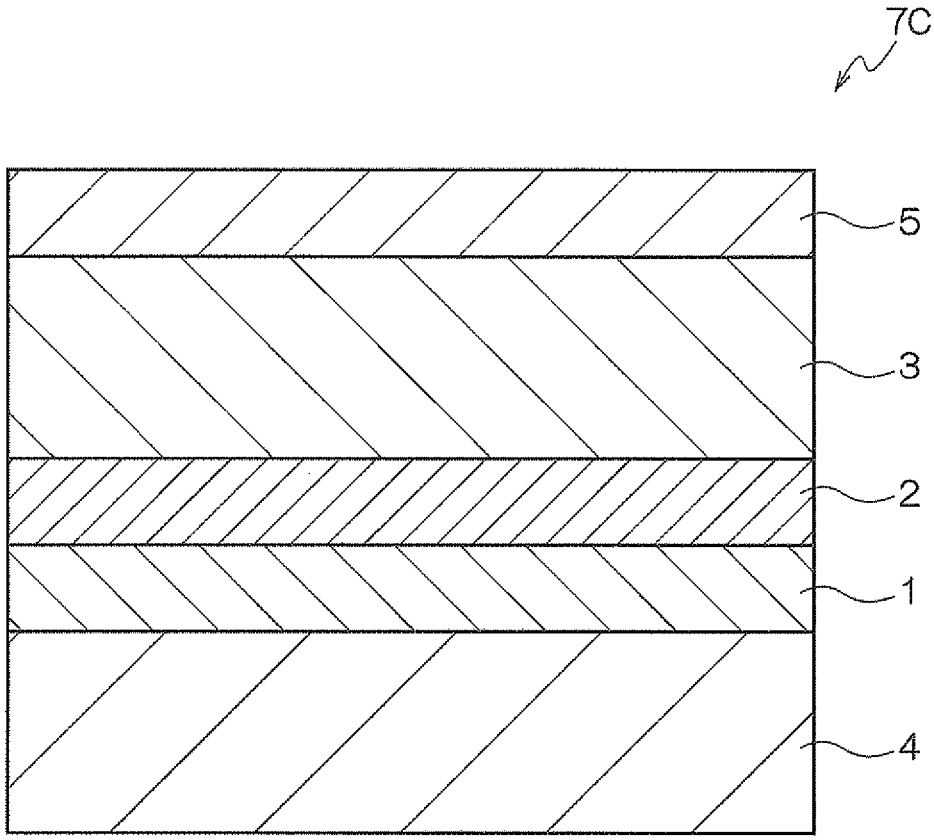
FIG. 3 is a diagram illustrating a partially schematic cross sectional view of an electrophotographic photoreceptor of another exemplary embodiment of the present invention.
Figure 4:
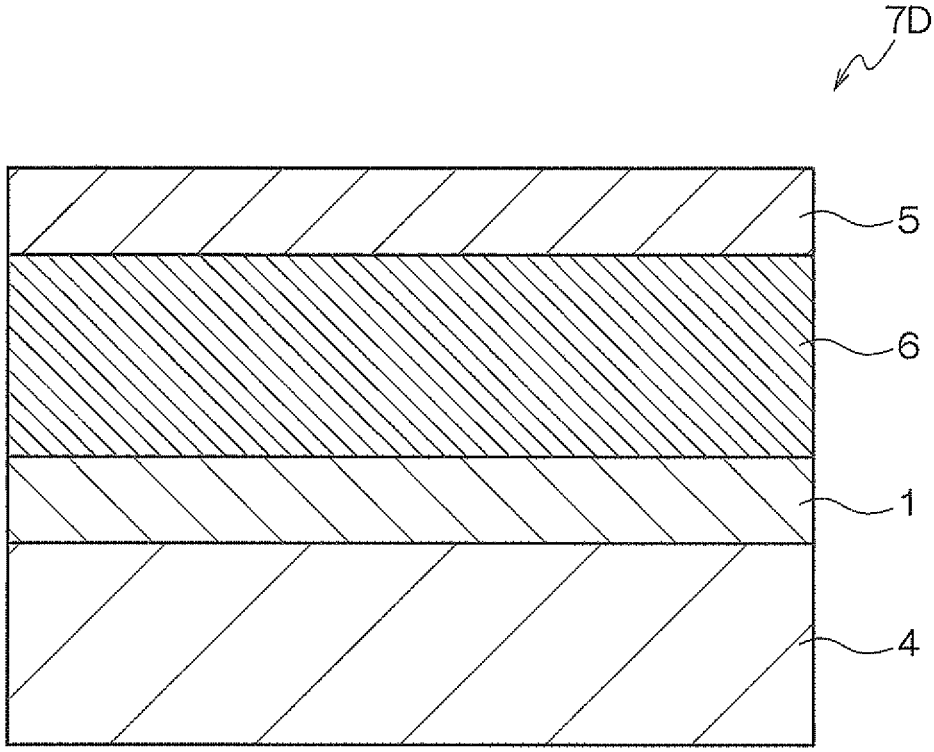
FIG. 4 is a diagram illustrating a partially schematic cross sectional view of an electrophotographic photoreceptor of another exemplary embodiment of the present invention.

FIG. 1 is a diagram illustrating a partially schematic cross sectional view of an electrophotographic photoreceptor according to this exemplary embodiment of the present invention. FIGS. 2 to 4 are diagrams each illustrating a partially schematic cross sectional view of an electrophotographic photoreceptor according to another exemplary embodiment of the present invention.

An electrophotographic photoreceptor 7A illustrated in FIG. 1 is a so-called function-separated type photoreceptor (or a layered type photoreceptor) and has a structure in which an undercoat layer 1 is provided on a conductive base 4 and a charge generating layer 2 and a charge transporting layer 3 are successively provided thereon. In the electrophotographic photoreceptor 7A, the photosensitive layer is constituted by the charge generating layer 2 and the charge transporting layer 3.

An electrophotographic photoreceptor 7B illustrated in FIG. 2 has a structure in which an undercoat layer 1 is provided on the conductive base 4 and a single-layer photosensitive layer 6 is formed thereon. More specifically, the electrophotographic photoreceptor 7B illustrated in FIG. 2 contains charge generating materials and charge transportable materials in the same layer (single-layer photosensitive layer 6 (charge generating/charge transporting layer)).

An electrophotographic photoreceptor 7C illustrated in FIG. 3 has a structure in which a protective layer 5 is provided in the electrophotographic photoreceptor 7A illustrated in FIG. 1, i.e., the undercoat layer 1 is provided on the conductive base 4 and the charge generating layer 2, the charge transporting layer 3, and the protective layer 5 are successively formed thereon.

An electrophotographic photoreceptor 7D illustrated in FIG. 4 has a structure in which the protective layer 5 is provided in the electrophotographic photoreceptor 7B illustrated in FIG. 2, i.e., the undercoat layer 1 is provided on the conductive base 4 and the single-layer photosensitive layer 6 and the protective layer 5 are successively formed thereon.

The electrophotographic photoreceptor 7A illustrated in FIG. 1 has a structure in which the charge transporting layer 3 serves as the outermost surface layer disposed at the farthest side from the conductive base 4 and the outermost surface layer is constituted by the cured film of the composition.

The electrophotographic photoreceptor 7B illustrated in FIG. 2 has a structure in which the single-layer photosensitive layer 6 serves as the outermost surface layer disposed at the farthest side from the conductive base 4 and the outermost surface layer is constituted by the cured film of the composition.

The electrophotographic photoreceptors 7C and 7D illustrated in FIGS. 3 and 4 each have a structure in which the protective layer 5 serves as the outermost surface layer disposed at the farthest side from the conductive base 4 and the outermost surface layer is constituted by the cured film of the composition.

In the electrophotographic photoreceptors illustrated in FIGS. 1 to 4, the undercoat layer 1 may be provided or may not be provided.

Hereinafter, each element will be described with reference to the electrophotographic photoreceptor 7A illustrated in FIG. 1 as a typical example.

(Conductive Base)

The conductive base is not particularly limited and a typical example includes a metal cylindrical base. In addition thereto, examples include resin films having conductive films (e.g., metals, such as aluminum, nickel, chromium, and stainless steel and films of aluminum, titanium, nickel, chromium, stainless steel, gold, vanadium, tin oxide, indium oxide, and indium tin oxide (ITO), and the like), paper to which a conductivity imparting agent is applied or which is impregnated with a conductivity imparting agent, and resin films to which a conductivity imparting agent is applied or which are impregnated with a conductivity imparting agent. The shape of the base is not limited to a cylindrical shape and may be a sheet shape or a plate shape.

In the conductive base, a conductive portion thereof preferably has a volume resistivity of lower than $10^7$ Ω·cm.

When a metal cylindrical object is used as the conductive base, the surface may be a material tube or may be subjected to treatment, such as specular cutting, etching, anodization, rough cutting, centerless grinding, sandblast, or wet honing beforehand.

(Undercoat Layer)

The undercoat layer is provided, as required, for the purpose of preventing light reflection on the surface of the conductive base, preventing inflow of an unnecessary carrier from the conductive base to the photosensitive layer, or the like.

The undercoat layer contains a binder resin and, as required, other additives, for example.

Examples of the binder resin contained in the undercoat layer include known resins (e.g., acetal resin, such as polyvinyl butyral, polyvinyl alcohol resin, casein, polyamide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol resin, phenol-formaldehyde resin, melamine resin, and urethane resin) and conductive resins (e.g., charge transportable resin having a charge transportable group or polyaniline). Among the above, the binder resin is preferably resin insoluble in a coating solvent of the upper layers, and, specifically, phenol resin, phenol-formaldehyde resin, melamine resin, urethane resin, and epoxy resin, and the like are preferable.

The conductive resin preferably has a conductivity with a volume resistivity of lower than $10^7$ Ω·cm, for example.

The undercoat layer may contain metallic compounds, such as a silicon compound, an organic zirconium compound, an organic titanium compound, an organic aluminum compound, or the like.

The ratio of the metallic compound and the binder resin is not particularly limited and is set in the range where target electrophotographic photoreceptor properties are obtained.

Into the undercoat layer, resin particles may be added for adjusting the surface roughness, for example. Examples of the resin particles include silicone resin particles and crosslinked polymethyl methacrylate (PMMA) resin particles. After the formation of the undercoat layer for adjusting the surface roughness, the surface may be polished. Examples of the polishing method include buff polishing, sandblast treatment, wet honing, and grinding treatment.

Herein, examples of the structure of the undercoat layer include a structure at least containing a binder resin and conductive particles.

The conductive particles are preferably particles having conductivity with a volume resistivity of lower than $10^7$ Ω·cm, for example.

Examples of the conductive particles include metal particles (e.g., particles of aluminum, copper, nickel, silver, and the like), conductive metal oxide particles (particles of antimony oxide, indium oxide, tin oxide, zinc oxide, and the like), and conductive substance particles (particles of carbon fiber, carbon black, and graphite powder). Among the above, conductive metal oxide particles are preferable. Two or more kinds of conductive particles may be mixed for use.

The conductive particles may be surface treated by a hydrophobilizing agent (e.g., coupling agent) or the like to adjust the resistance for use.

The content of the conductive particles is, for example, in the range of 10% by weight to 80% by weight or in the range of 40% by weight to 80% by weight based on the weight of the binder resin.

In the formation of the undercoat layer, a coating solution for forming an undercoat layer obtained by adding the ingredients mentioned above to a solvent is used, for example.

As a method for dispersing particles in the coating solution for forming an undercoat layer, a media disperser, such as a ball mill, a vibratory ball mill, an attritor, or a sand mill or a medialess disperser, such as an agitator, an ultrasonic disperser, a roll mill, or a high pressure homogenizer, is utilized. Herein, the high pressure homogenizer includes a collision method where a dispersion liquid is dispersed by liquid-liquid collision or liquid-wall collision under a high pressure or a penetration method where a dispersion liquid is dispersed by making the same penetrate through channels under a high pressure.

Examples of methods for applying the coating solution for forming an undercoat layer onto the conductive base include a dip coating method, a push-up coating method, a wire bar coating method, a spray coating method, a blade coating method, a knife coating method, and a curtain coating method.

The film thickness of the undercoat layer is, for example, in the range of 15 μm or more or in the range of 20 μm to 50 μm.

Herein, although not illustrated, an intermediate layer may be further provided between the undercoat layer and the photosensitive layer, for example. Examples of the binder resin for use in the intermediate layer include polymer resin compounds, such as acetal resin (e.g., polyvinyl butyral), polyvinyl alcohol resin, casein, polyimide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, and melamine resin and also includes, in addition thereto, organometallic compounds containing zirconium, titanium, aluminum, manganese, a silicon atom, and the like. These compounds may be used singly or as a mixture or a polycondensate of two or more kinds of the compounds. In particular, the use of the organometallic compounds containing zirconium or silicon facilitates obtaining a photoreceptor in which the residual potential is low, the potential hardly changes due to the environment, and the potential hardly changes due to repeated use compared with the case where another binder resin is used.

In the formation of the intermediate layer, a coating solution for forming an intermediate layer obtained by adding the ingredients mentioned above to a solvent is used, for example.

Examples of coating methods for forming the intermediate layer include usual methods, such as a dip coating method, a push-up coating method, a wire bar coating method, a spray coating method, a blade coating method, a knife coating method, and a curtain coating method.

The intermediate layer has a function as an electrical blocking layer, for example, in addition to a function of improving the coatability of the upper layer. When the film thickness is excessively large, the electric barrier becomes excessively strong to sometimes cause desensitization or an increase in potential due to repetition.

Therefore, when the intermediate layer is formed, the thickness thereof is set to be in the range of 0.1 μm to 3 μM. The intermediate layer in this case may be used as the undercoat layer.

(Charge Generating Layer)

The charge generating layer contains a charge generating material and a binder resin, for example.

Examples of the charge generating material constituting the charge generating layer include phthalocyanine pigments, such as metal-free phthalocyanine, chlorogallium phthalocyanine, hydroxygallium phthalocyanine, dichlorotin phthalocyanine, or titanylphthalocyanine. In particular, examples include a chlorogallium phthalocyanine crystal having strong diffraction peaks at least at 7.4°, 16.6°, 25.5°, and 28.3° of Bragg angles (2θ±0.2°) in CuKα characteristic X-rays, a metal-free phthalocyanine crystal having strong diffraction peaks at of at least at 7.7°, 9.3°, 16.9°, 17.5°, 22.4°, and 28.8° of Bragg angles (2θ±0.2°) in CuKα characteristic X-rays, a hydroxygallium phthalocyanine crystal having strong diffraction peaks at lest at 7.5°, 9.9°, 12.5°, 16.3°, 18.6°, 25.1°, and 28.3° of Bragg angles (2θ±0.2°) in CuKα characteristic X-rays, and a titanylphthalocyanine crystal having strong diffraction peaks at least at 9.6°, 24.1°, and 27.2° of Bragg angles (2θ±0.2°) in CuKα characteristic X-rays. Examples of the charge generating material further include quinone pigments, perylene pigments, indigo pigments, bisbenzimidazole pigments, anthrone pigments, and quinacridone pigments. The charge generating materials may be used singly or as a mixture of two or more kinds thereof.

Examples of the binder resin constituting the charge generating layer include polycarbonate resin, (e.g., bisphenol A polycarbonate resin and bisphenol Z polycarbonate resin), acrylic resin, methacrylic resin, polyarylate resin, polyester resin, polyvinyl chloride resin, polystyrene resin, acrylonitrile-styrene copolymer resin, an acrylonitrile-butadiene copolymer, polyvinyl acetate resin, polyvinyl formal resin, polysulfone resin, styrene-butadiene copolymer resin, vinylidene chloride-acrylonitrile copolymer resin, vinyl chloride-vinyl acetate-maleic anhydride resin, silicone resin, phenol-formaldehyde resin, polyacrylamide resin, polyamide resin, and poly-N-vinylcarbazole resin. The binder resin may be used singly or as a mixture of two or more kinds thereof.

The blending ratio of the charge generating material and the binder is, for example, in the range of 10:1 to 1:10 based on weight.

In the formation of the charge generating layer, a coating solution for forming a charge generating layer obtained by adding the ingredients mentioned above to a solvent is used, for example.

As a method for dispersing particles (e.g., charge generating materials) in the coating solution for forming a charge generating layer, a media disperser, such as a ball mill, a vibratory ball mill, an attritor, or a sand mill or a medialess disperser, such as an agitator, an ultrasonic disperser, a roll mill, or a high pressure homogenizer, is utilized. The high pressure homogenizer includes a collision method where a dispersion liquid is dispersed by liquid-liquid collision or liquid-wall collision under a high pressure or a penetration method where a dispersion liquid is dispersed by making the same penetrate through channels under a high pressure.

Examples of methods for applying the coating solution for forming a charge generating layer onto the undercoat layer include a dip coating method, a push-up coating method, a wire bar coating method, a spray coating method, a blade coating method, a knife coating method, and a curtain coating method.

The film thickness of the charge generating layer is, for example, in the range of 0.01 μm to 5 μm or in the range of 0.05 μm to 2.0 μm.

(Charge Transporting Layer)

The charge transporting layer is a cured film of a composition (hereinafter, sometimes referred to as a charge transportable composition) containing a compound having a chain polymerizable functional group and a charge transportable skeleton in a molecule and a chain transfer agent having sulfur atoms in a molecule and is a layer constituted by a cured film in which the curing reaction rate is from 90% (or about 90%) to 100% (or about 100%) and the charge mobility at an electric field intensity of $1.0\times10^5$ v/cm is from $5.0\times10^{-7}$ $cm^2/Vs$ (or about $5.0\times10^{-7}$ $cm^2/Vs$) to $1.0\times10^{-4}$ $cm^2/Vs$ (or about $1.0\times10^{-4}$ $cm^2/Vs$).

Herein, the cured film constituting the charge transporting layer has a curing reaction rate of 90% (or about 90%) to 100% (or about 100%) and a charge mobility at an electric field intensity of $1.0\times10^5$ v/cm of $5.0\times10^{-7}$ $cm^2/Vs$ (or about $5.0\times10^{-7}$ $cm^2/Vs$) to $1.0\times10^{-4}$ $cm^2/Vs$ (or about $1.0\times10^{-4}$ $cm^2/Vs$). For example, a cured film in which the curing reaction rate is from 95% (or about 95%) to 100% (or about 100%) and the charge mobility is from $1.0\times10^{-6}$ $cm^2/Vs$ to $1.0\times10^{-5}$ $cm^2/Vs$ is preferable. A cured film in which the curing reaction rate is from 98% (or about 98%) to 100% (or about 100%) and the charge mobility is from $2.0\times10^{-6}$ $cm^2/Vs$ (or about $2.0\times10^{-6}$ $cm^2/Vs$) to $5.0\times10^{-6}$ $cm^2/Vs$ (or about $5.0\times10^{-6}$ $cm^2/Vs$) is more preferable. A cured film in which the curing reaction rate is from 98% (or about 98%) to 100% (or about 100%) and the charge mobility is from $2.0\times10^{-6}$ $cm^2/Vs$ to $3.0\times10^{-6}$ $cm^2/Vs$ is particularly preferable.

The cured film having the curing reaction rate and the charge mobility in the range mentioned above is preferably a cured film that is cured by causing a radical polymerization by heat treatment. Examples of the method for causing a radical polymerization include methods using thermal electron beam irradiation or light irradiation in addition to the method using heat treatment. However, according to the method, in the curing of a charge transportable composition containing a chain transfer agent having sulfur atoms in a molecule with a compound having a chain polymerizable functional group and a charge transportable skeleton in a molecule, there is a tendency that a cured film having the curing reaction rate and the charge mobility in the range mentioned above is hard to obtain.

It is considered that the cured film is cured in a state where a polymerization reaction (chain polymerization reaction) of the chain polymerizable functional group in the compound having the chain polymerizable functional group and the charge transportable skeleton in a molecule is efficiently performed using the chain transfer agent having sulfur atoms in a molecule and, desirably, by heat curing and the degradation of the charge transportable skeleton of the compound is suppressed due to the reaction.

More specifically, it has been difficult to achieve both properties of accelerating the chain polymerization reaction and achieving a charge transportation function by former methods but this exemplary embodiment can achieve both properties, and as a result provides an electrophotographic photoreceptor in which the mechanical strength is excellent and the generation of image density unevenness due to repeated use is suppressed.

In this exemplary embodiment, the curing reaction rate is defined as $(W_1-W_2)/W_1\times100(\%)$, when the weight of the cured film is defined as $W_1$ and the weight of the compound having a chain polymerizable functional group and a charge transportable skeleton in a molecule extracted with the solvent from the inside of the cured film after curing is defined as $W_2$. Specifically, the curing reaction rate is measured as follows.

First, about 1.000 g (weighed as $W_1$) of the cured films is immersed in 30 ml of tetrahydrofuran, and then shaked at 55° C. for 3 hours. Thereafter, the qualitative analysis and quantitative determination of the compound having a chain polymerizable functional group and a charge transportable skeleton in a molecule in the solution are performed by subjecting the solution to a high-performance liquid chromatography, for example, HLC-8210 (trade name) manufactured by Tosoh Corporation, and thus the curing reaction rate is calculated. Herein, the curing reaction rate serves as an index indicating whether or not the compound having a chain polymerizable functional group and a charge transportable skeleton in a molecule participates in the reaction by the curing reaction. A higher curing reaction rate indicates that the compound has caused the curing reaction at a higher degree.

The charge mobility of the cured film is measured under the conditions of 40% RH at 24° C. using a XTOF (Xerographic TOF) method. Specifically, a voltage is applied to the electrophotographic photoreceptor using a scorotron charging device so that the electric field intensity is $1\times10^5$ V/cm, pulsed light is emitted by a xenon flash lamp to generate charges from the charge generating layer, and then changes in photoreceptor surface potential are measured using a potential probe, an electrometer amplifier, and a digital oscilloscope. For the judgment of running time, a method is used that determines the same from the bending point of a waveform obtained by logarithmically transforming the relationship between time change and time differentiation of surface potential. In general, the cured film in which the charge mobility is higher is preferable in terms of a charge transportation function. However, the cured film has a function for developing a toner by holding charges on the photoreceptor surface in the electrophotographic photoreceptor, and a secondary problem occurs in some cases.

Hereinafter, each material constituting the charge transporting layer will be described.

—Compound Having Chain Polymerizable Functional Group and Charge Transportable Skeleton in a Molecule—

The compound (hereinafter sometimes referred to as a specific charge transportable material) having a chain polymerizable functional group and a charge transportable skeleton in a molecule will be described.

Herein, examples of the charge transportable skeleton in the specific charge transportable material include a skeleton derived from nitrogen-containing electron hole transportable compounds, such as triarylamine compounds, benzidine compounds, or hydrazone compounds, in which a structure conjugating with the nitrogen atom is a charge transportable skeleton. Among the above, the triarylamine skeleton is preferable.

In contrast, examples of the chain polymerizable functional group in the specific charge transportable material include a group containing an unsaturated double bond and examples include a group containing at least one selected from an acryloyl group, a methacryloyl group, and a vinylphenyl group.

The specific charge transportable material is preferably a compound having two or more (particularly 4 or more) chain polymerizable functional groups in a molecule. Thus, the electrical characteristics (e.g., charge transportability, chargeability, and residual potential) of the cured film increase and these properties are easily maintained even when repeatedly used and the generation of image density unevenness due to repeated use is easily suppressed. Moreover, the crosslinking density increases and a cured film having a higher mechanical strength is easily obtained.

The number of these chain polymerizable functional groups is, for example, in the range of 20 or lower or in the range of 10 or lower in terms of the stability and the electrical characteristics of the charge transportable composition (coating solution).

Specific examples of the specific charge transportable material include a compound represented by the following Formula (A) from the viewpoint of electrical characteristics and film strength.

When the compound represented by the following Formula (A) is applied, the electrical characteristics (e.g., charge transportability, chargeability, and residual potential) of the cured film increase and these properties are easily maintained even when repeatedly used and the generation of image density unevenness due to repeated use is easily suppressed. The crosslinking density increases and a cured film having a higher mechanical strength is easily obtained.

(A)

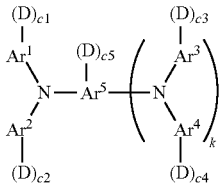

In Formula (A), $Ar^1$ to $Ar^4$ each independently represent a substituted or unsubstituted aryl group, $Ar^5$ represents a substituted or unsubstituted aryl group or a substituted or unsubstituted arylene group, D represents a group containing at least one selected from the group consisting of an acryloyl group, a methacryloyl group, and a vinylphenyl group at the terminal, c1 to c5 each independently represent 0, 1, or 2, k represents 0 or 1, and the total number of D is 1 or more.

Herein, the compound represented by Formula (A) is preferably a compound in which D represents $—(CH_2)_d—(O—CH_2—CH_2)_e—O—CO—C(R')=CH_2$ (R' represents a hydrogen atom or a methyl group, d represents an integer of 1 to 5, and e represents 0 or 1) and the total number of D is 4 or more.

When the compound is applied, the electrical characteristics (e.g., charge transportability, chargeability, and residual potential) of the cured film are improved and these properties are easily maintained even when repeatedly used and the generation of image density unevenness due to repeated use is easily suppressed. Moreover, the crosslinking density increases and a cured film having higher mechanical strength is easily obtained.

Herein, the terminal of the group represented by D is preferably a methacryloyl group (R represents a methyl group (—$CH_3$)). Although the reason is not always clear, the following reason is considered.

In usual, an acryloyl group having high reactivity is used for the curing reaction in many cases. When an acryloyl group having high reactivity is used as a bulky substituent of the charge transportable material as in the compound represented by Formula (A), an uneven curing reaction is likely to occur and a microscopic (or macroscopic) sea-island structure is likely to form in the cured film, compared with the case where a methacryloyl group is used. It is considered that the sea-island structure is likely to cause unevenness and wrinkles in the cured film, and when the cured film having the sea-island structure is used as the outermost surface layer of the electrophotographic photoreceptor, the sea-island structure is likely to cause image unevenness. Therefore, the terminal of the group represented by D is preferably a methacryloyl group.

It is considered that the formation of the sea-island structure becomes particularly noticeable when plural functional groups are attached to one charge transportable skeleton.

In Formula (A), $Ar^1$ to $Ar^4$ each independently represent a substituted or unsubstituted aryl group. $Ar^1$ to $Ar^4$ each may be the same or different.

Herein, examples of substituents in the substituted aryl group include an alkyl group having 1 to 4 carbon atoms, an alkoxy group having 1 to 4 carbon atoms, and an aryl group having 1 to 4 carbon atoms, as a group other than the group represented by D.

$Ar^1$ to $Ar^4$ each are preferably any one of the following Formulae (1) to (7). The following Formulae (1) to (7) are shown with "-$(D)_c$" collectively representing "-$(D)_{c1}$" to "-$(D)_{c4}$" that can be connected to each of $Ar^1$ to $Ar^4$.

(1)

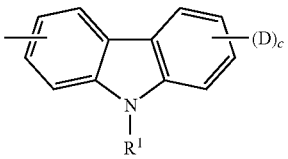

(2)

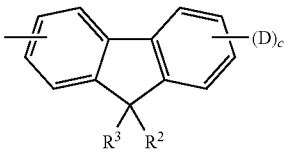

(3)

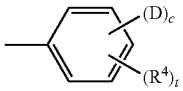

(4)

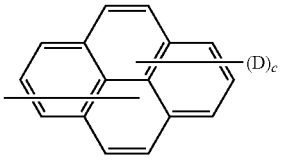

-continued (5)

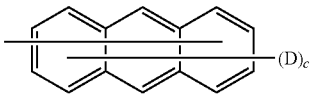

(6)

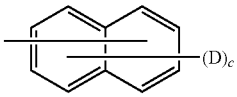

(7)

In Formulae (1) to (7), $R^1$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^2$ to $R^4$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group, D represents the same group as that of D in Formula (A), c represents 1 or 2, s represents 0 or 1, and t represents an integer of 0 to 3.

Herein, Ar in Formula (7) is preferably one represented by the following structural formula (8) or (9).

(8)

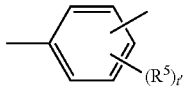

(9)

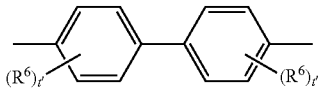

In Formulae (8) and (9), $R^5$ and $R^6$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom and t' represents an integer of 0 to 3.

In Formula (7), Z' represents a divalent organic linking group and may be represented by any one of the following Formulae (10) to (17). s represents 0 or 1.

(10)

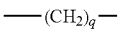

(11)

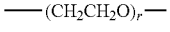

(12)

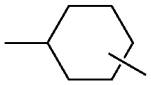

-continued (13)

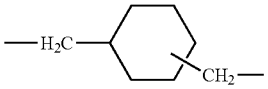

(14)

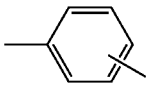

(15)

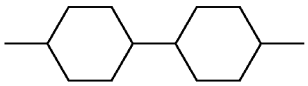

(16)

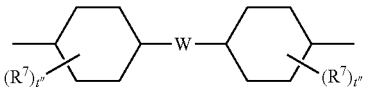

(17)

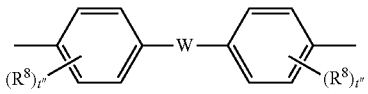

In Formulae (10) to (17), $R^7$ and $R^8$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, W represents a divalent group, q and r each independently represent an integer of 1 to 10, and t" represents an integer of 0 to 3.

W in Formulae (16) and (17) is preferably any one of the divalent groups represented by the following formulae (18) to (26). In Formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

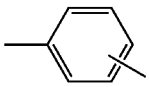

(25)

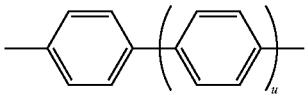

(26)

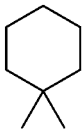

In Formula (A), $Ar^5$ is a substituted or unsubstituted aryl group when k is 0. Examples of the aryl group include the same one as the aryl group mentioned in the description of $Ar^1$ to $Ar^4$. $Ar^5$ is a substituted or unsubstituted arylene group when k is 1. Examples of the arylene group include an arylene group lacking one hydrogen atom at a target position in the aryl group mentioned in the description of $Ar^1$ to $Ar^4$.

Hereinafter, specific examples of the specific charge transportable material are shown. The specific charge transportable material is not limited at all to the examples.

First, specific examples of a specific charge transportable material having one chain polymerizable functional group are shown but are not limited thereto.

| No. | |
|---|---|
| i-1 | 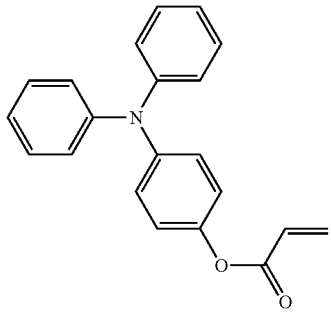 |
| i-2 | 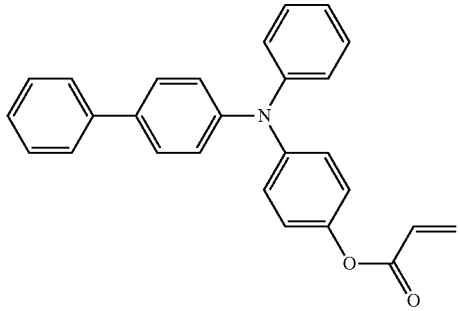 |
| i-3 | 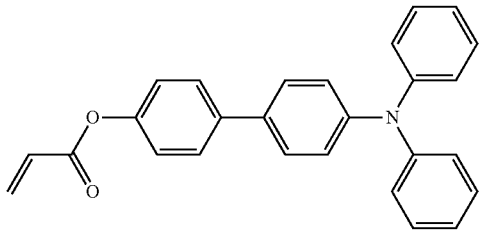 |
| i-4 | 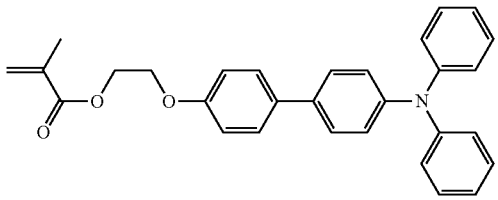 |

-continued
No.
i-5
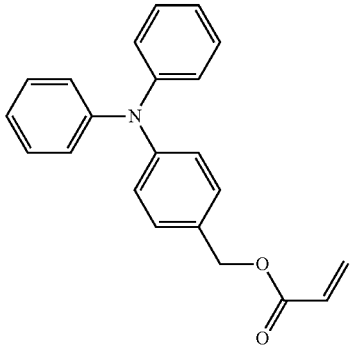
i-6
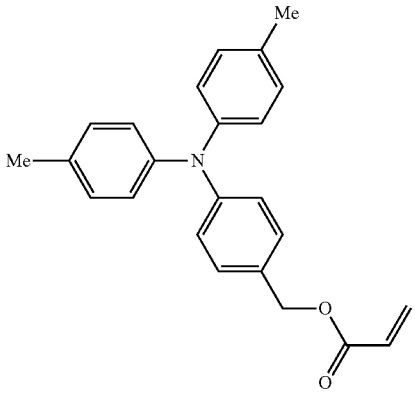
i-7
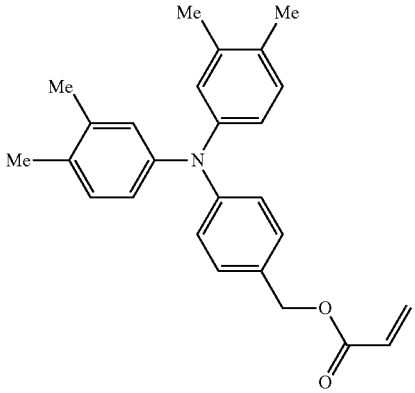
i-8
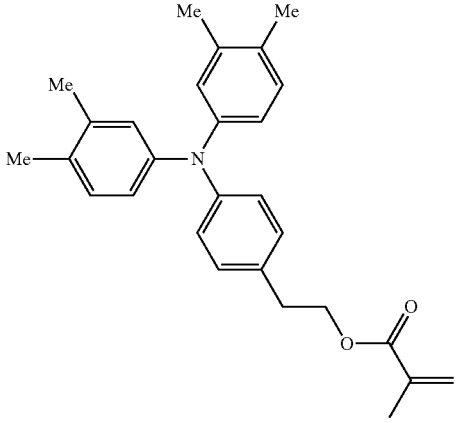
-continued
No.
i-9
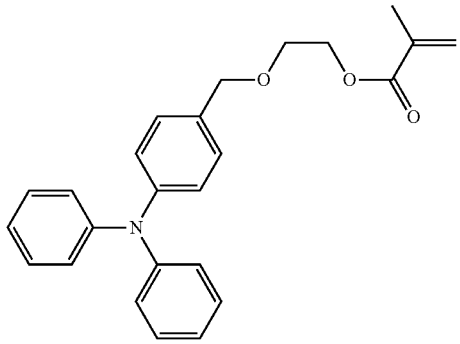
i-10
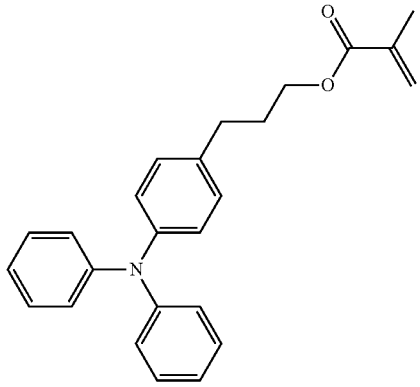
i-11
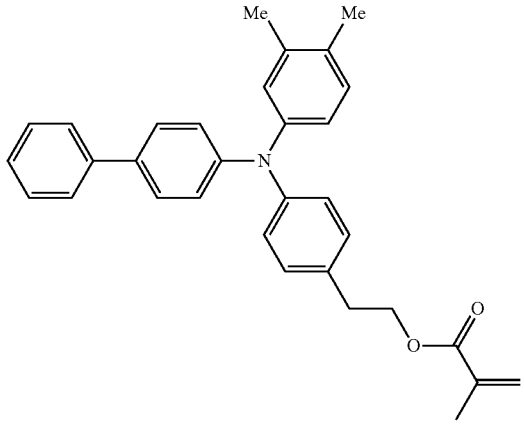
i-12
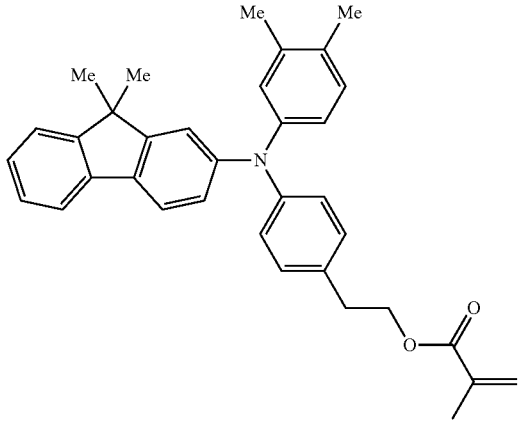

-continued
No.
i-13
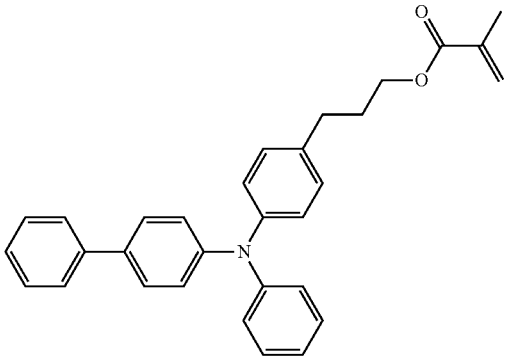
i-14
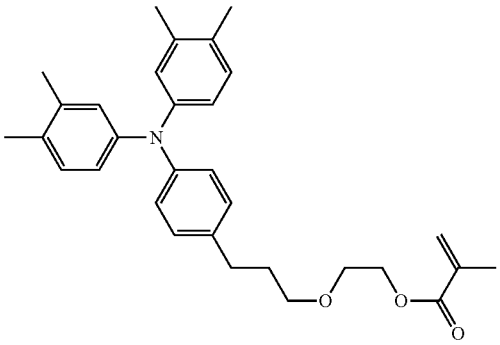
i-15
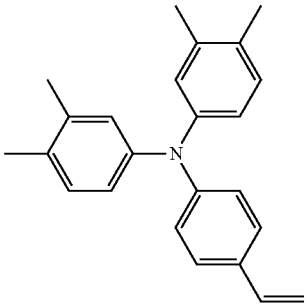
i-16
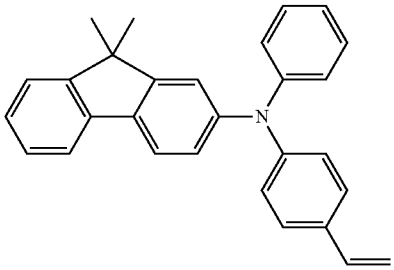
i-17
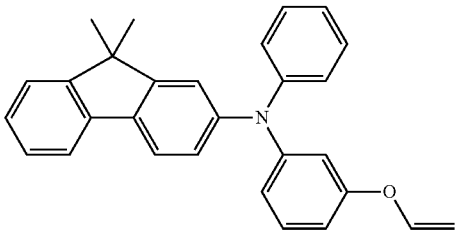
-continued
No.
i-18
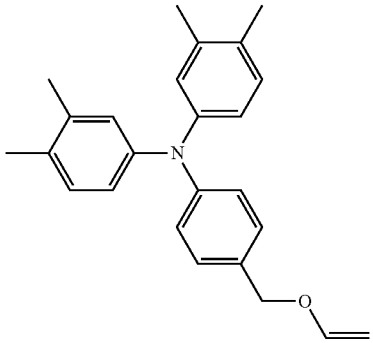
i-19
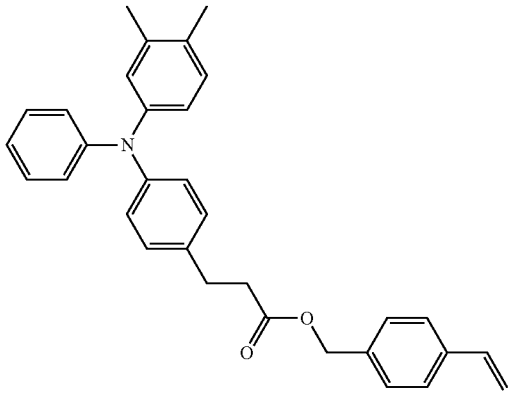
i-20
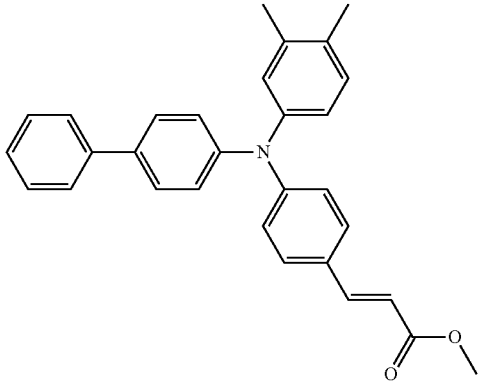
i-21
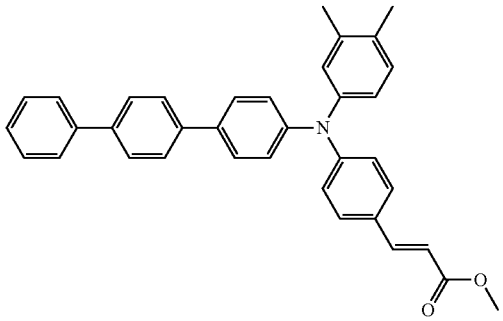

-continued
| No. | |
|---|---|
| i-22 | 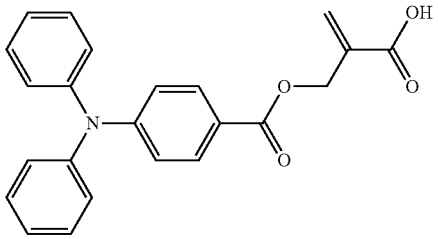 |
| i-23 | 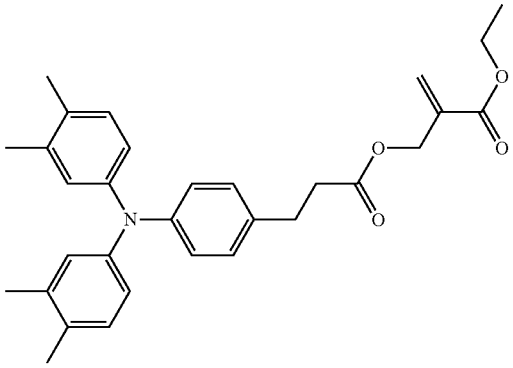 |
-continued
| No. | |
|---|---|
| i-24 | 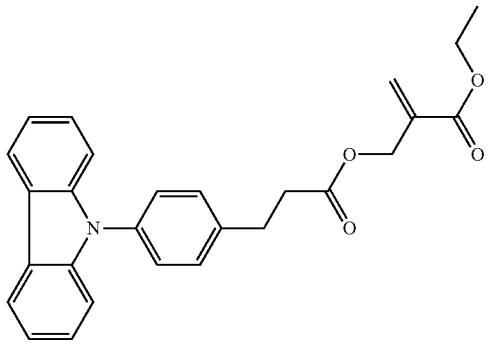 |
| i-25 | 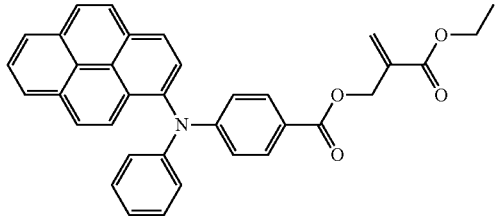 |
Specific examples of a specific charge transportable material having two chain polymerizable functional groups are shown below but are not limited thereto.
| No. | |
|---|---|
| ii-1 | 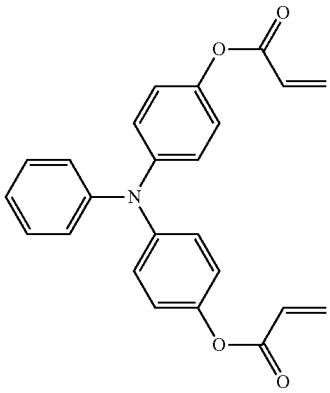 |
| ii-2 | 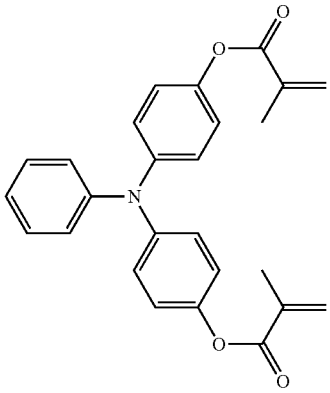 |

-continued
| No. | |
|---|---|
| ii-3 | 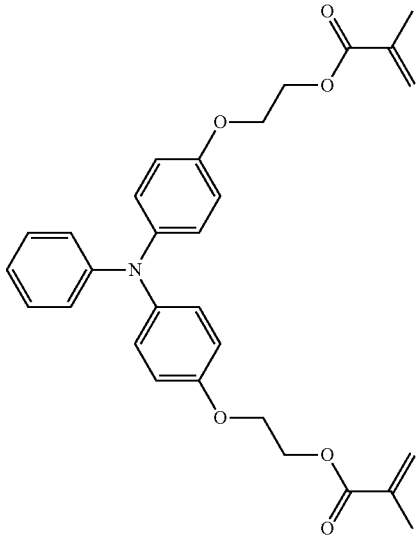 |
| ii-4 | 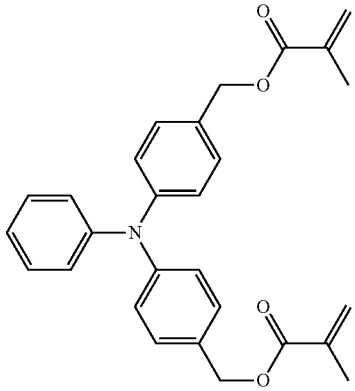 |
| ii-5 | 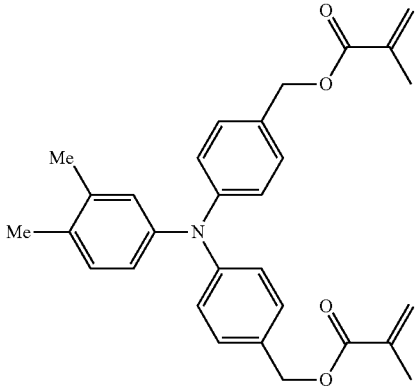 |

-continued
| No. | |
|---|---|
| ii-6 | 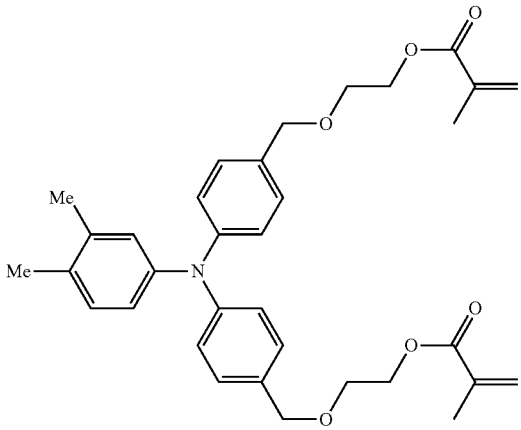 |
| ii-7 | 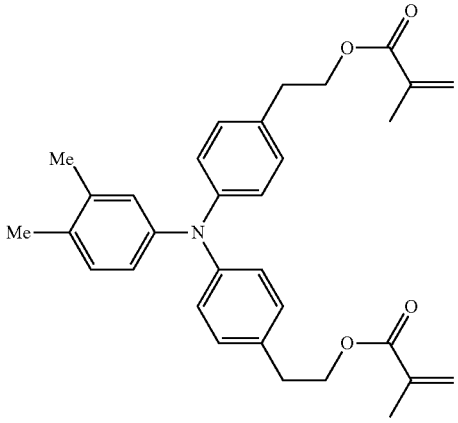 |
| ii-8 | 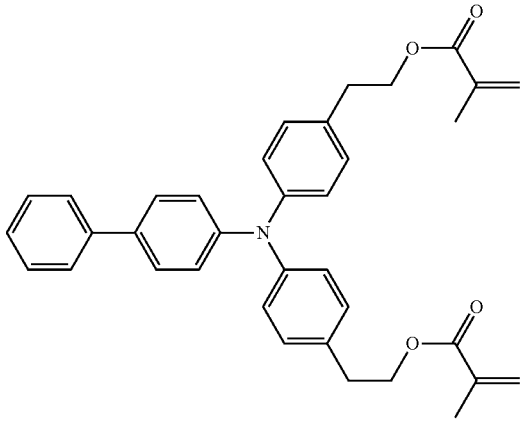 |

-continued
| No. | |
|---|---|
| ii-9 | 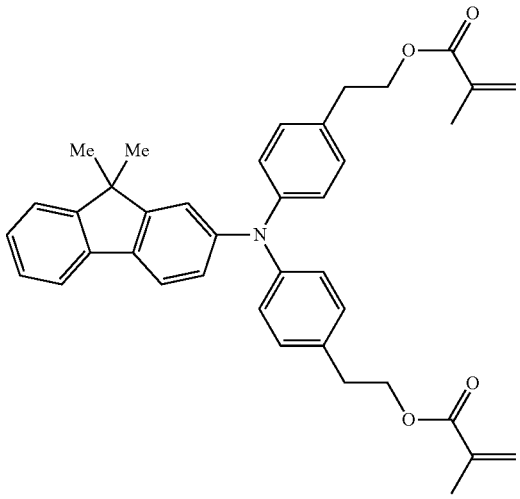 |
| ii-10 | 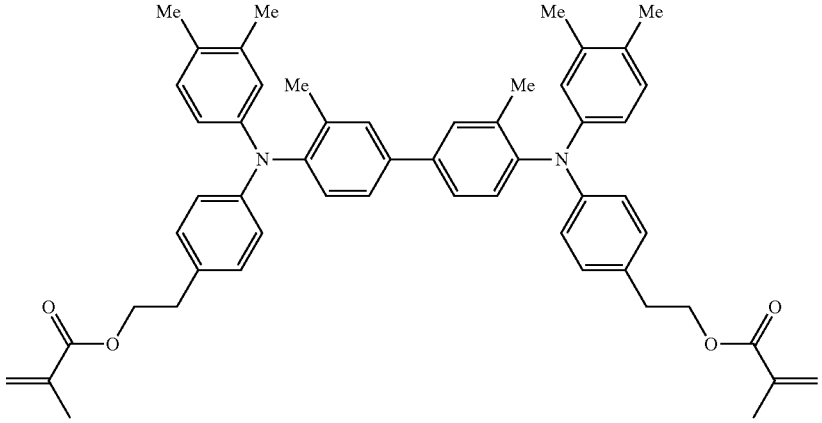 |
| ii-11 | 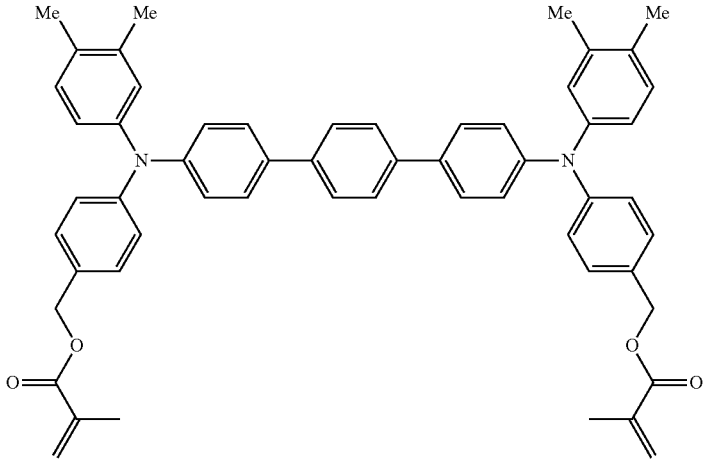 |

-continued
| No. |
| --- |
| ii-12 |
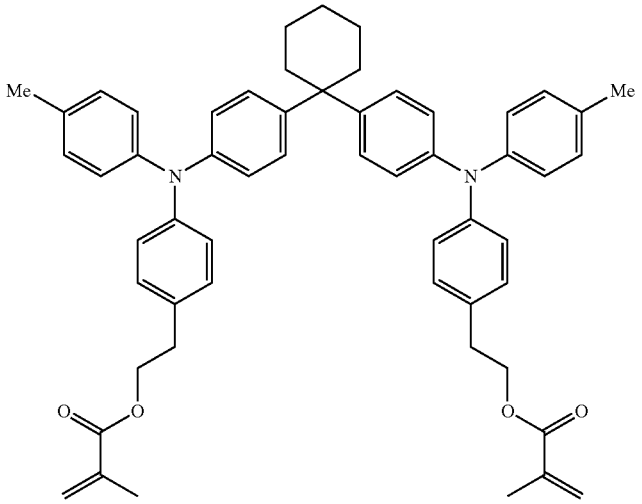
ii-13
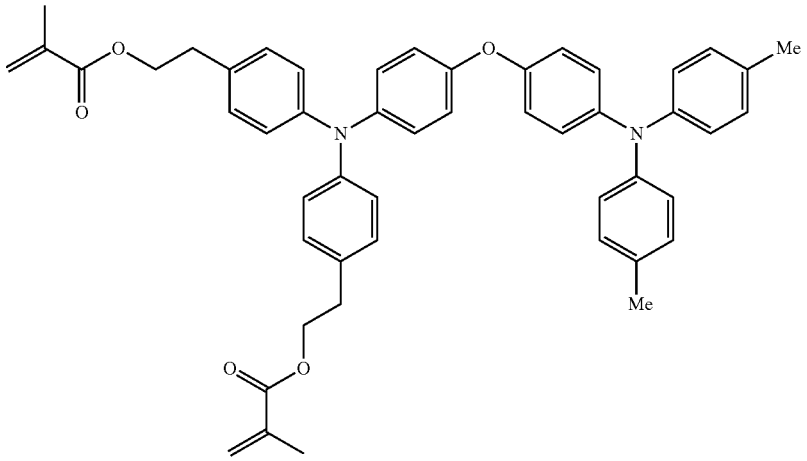
ii-14
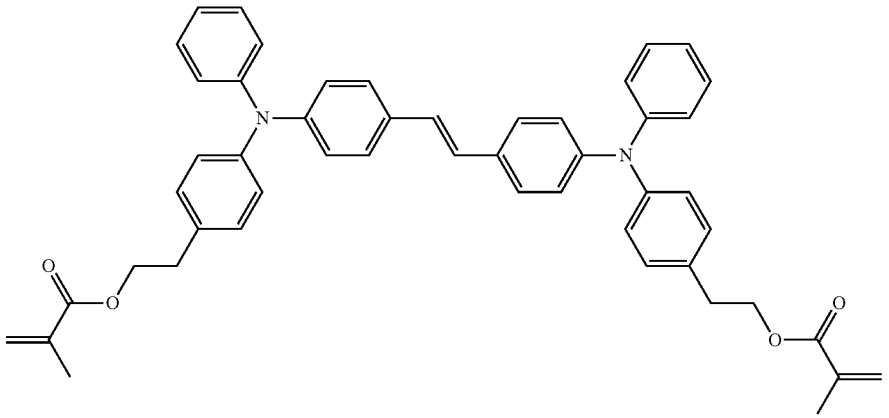

-continued
| No. |
| --- |
| ii-15 |
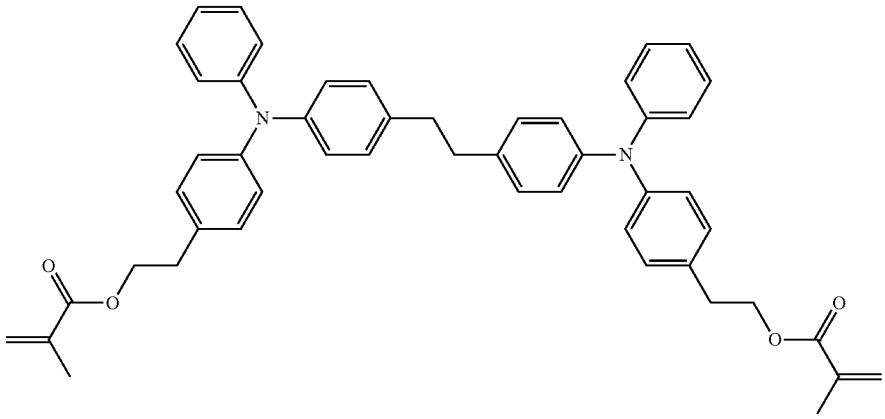
ii-16
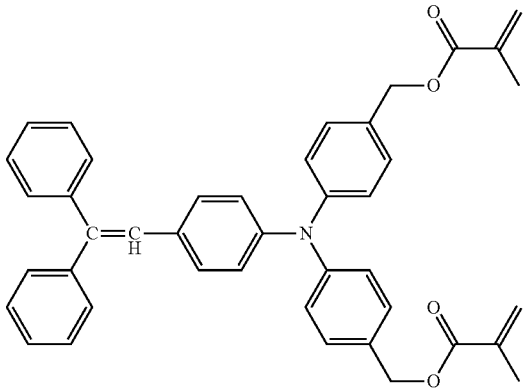
ii-17
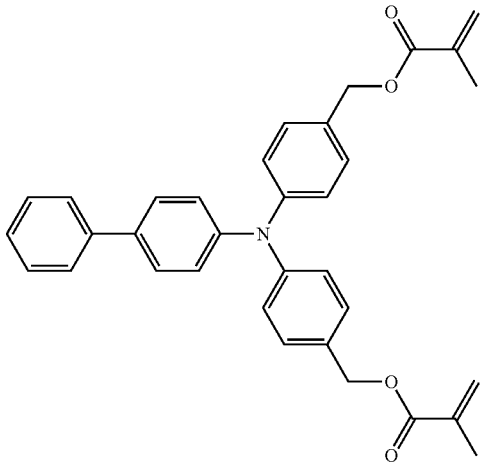

-continued
| No. | |
|---|---|
| ii-18 | 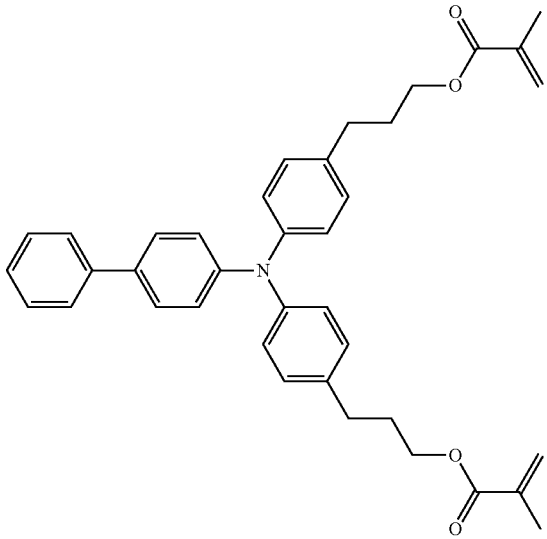 |
| ii-19 | 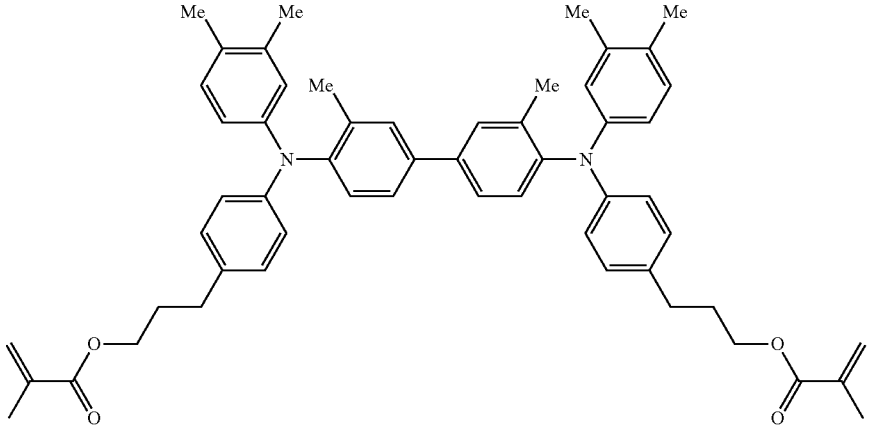 |
| ii-20 | 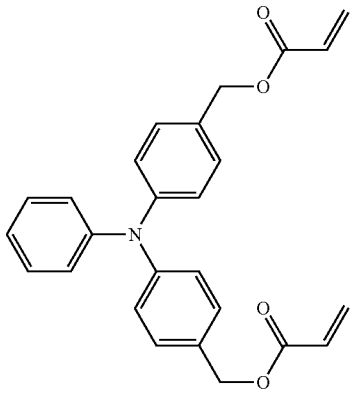 |

-continued
| No. |
| --- |
| ii-21 |
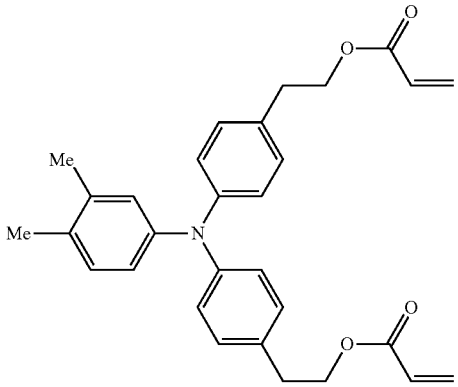
ii-22
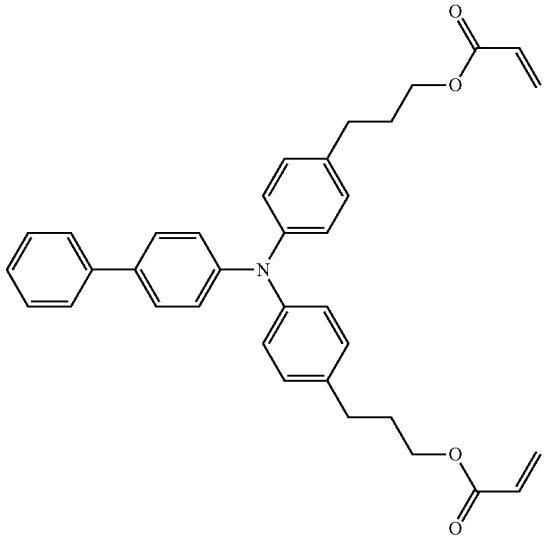
ii-23
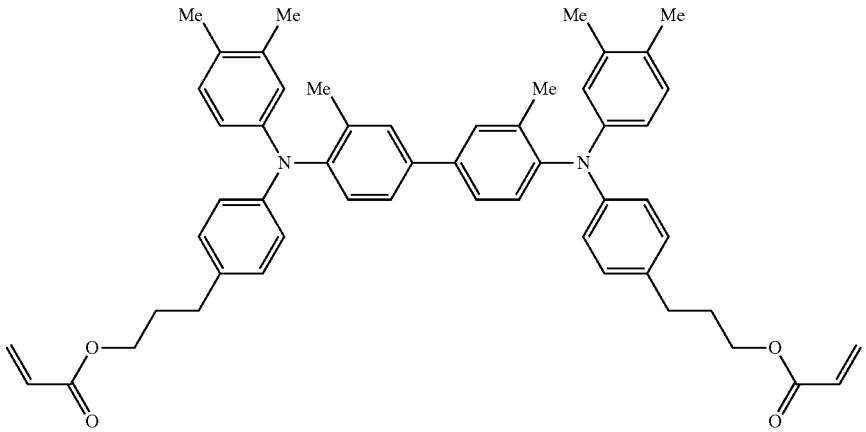

-continued
| No. | |
|---|---|
| ii-24 | 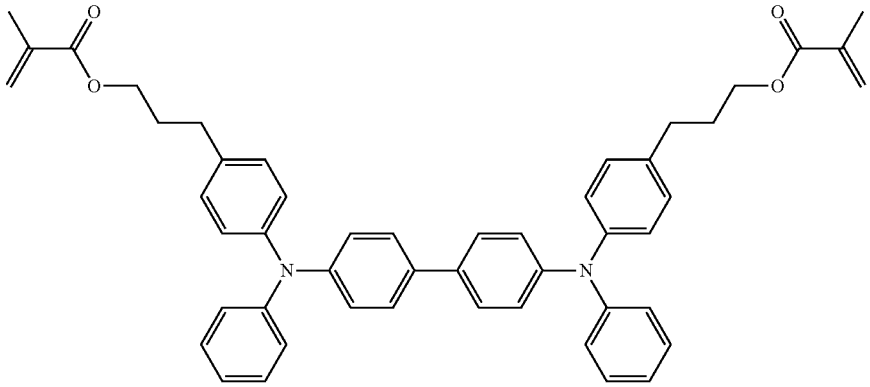 |
| ii-25 | 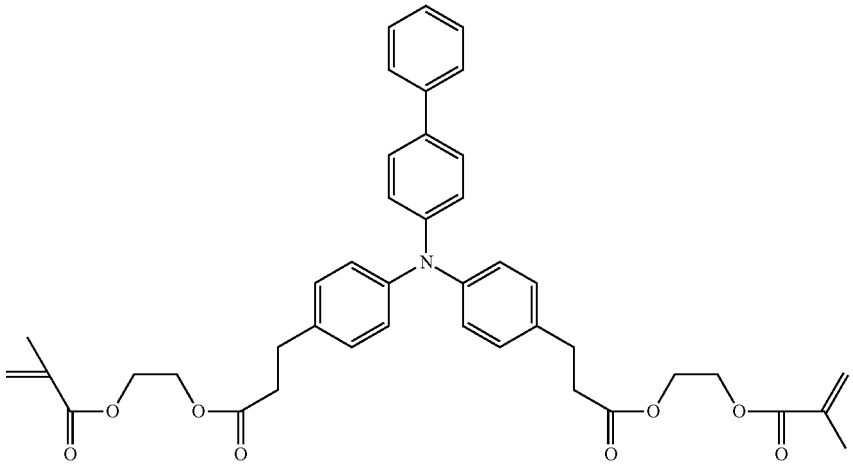 |
| ii-26 | 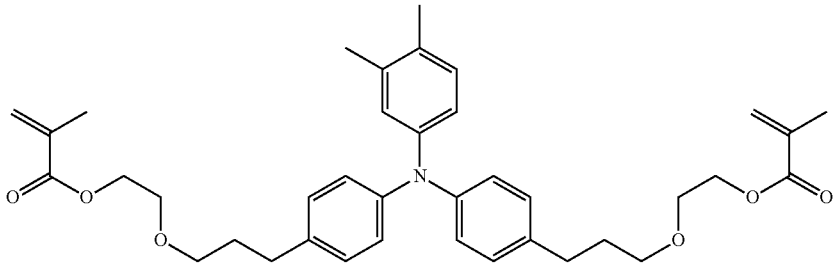 |
| ii-27 | 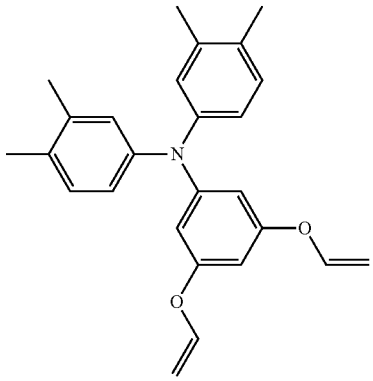 |

-continued
| No. |
| --- |
| ii-28 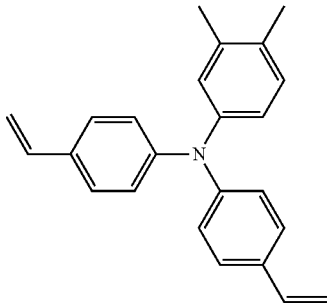 |
| ii-29 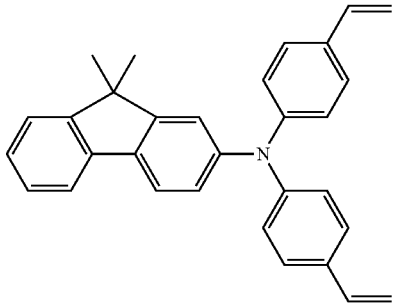 |
| ii-30 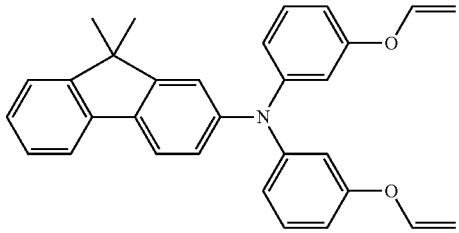 |
| ii-31 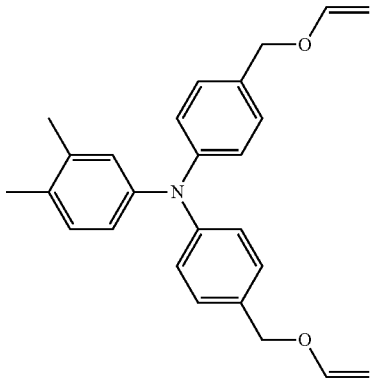 |
| ii-32 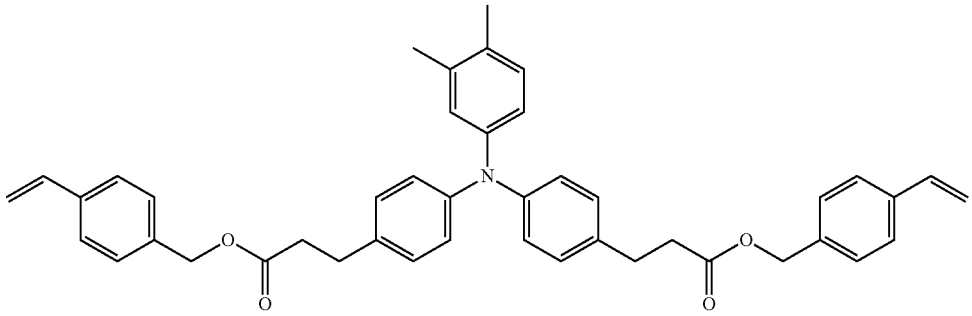 |

-continued
| No. |
| --- |
| ii-33 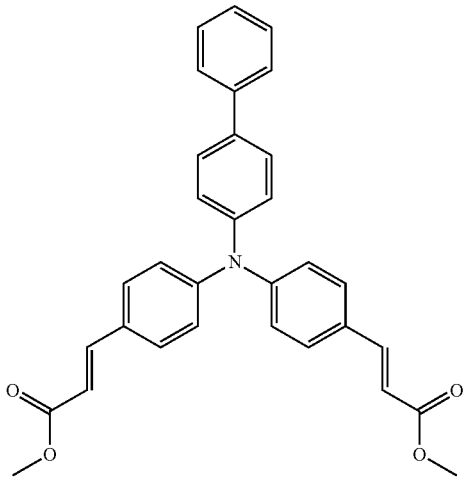 |
| ii-34 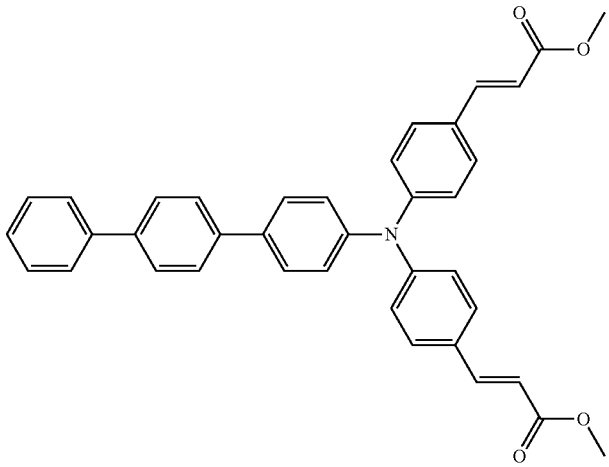 |
| ii-35 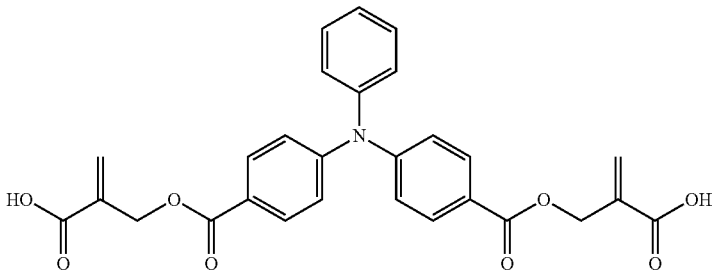 |
| ii-36 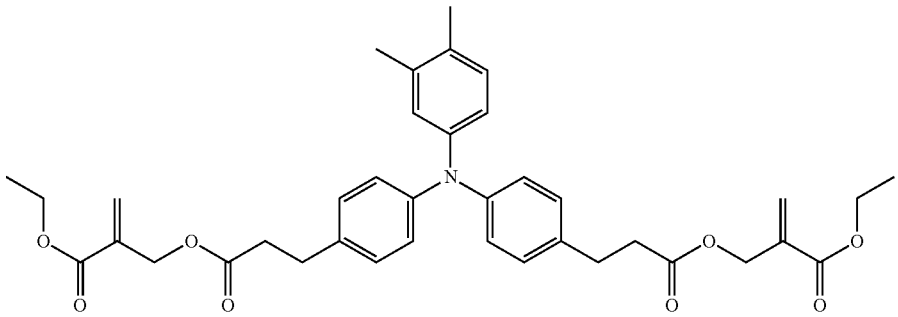 |

-continued
| No. |
| --- |
| ii-37 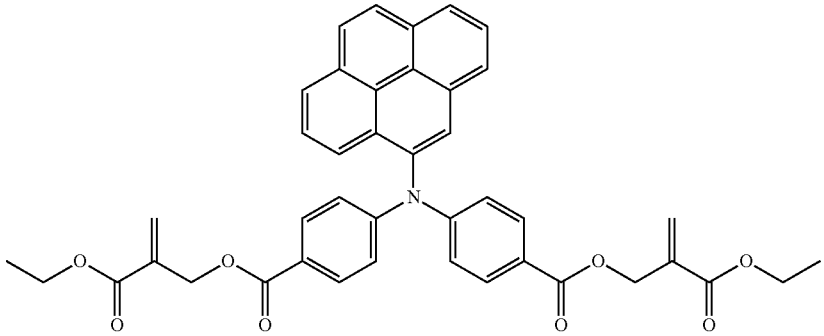 |
| ii-38 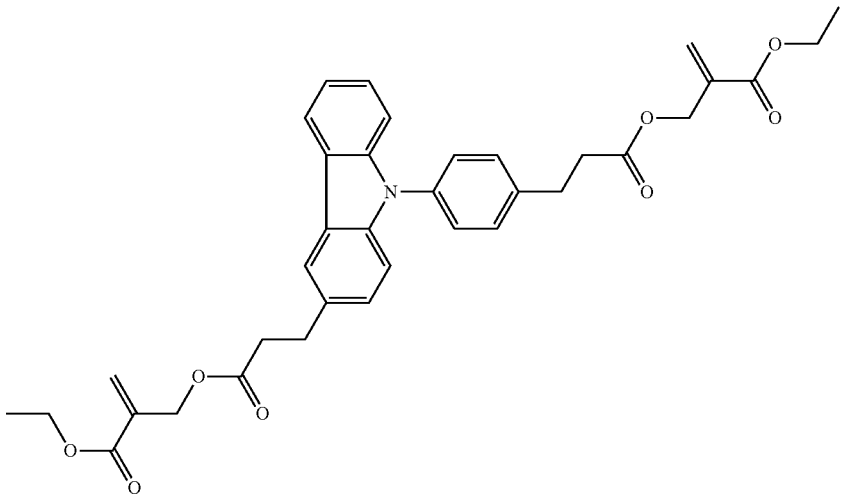 |
| ii-39 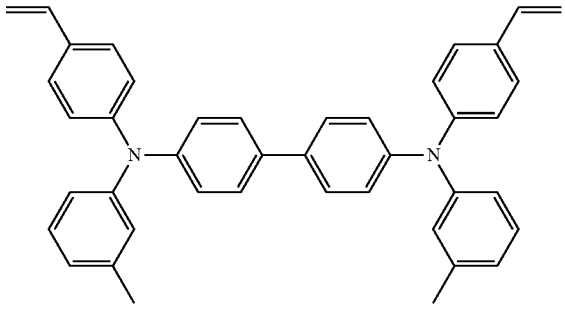 |
| ii-40 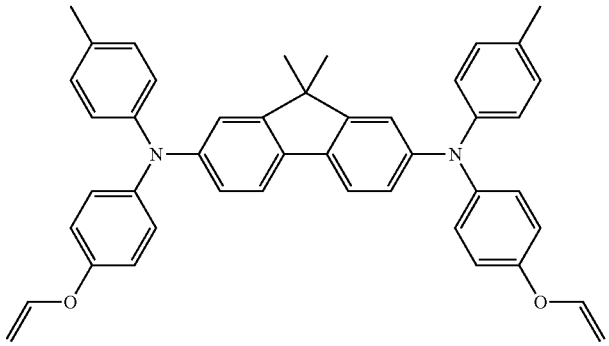 |

-continued
No.
ii-41
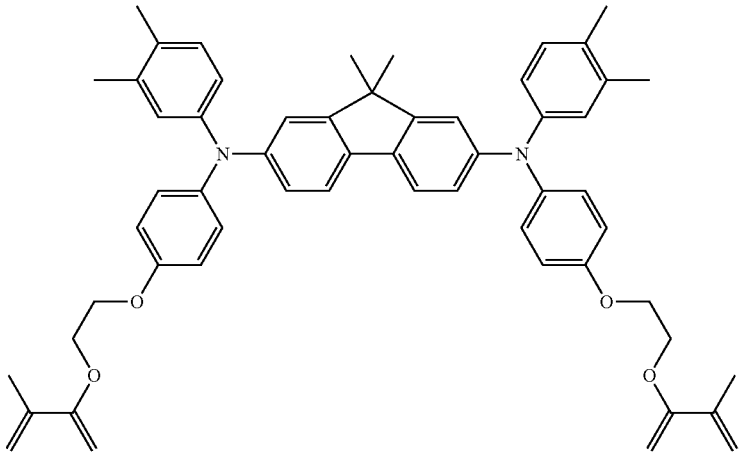
ii-42
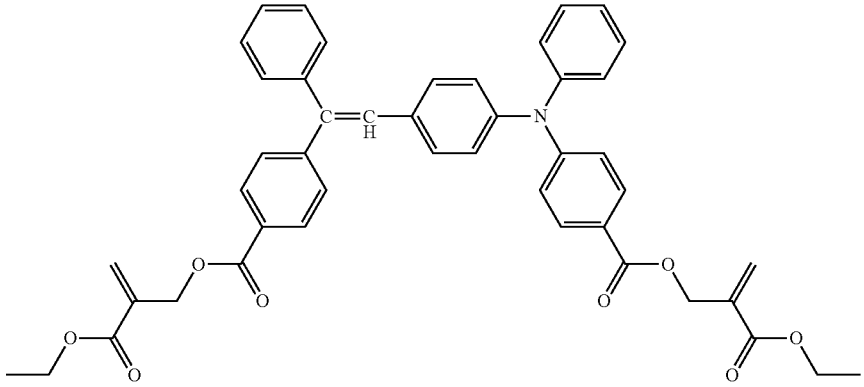
ii-43
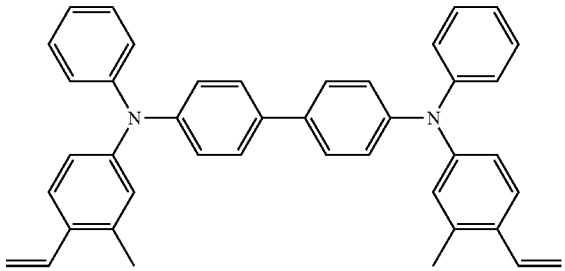
ii-44
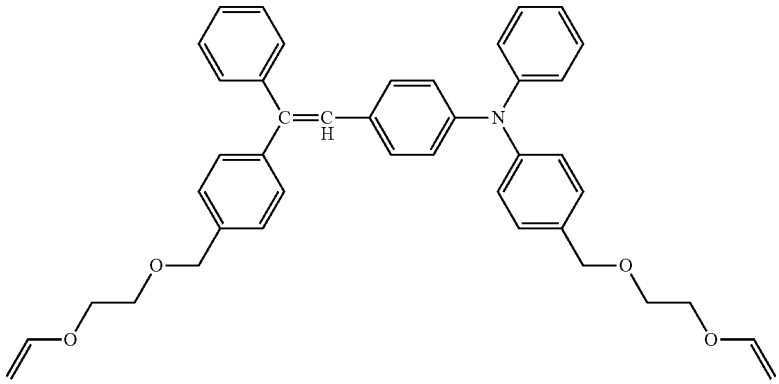

-continued
| No. | |
|---|---|
| ii-45 | 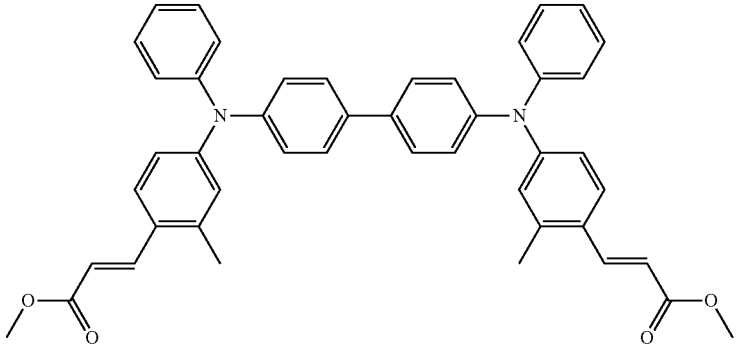 |
| ii-46 | 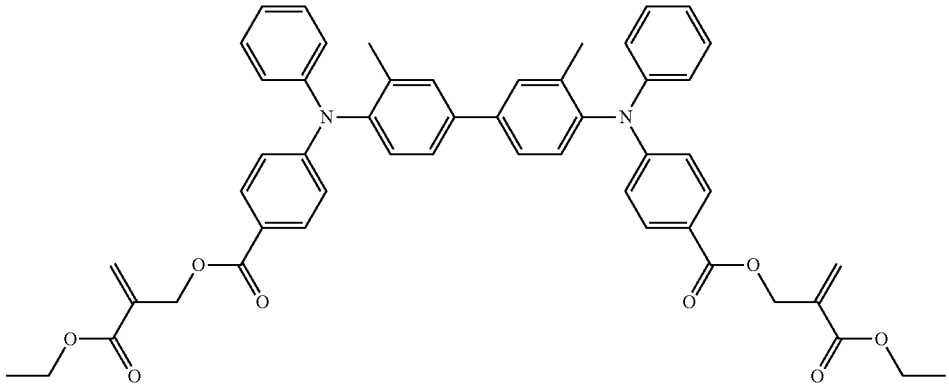 |
| ii-47 | 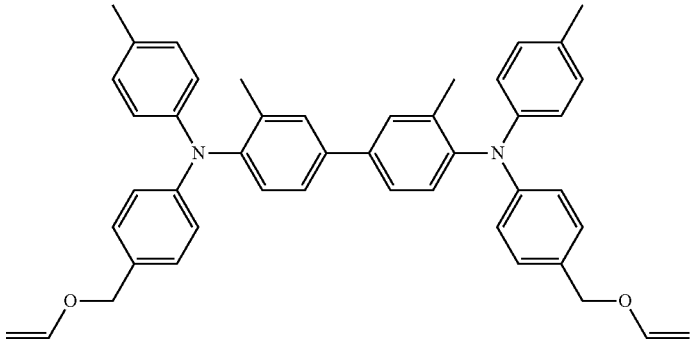 |
| ii-48 | 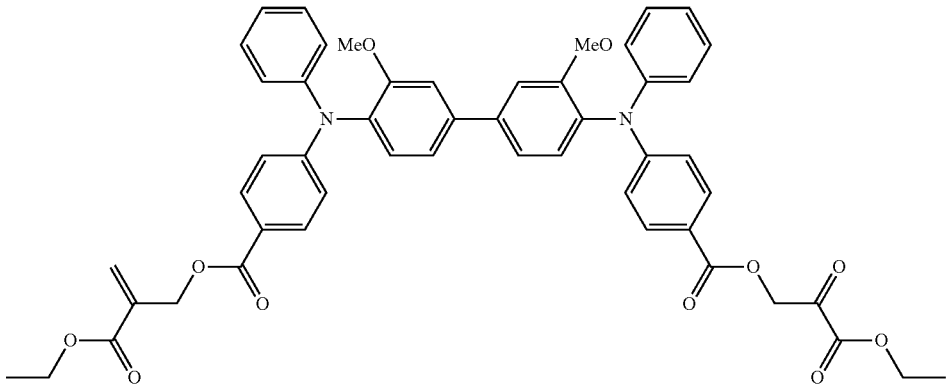 |

-continued
| No. | |
|---|---|
| ii-49 | 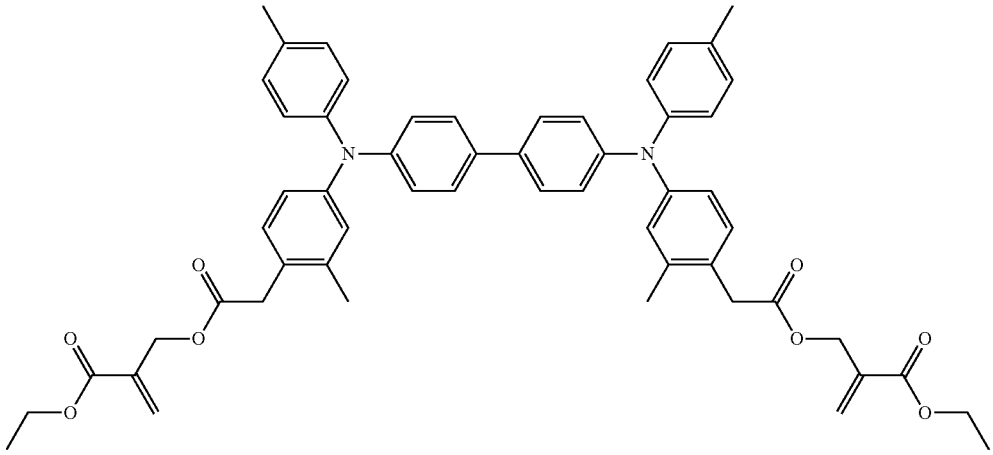 |
| ii-50 | 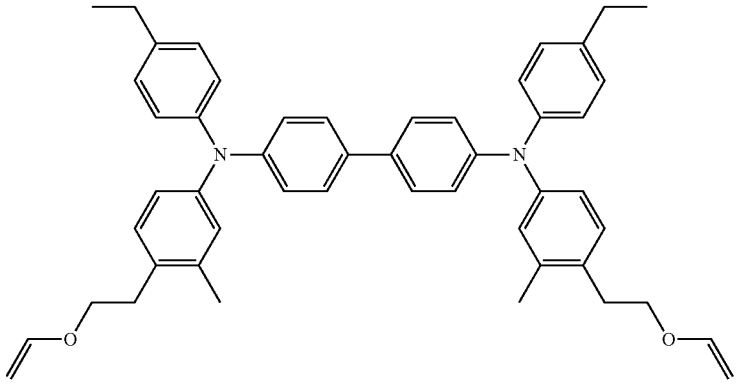 |
| ii-51 | 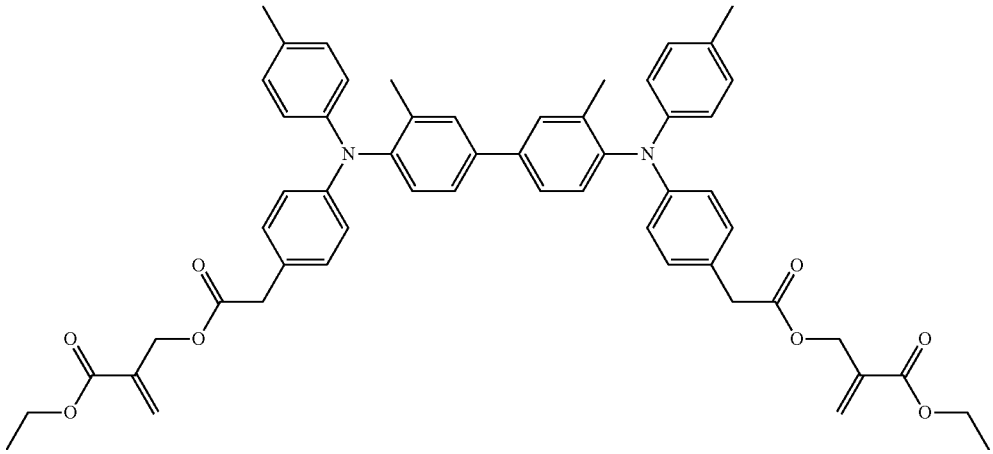 |

-continued
| No. | |
|---|---|
| ii-52 | 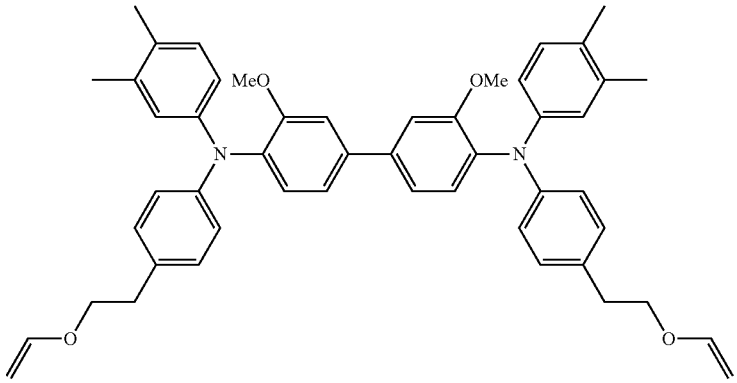 |
| ii-53 | 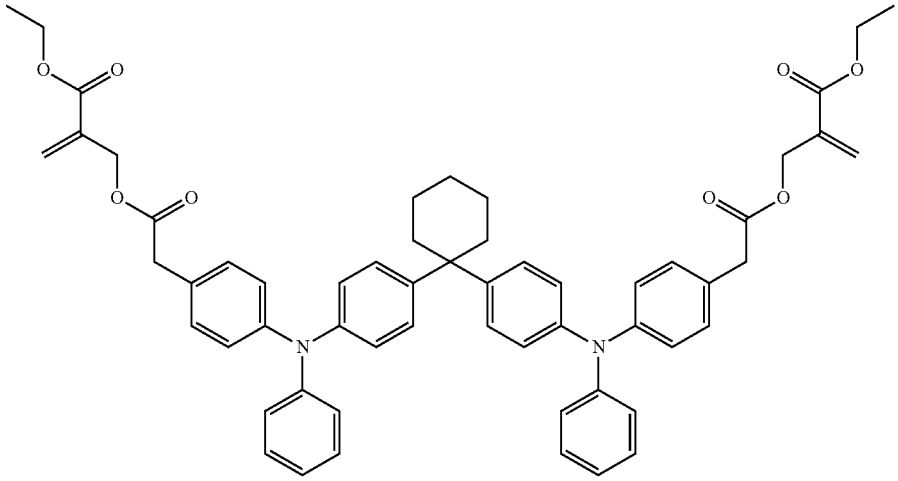 |
| ii-54 | 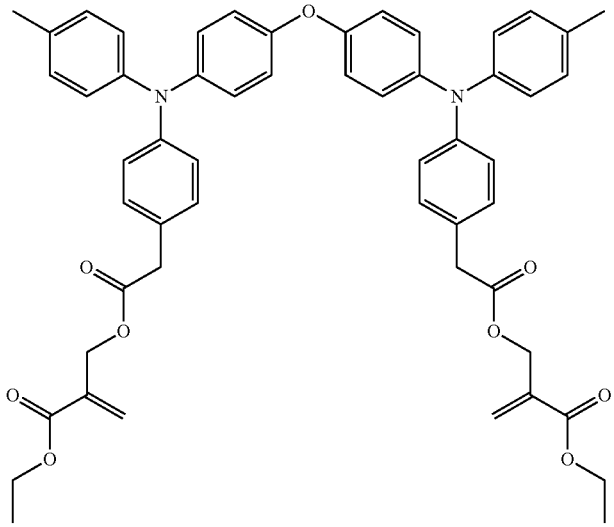 |

-continued
| No. | |
|---|---|
| ii-55 | 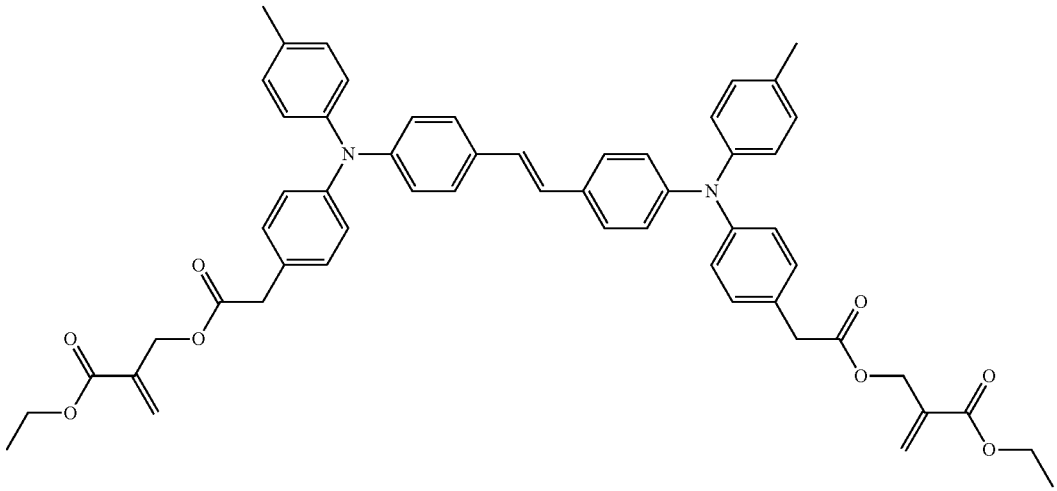 |
| ii-56 | 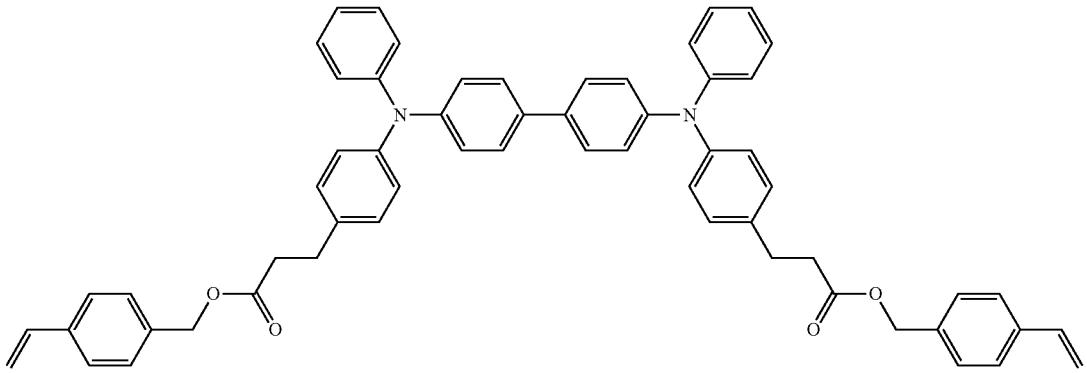 |
Next, specific examples of a specific charge transportable material having three chain polymerizable functional groups are shown but are not limited thereto.
| No. | |
|---|---|
| iii-1 | 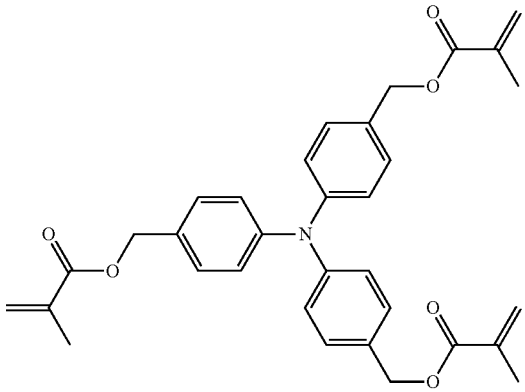 |

-continued
No.
iii-2
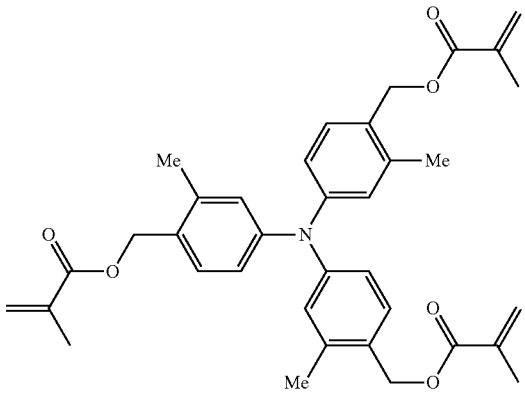
iii-3
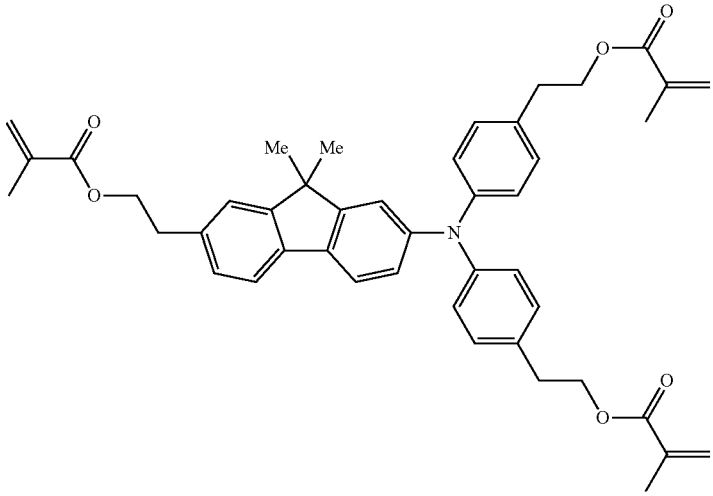
iii-4
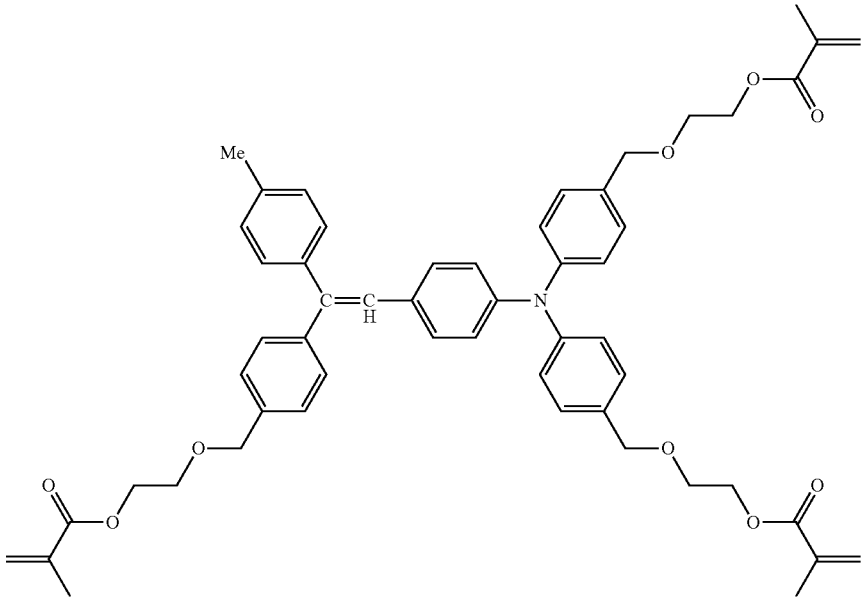

-continued
| No. |
| --- |
| iii-5 |
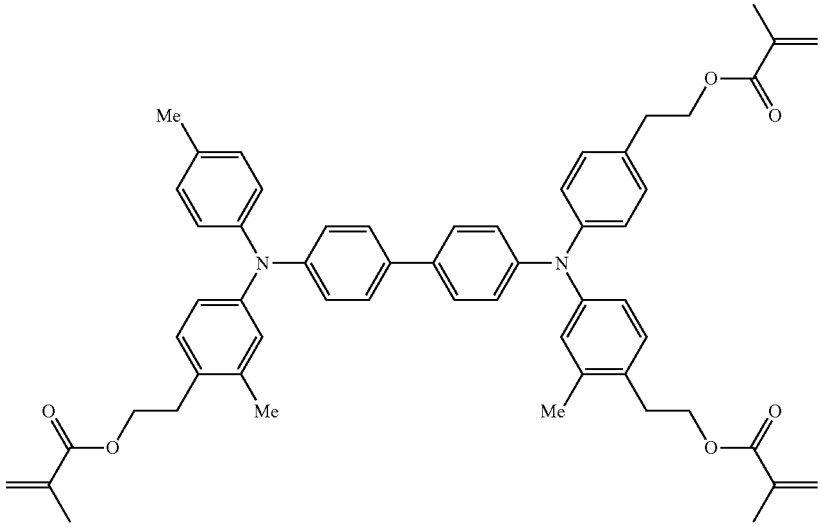
iii-6
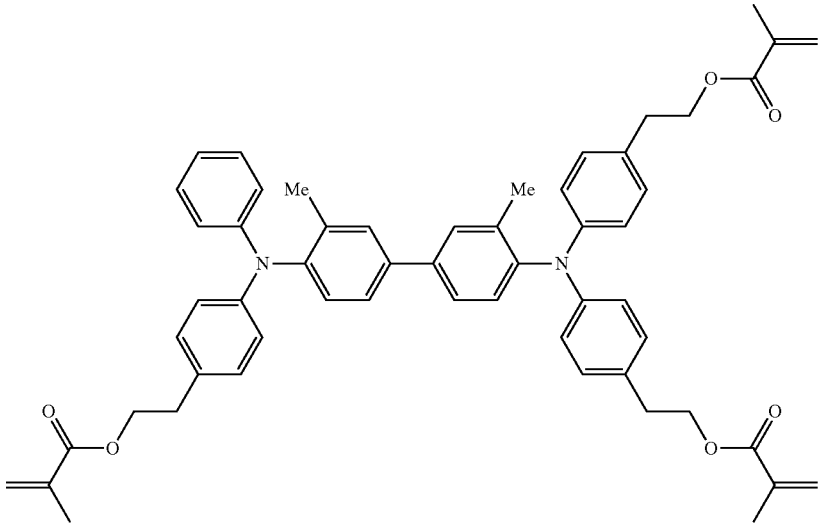
iii-7
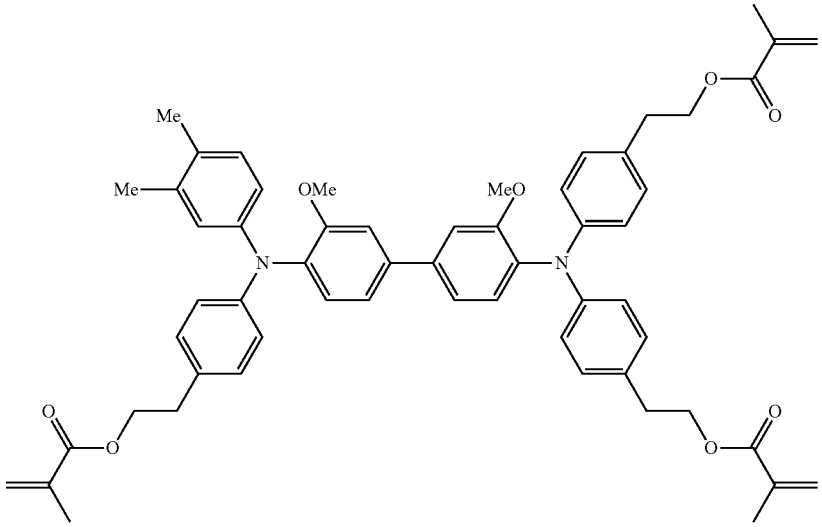

-continued
| No. |
| --- |
| iii-8 |
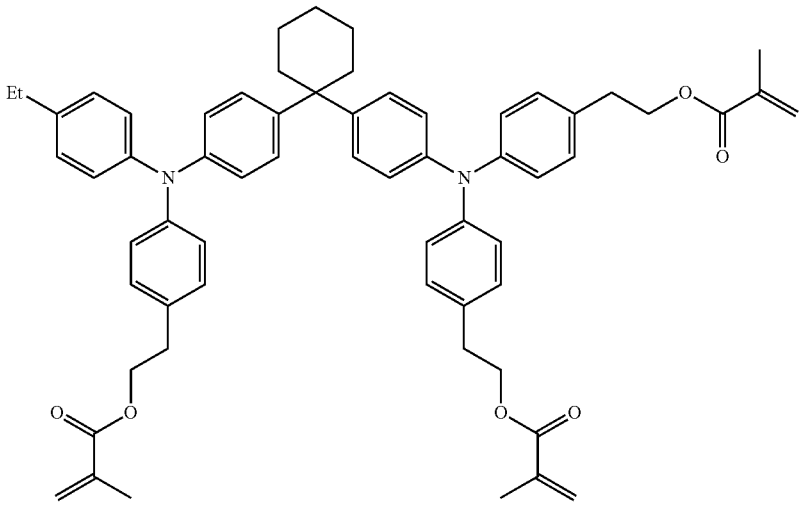
iii-9
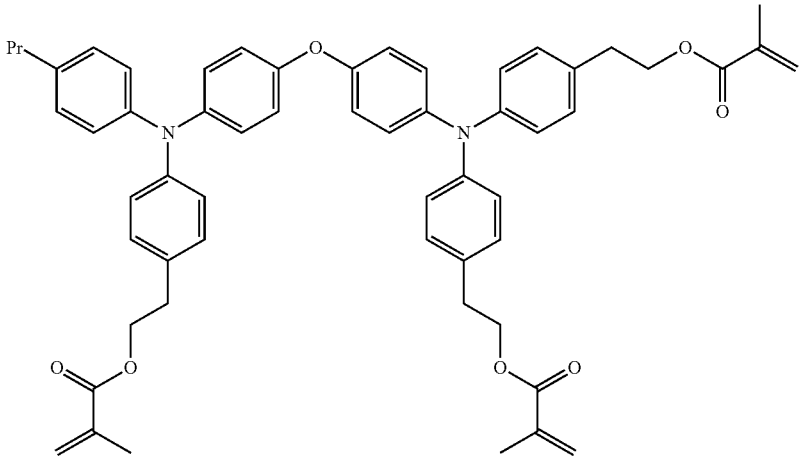
iii-10
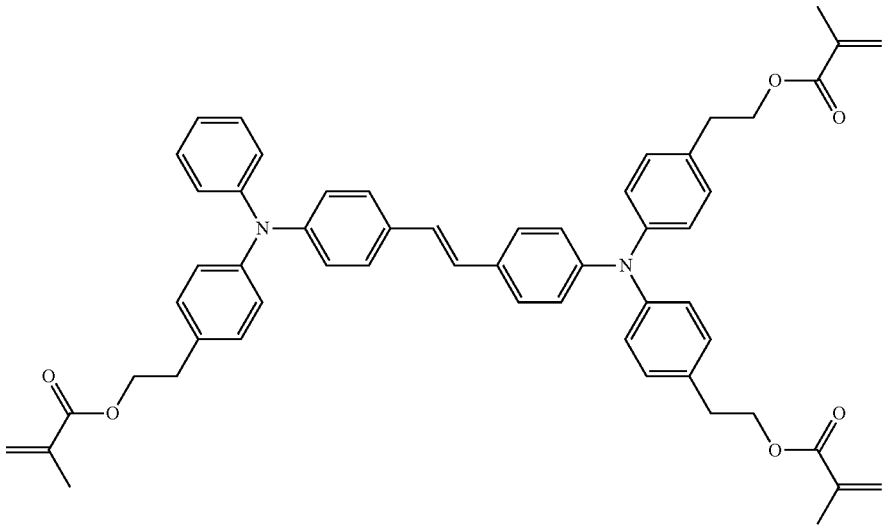

-continued
No.
iii-11
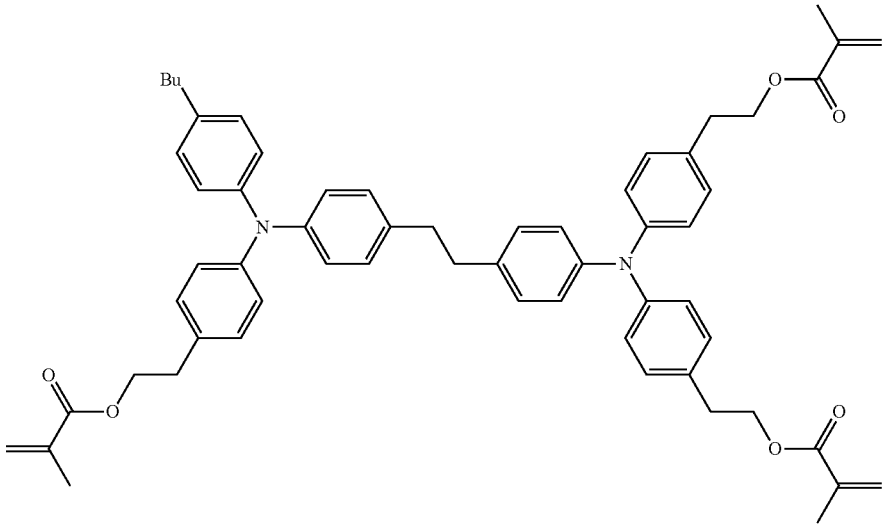
iii-12
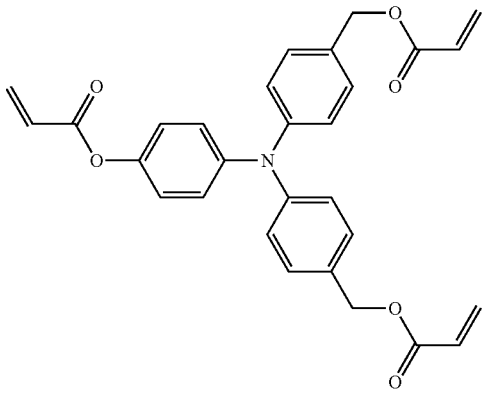
iii-13
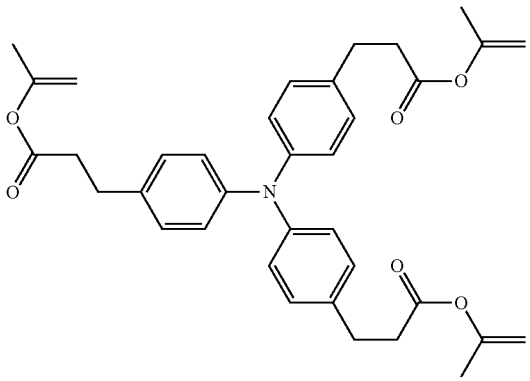

-continued
| No. |
|---|
| iii-14 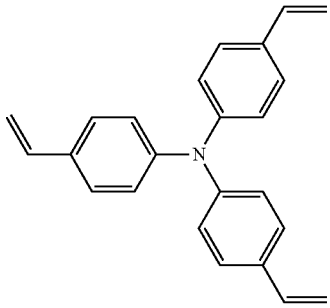 |
| iii-15 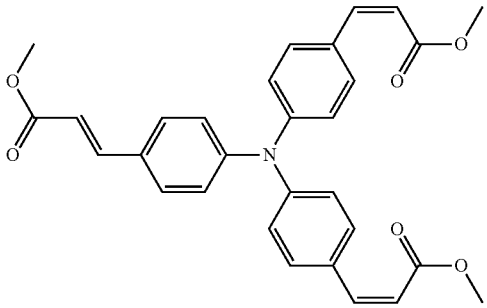 |
| iii-16 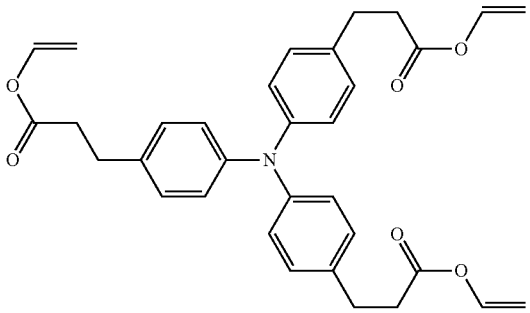 |
| iii-17 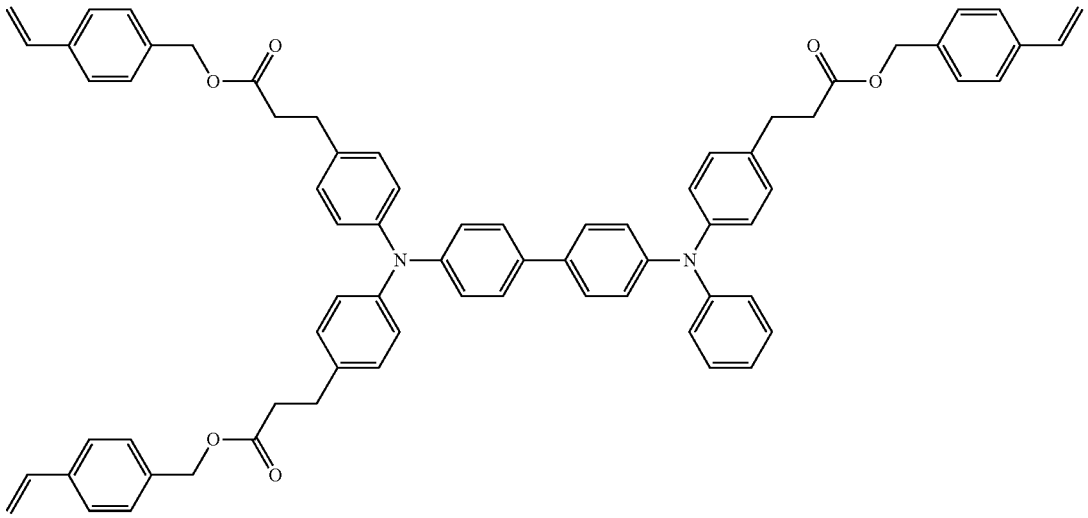 |

-continued
| No. | |
|---|---|
| iii-18 | 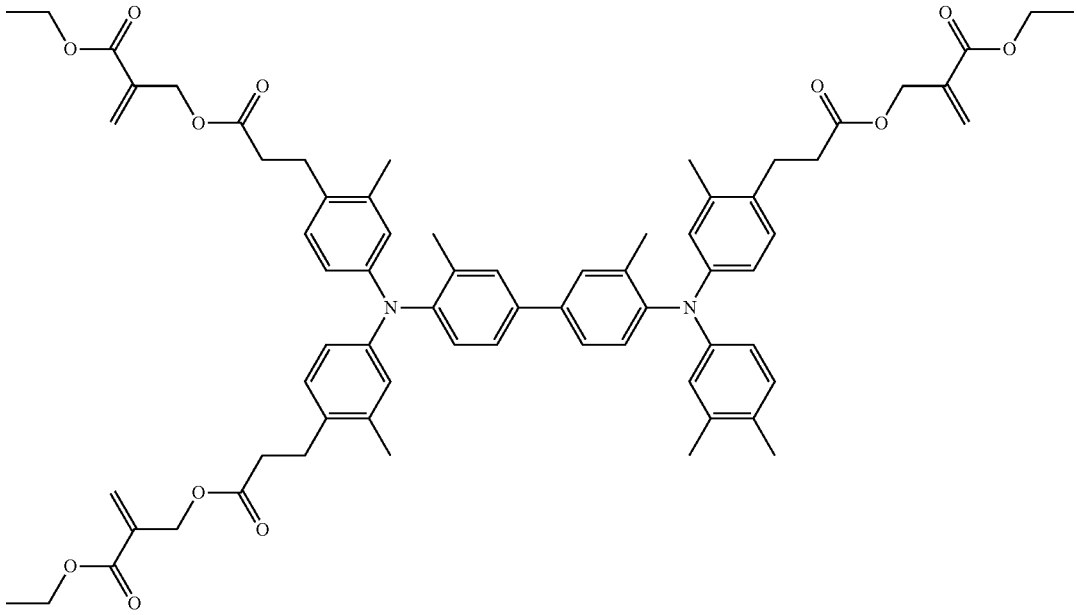 |
| iii-19 | 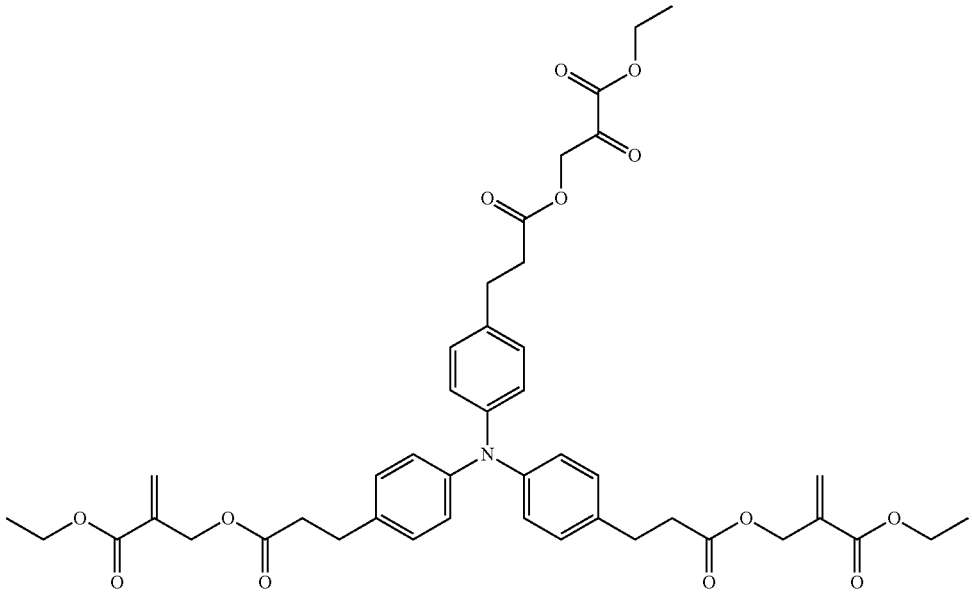 |

Specific examples of a specific charge transportable material having four chain polymerizable functional groups are shown but are not limited thereto.
| No. | |
|---|---|
| iv-1 | 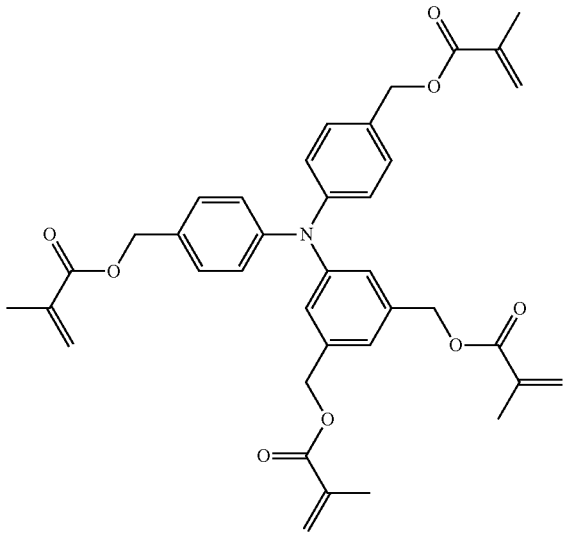 |
| iv-2 | 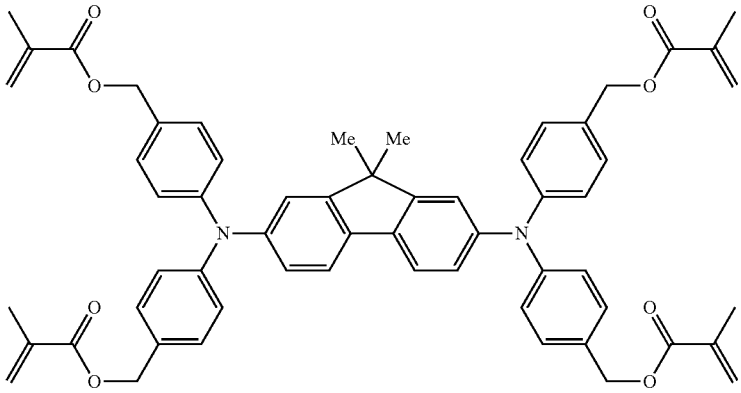 |
| iv-3 | 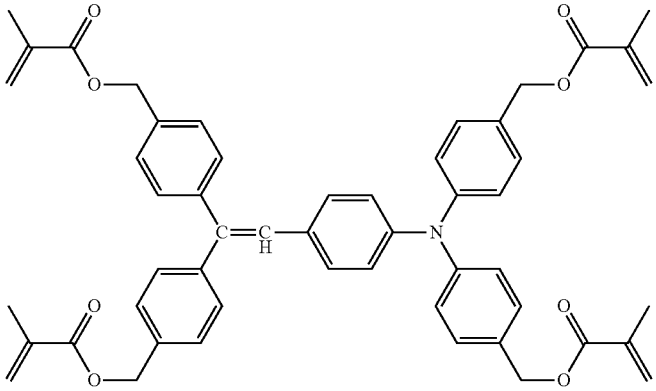 |

-continued
| No. | |
|---|---|
| iv-4 | 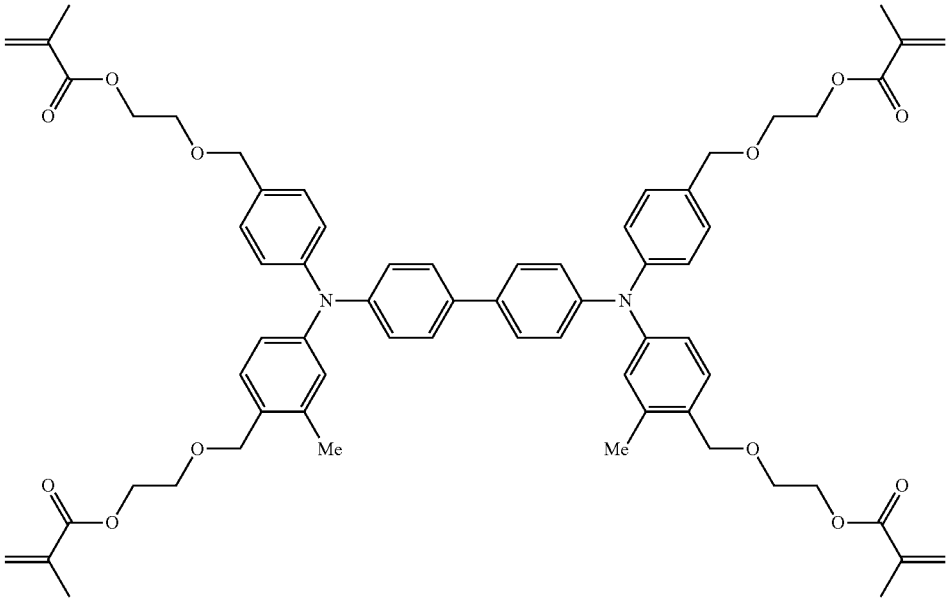 |
| iv-5 | 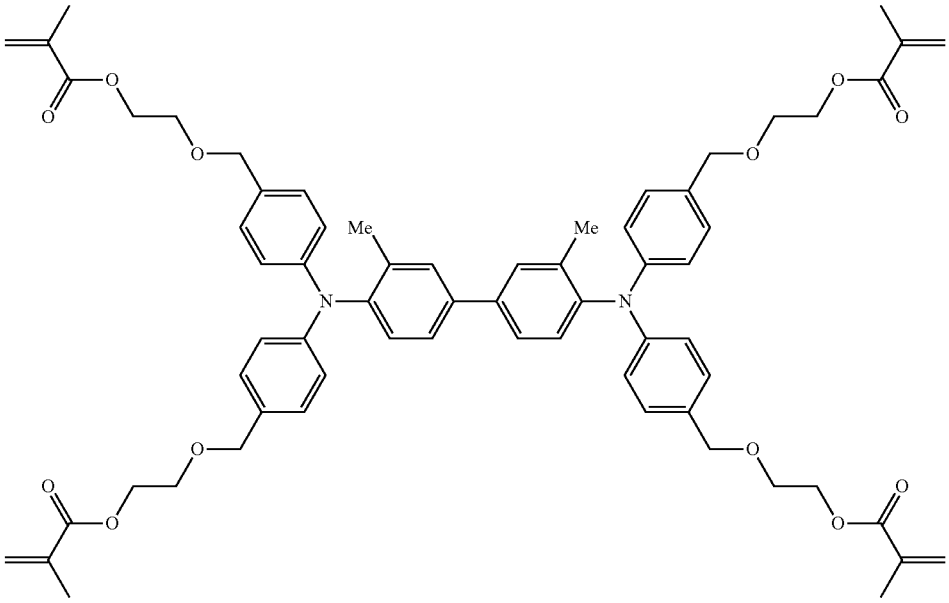 |

-continued
| No. | |
|---|---|
| iv-6 | 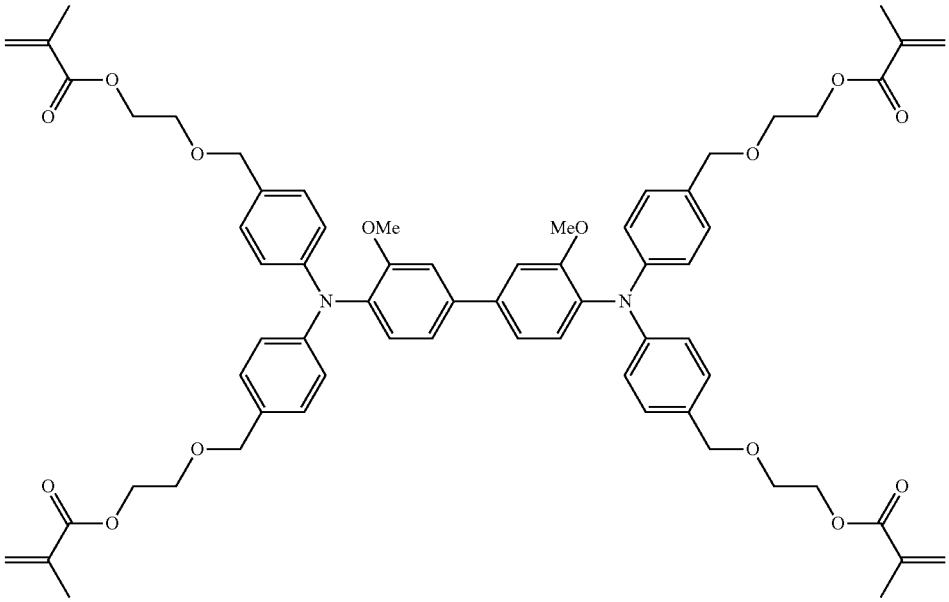 |
| iv-7 | 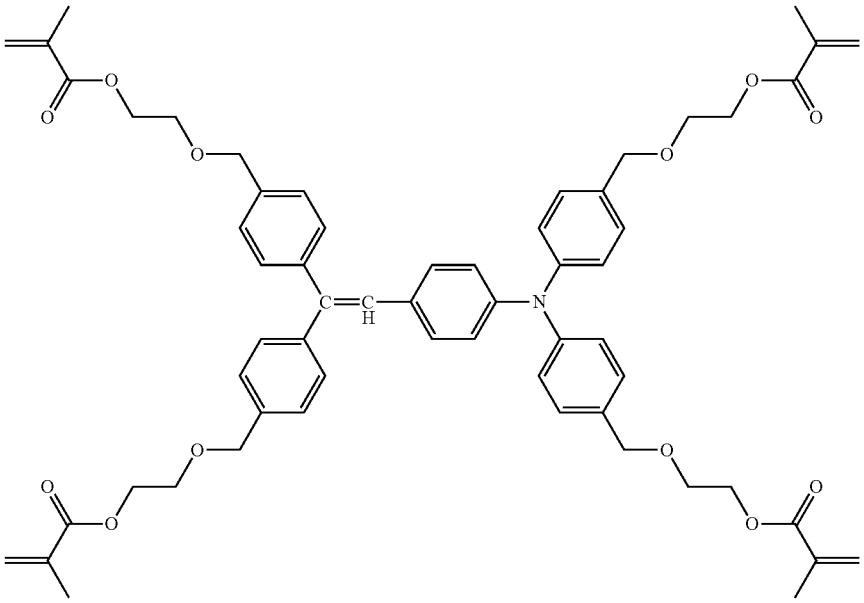 |

-continued
| No. | |
|---|---|
| iv-8 | 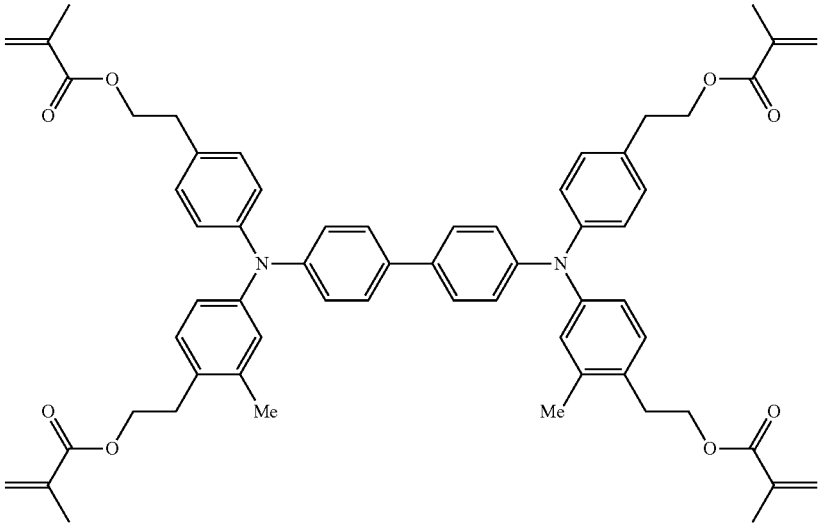 |
| iv-9 | 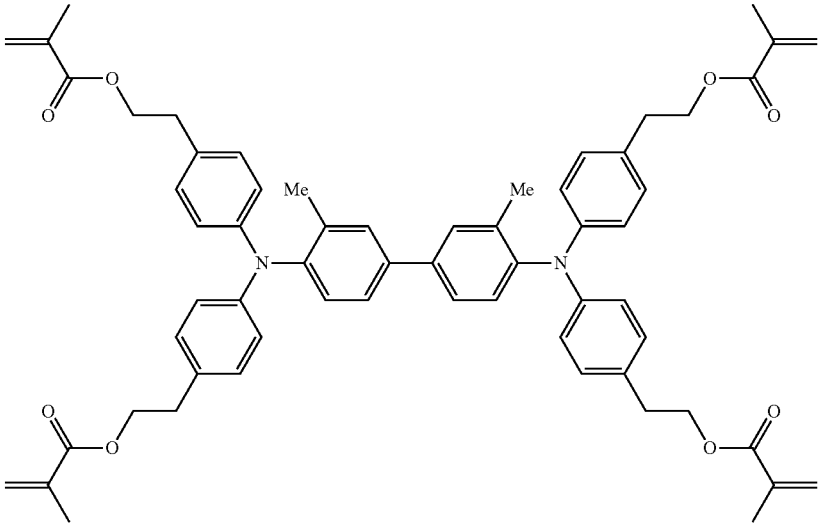 |
| iv-10 | 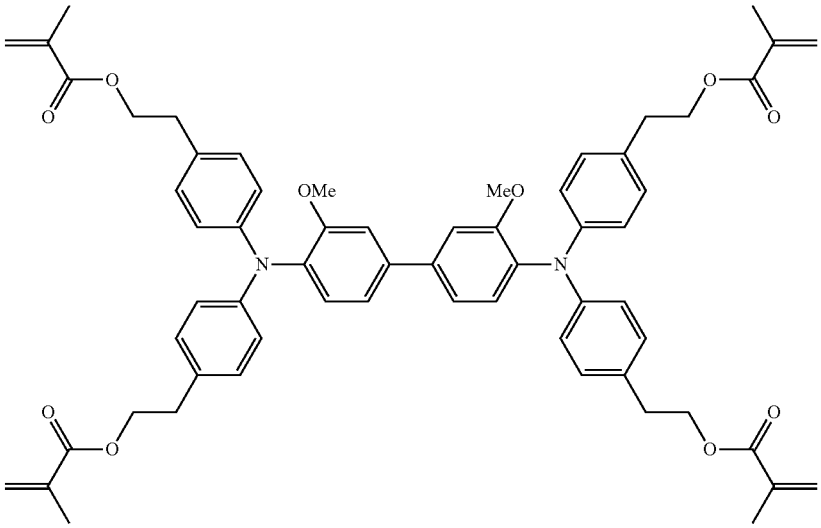 |

-continued
| No. | |
|---|---|
| iv-11 | 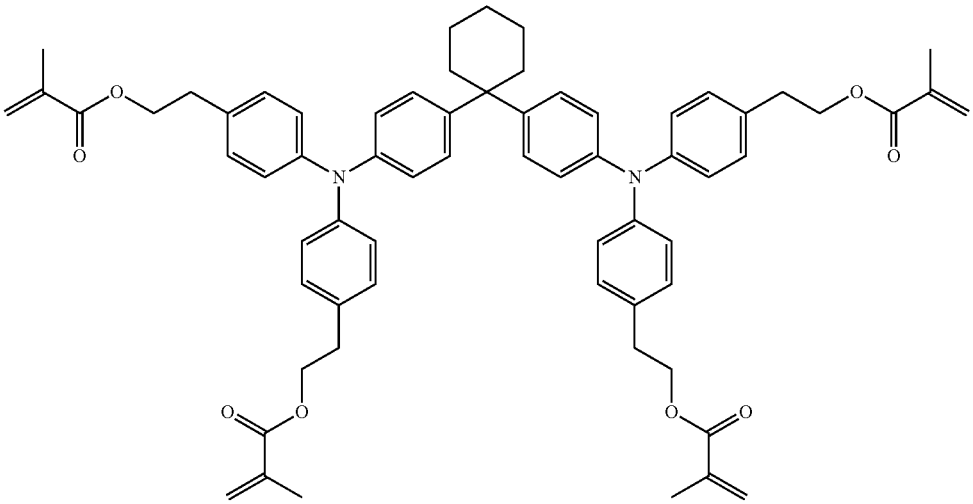 |
| iv-12 | 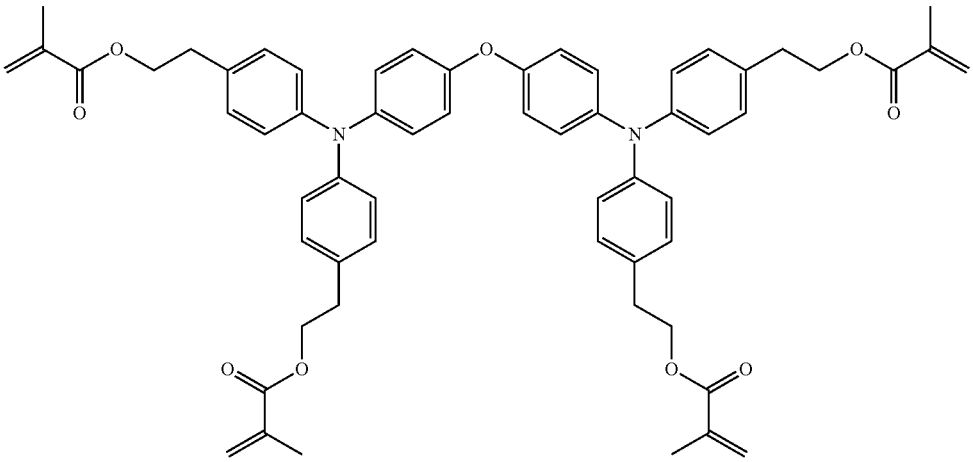 |
| iv-13 | 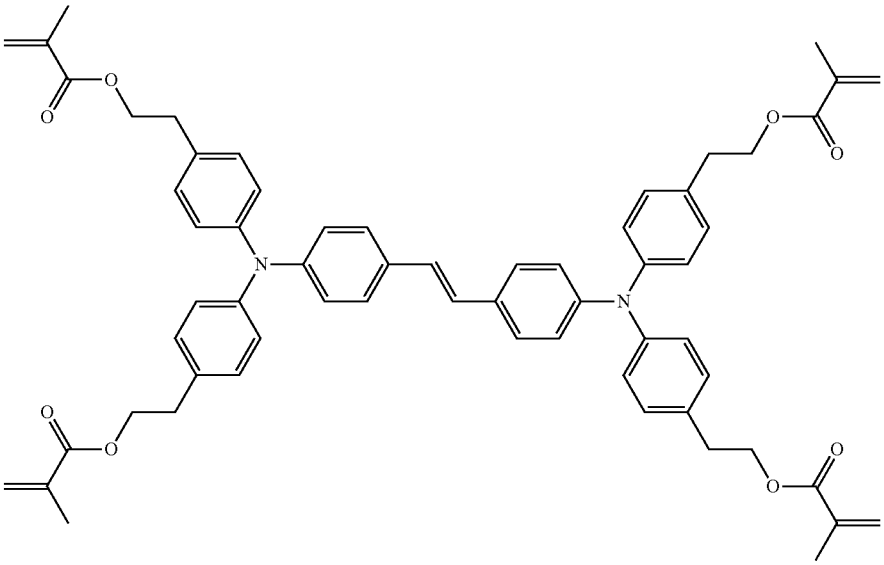 |

-continued
| No. | |
|---|---|
| iv-14 | 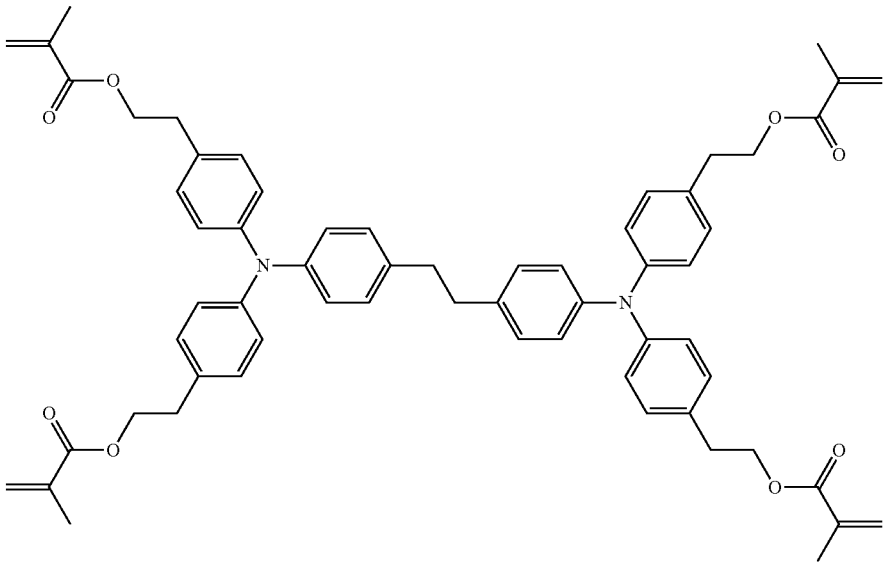 |
| iv-15 | 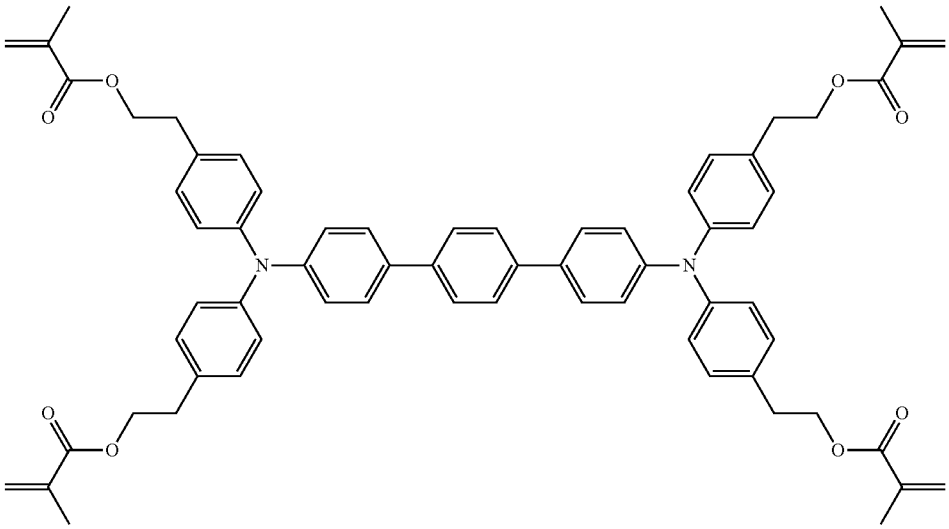 |

-continued
| No. | |
|---|---|
| iv-16 | 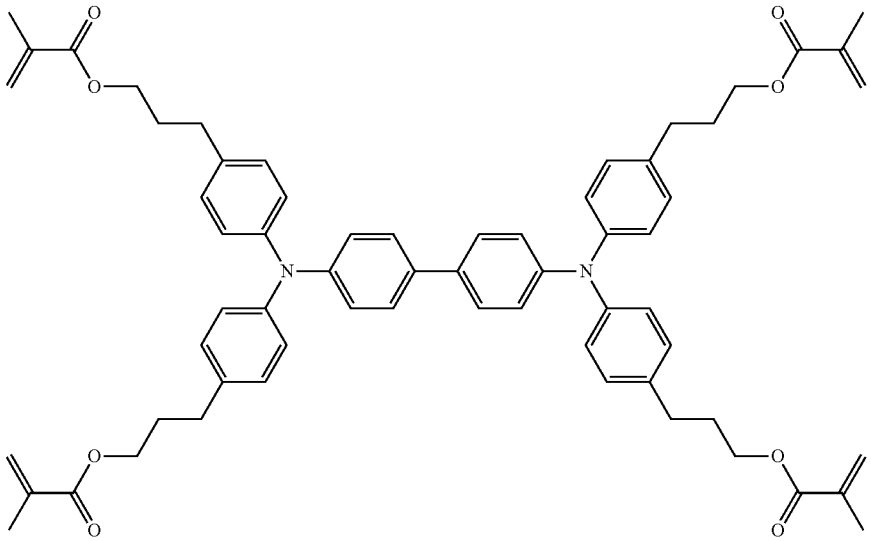 |
| iv-17 | 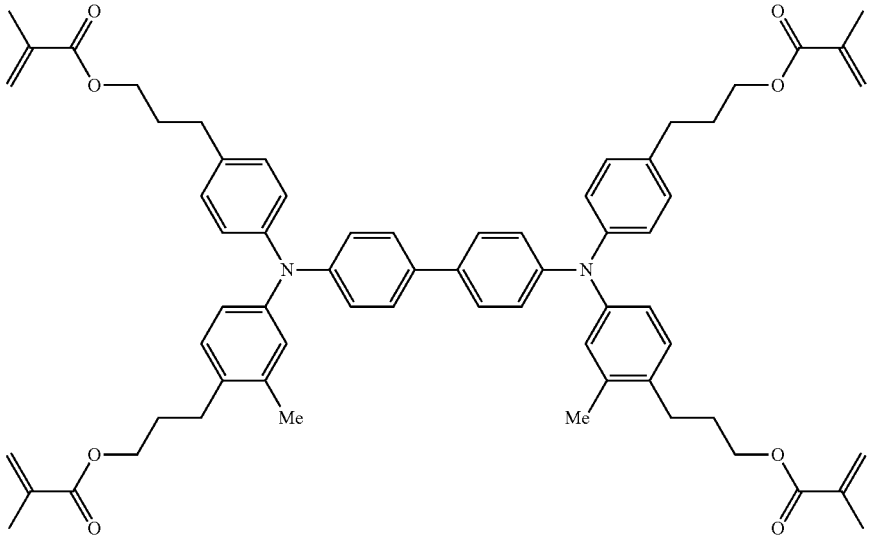 |
| iv-18 | 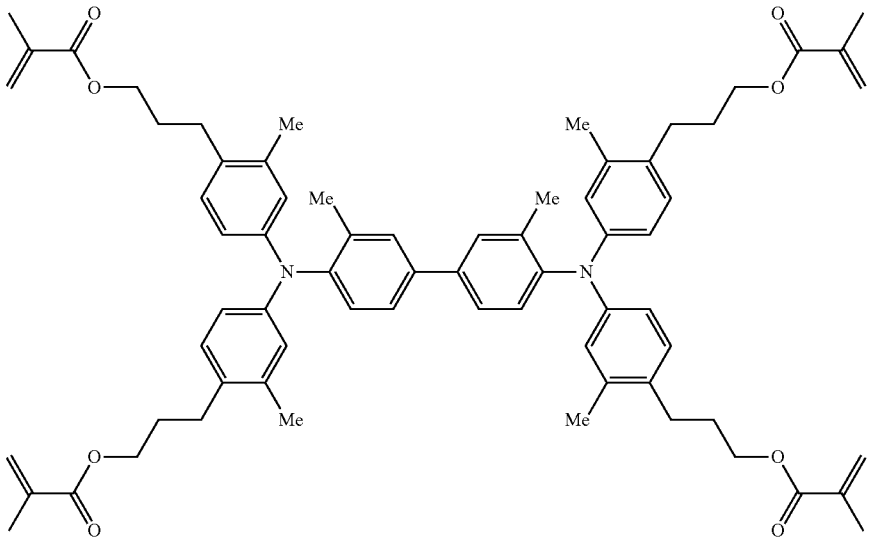 |

-continued
| No. |
| --- |
| iv-19 |
| iv-20 |
| iv-21 |
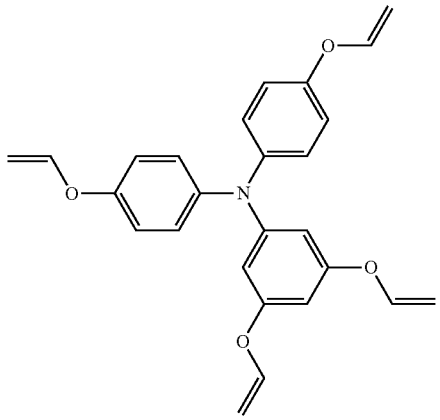
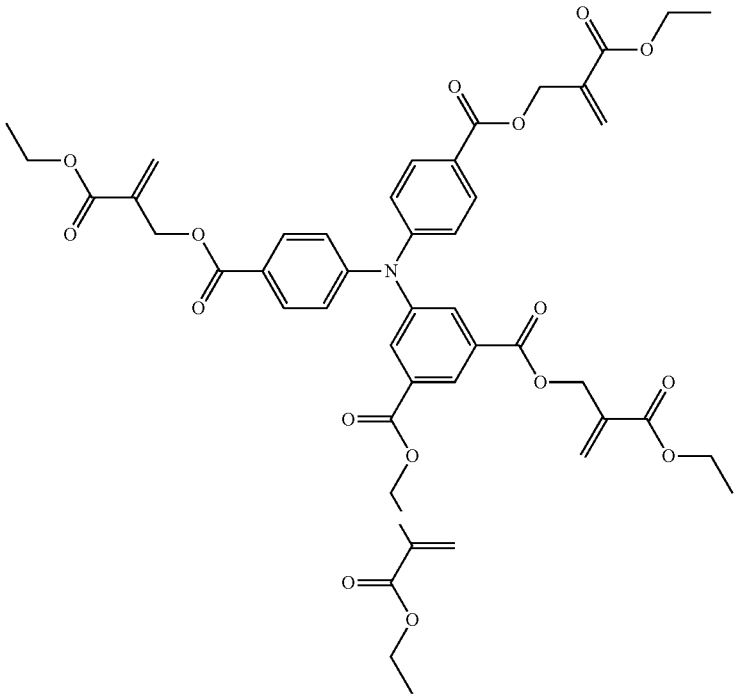
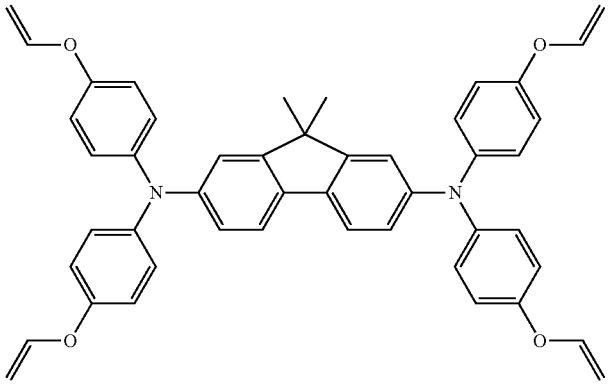

-continued
| No. | |
|---|---|
| iv-22 | 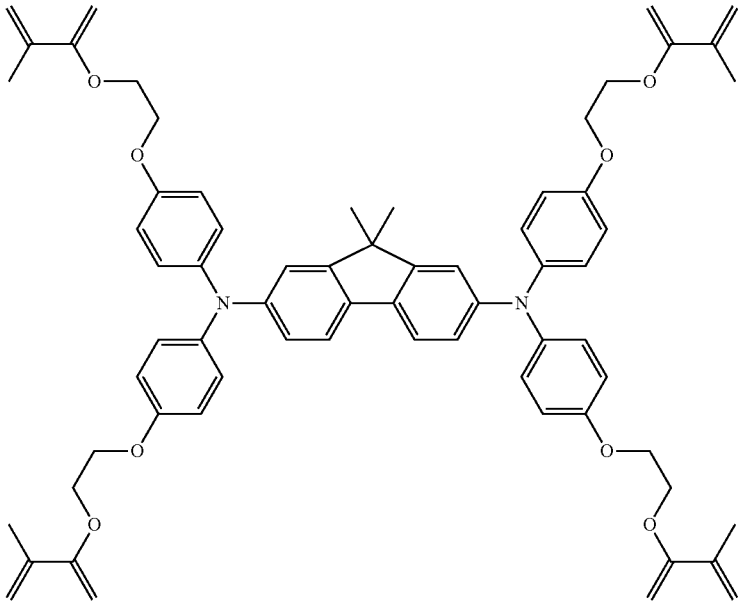 |
| iv-23 | 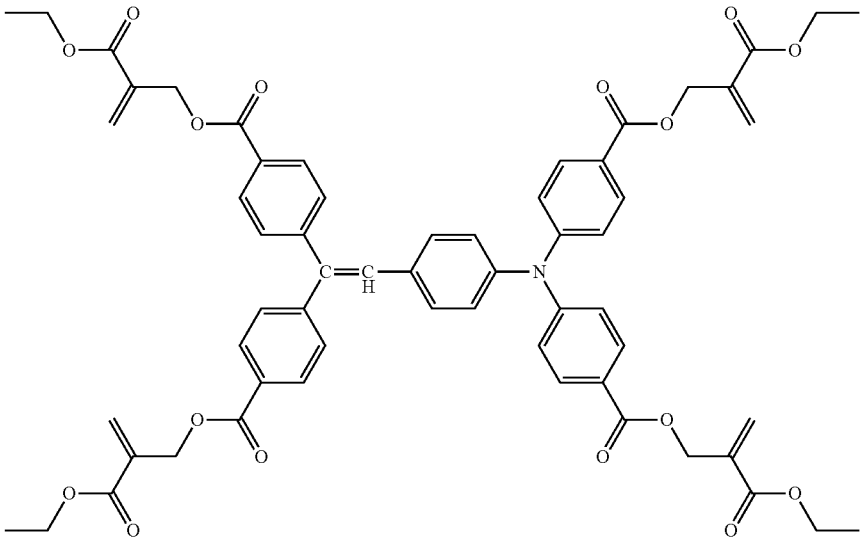 |

-continued
| No. | |
|---|---|
| iv-24 | 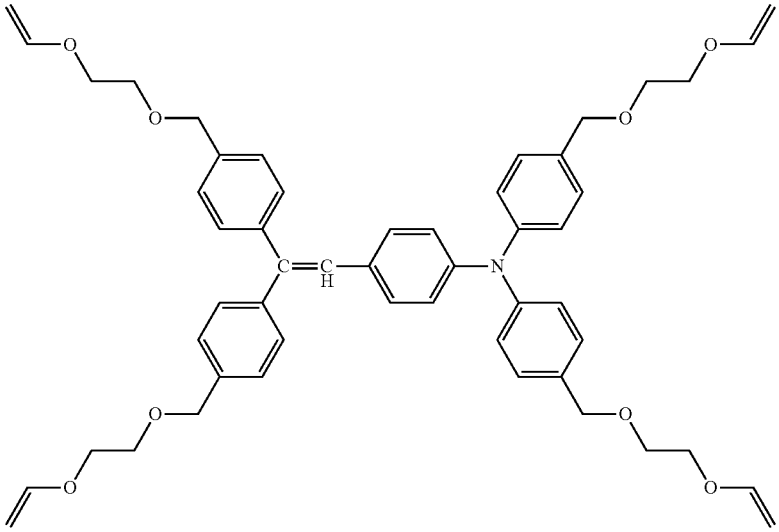 |
| iv-25 | 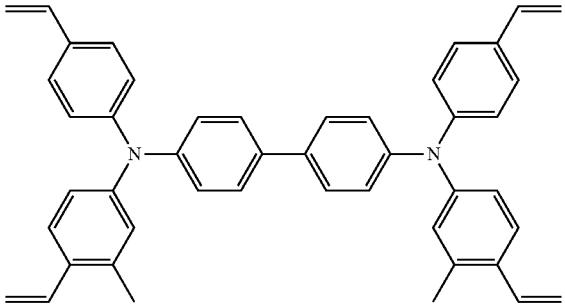 |
| iv-26 | 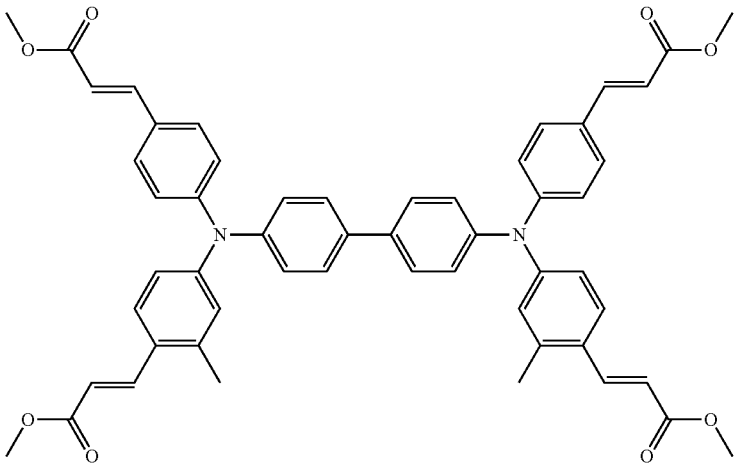 |

-continued
| No. | |
|---|---|
| iv-27 | 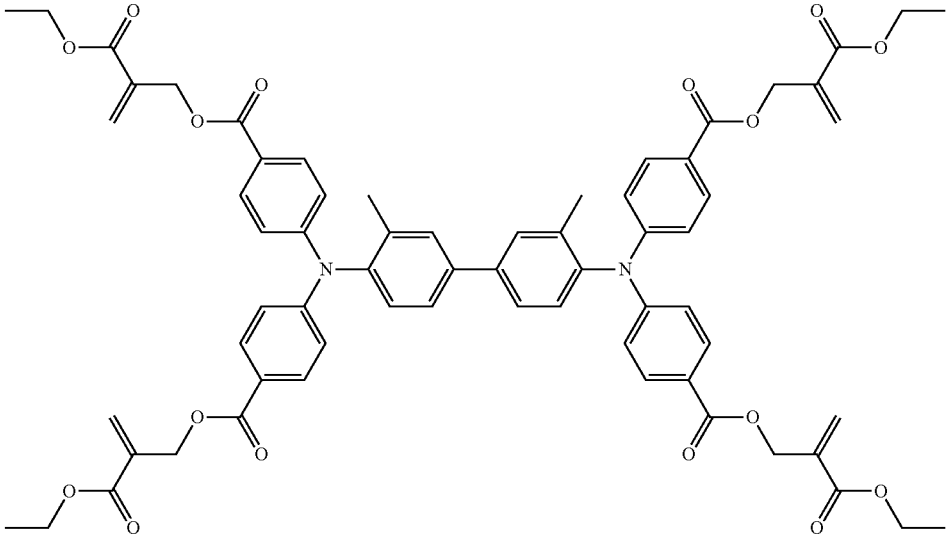 |
| iv-28 | 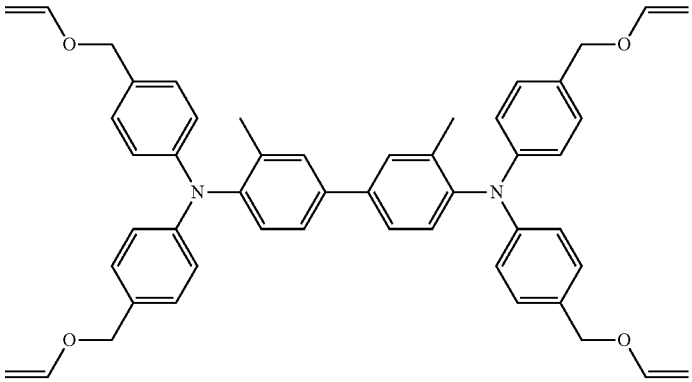 |
| iv-29 | 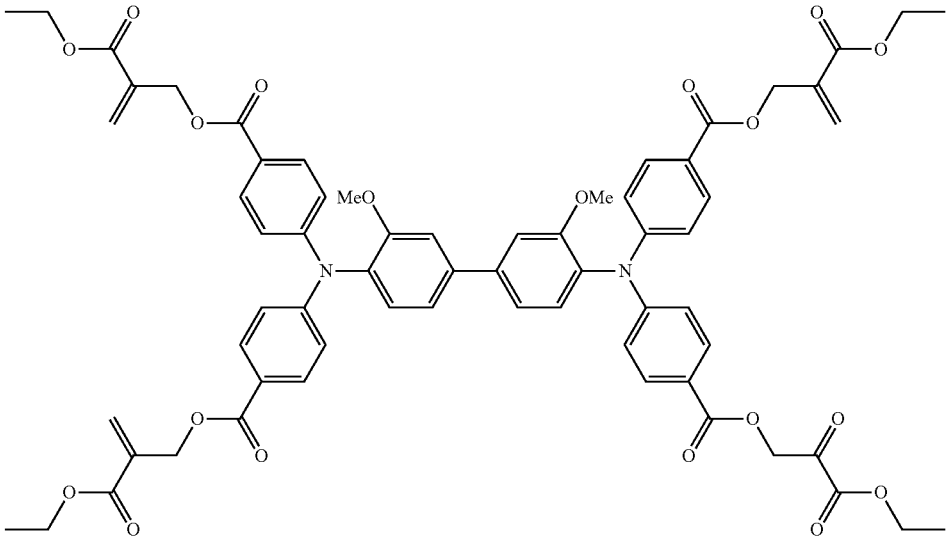 |

-continued
| No. | |
|---|---|
| iv-30 | 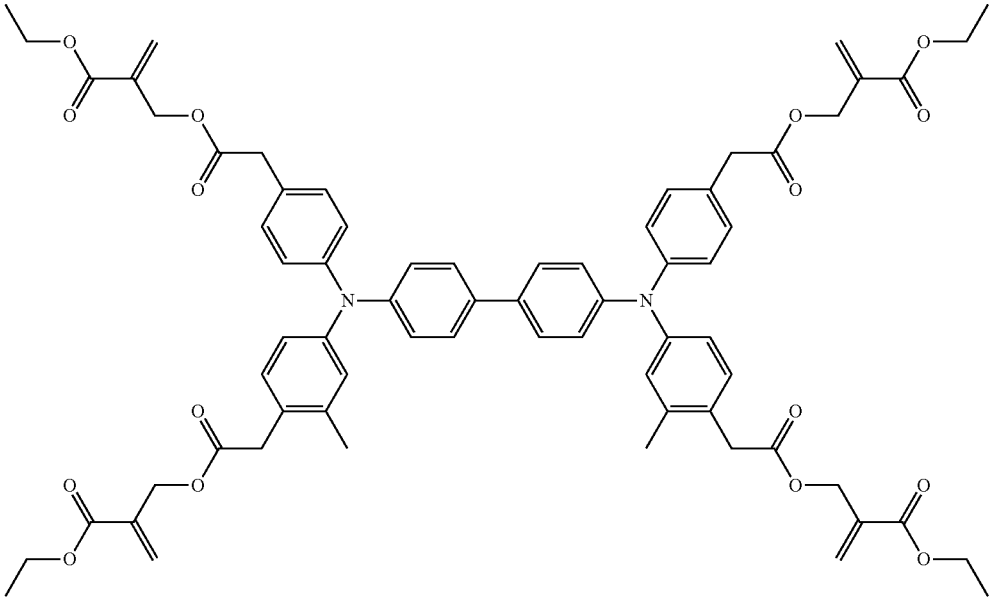 |
| iv-31 | 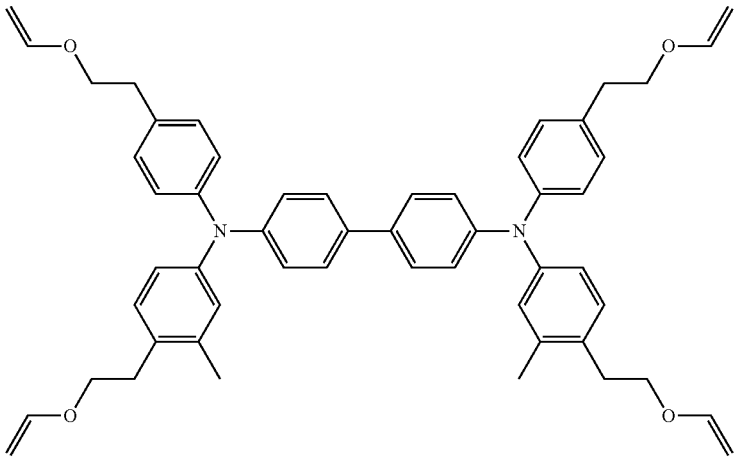 |

-continued
| No. | |
|---|---|
| iv-32 | 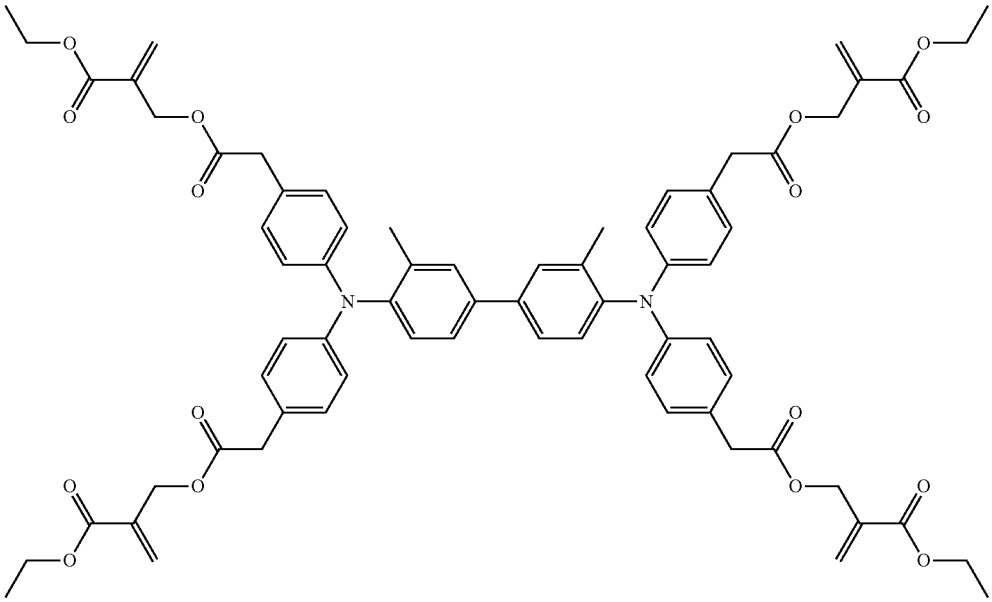 |
| iv-33 | 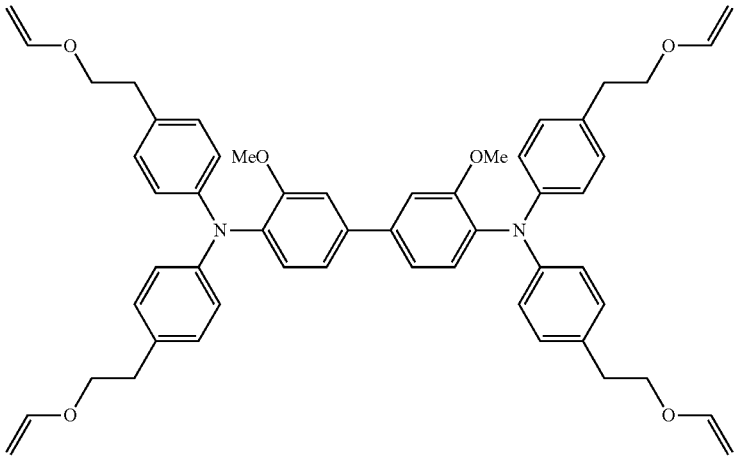 |

-continued
| No. | |
|---|---|
| iv-34 | 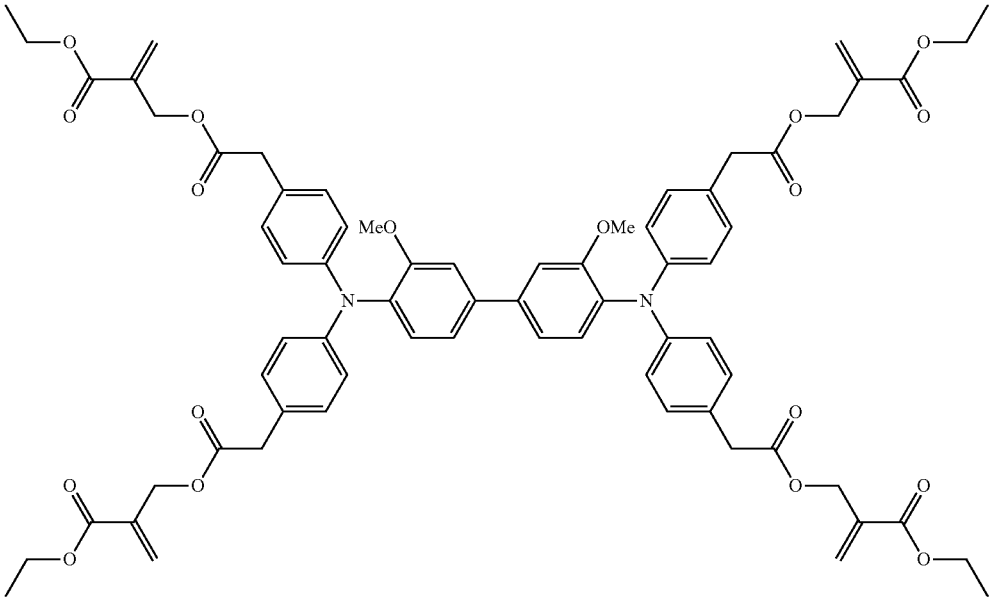 |
| iv-35 | 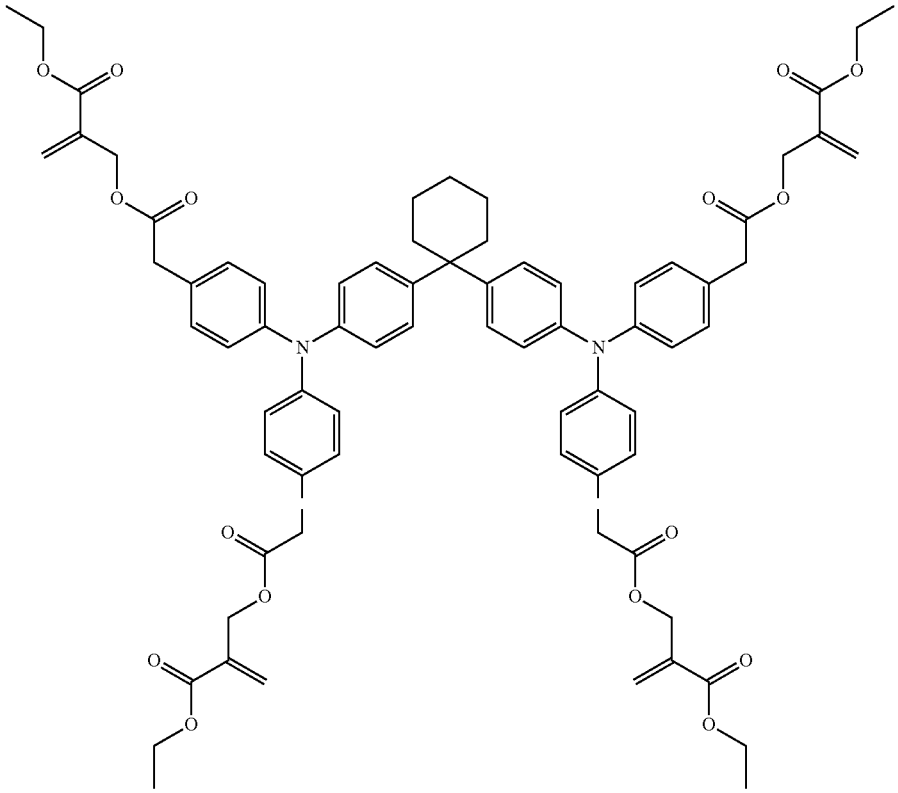 |

-continued
| No. | |
|---|---|
| iv-36 | 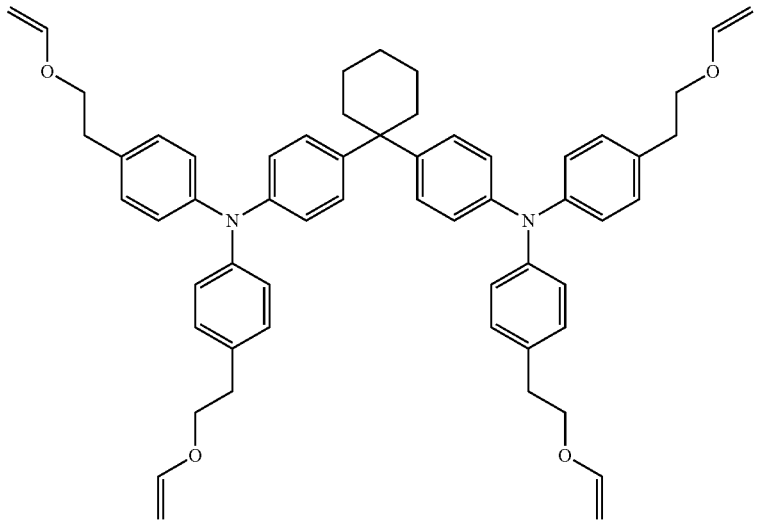 |
| iv-37 | 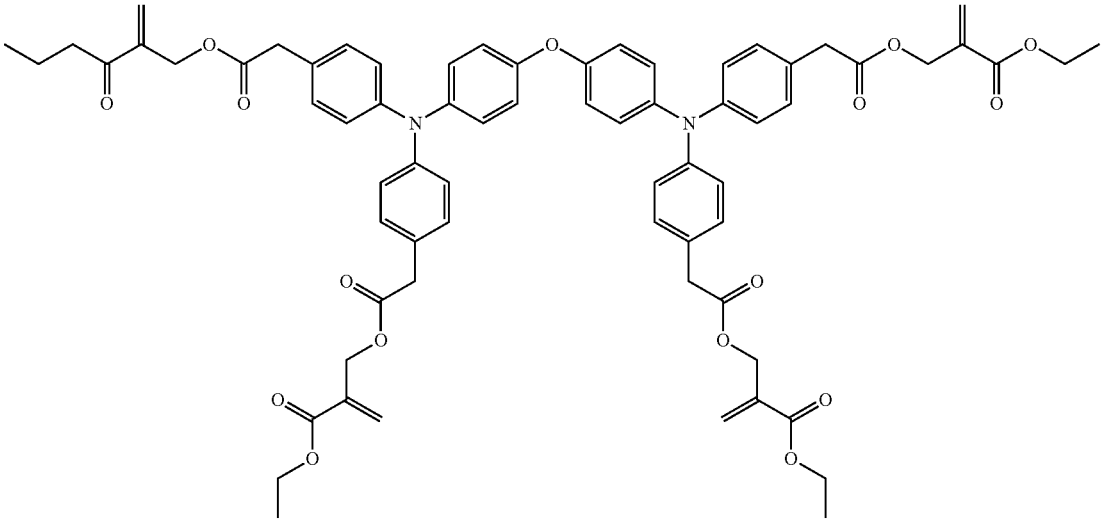 |

-continued
| No. | |
|---|---|
| iv-38 | 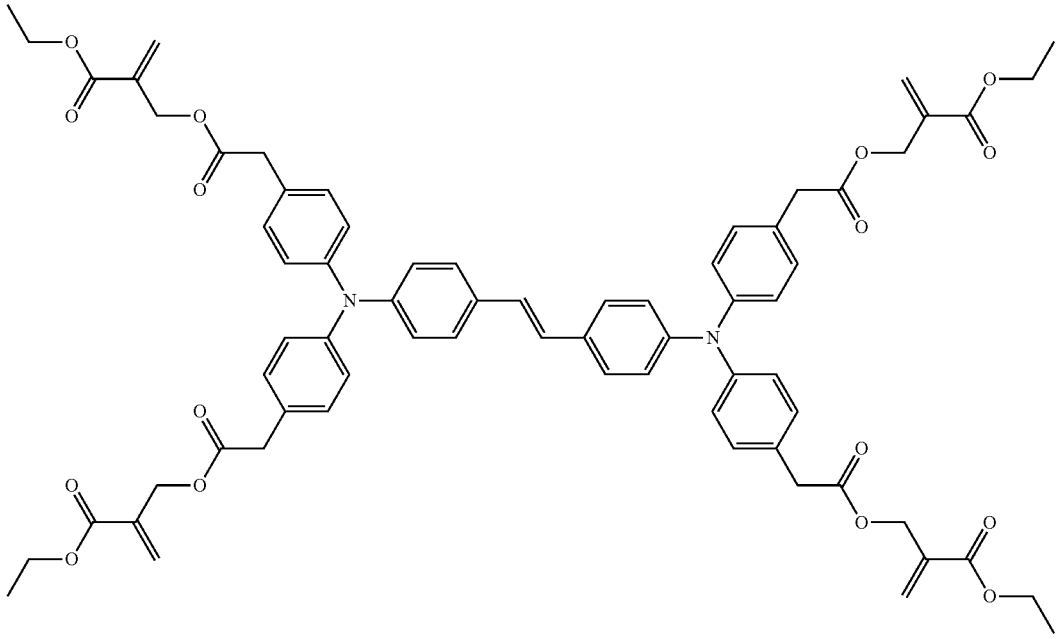 |
| iv-39 | 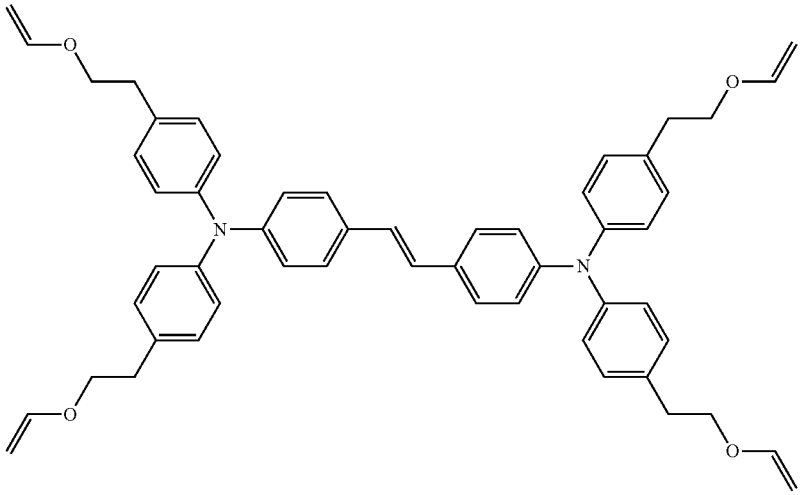 |

-continued
| No. | |
|---|---|
| iv-40 | 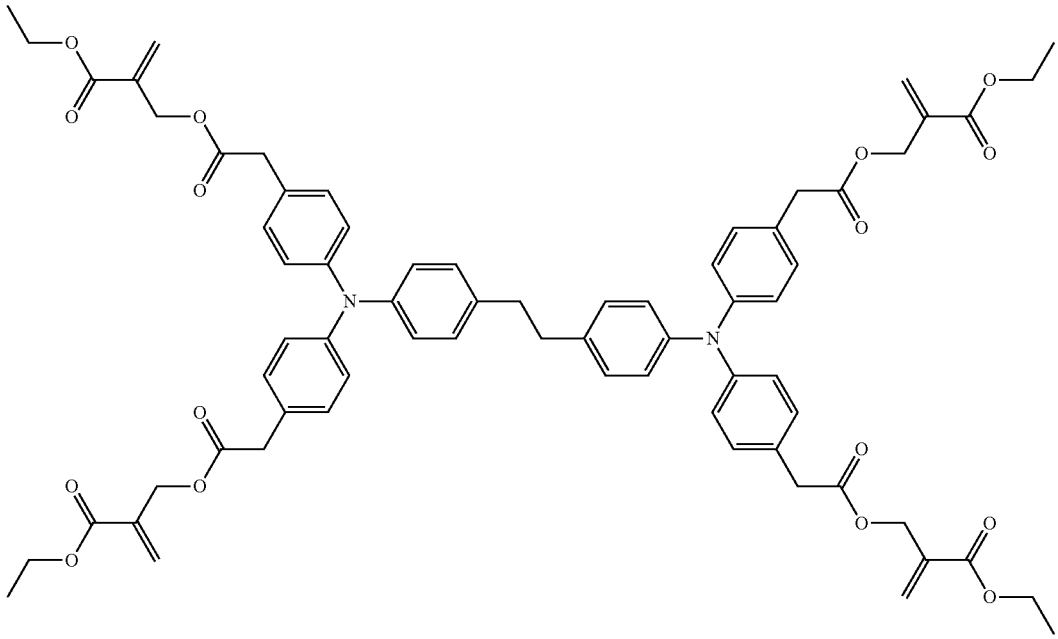 |
| iv-41 | 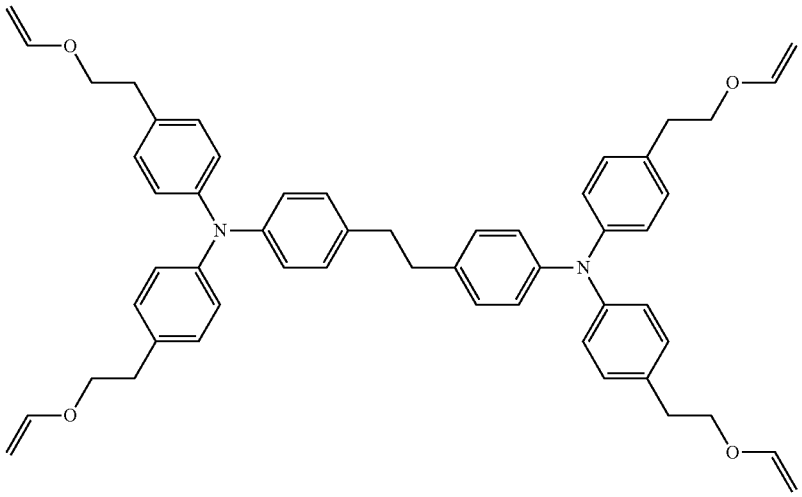 |

-continued
| No. | |
|---|---|
| iv-42 | 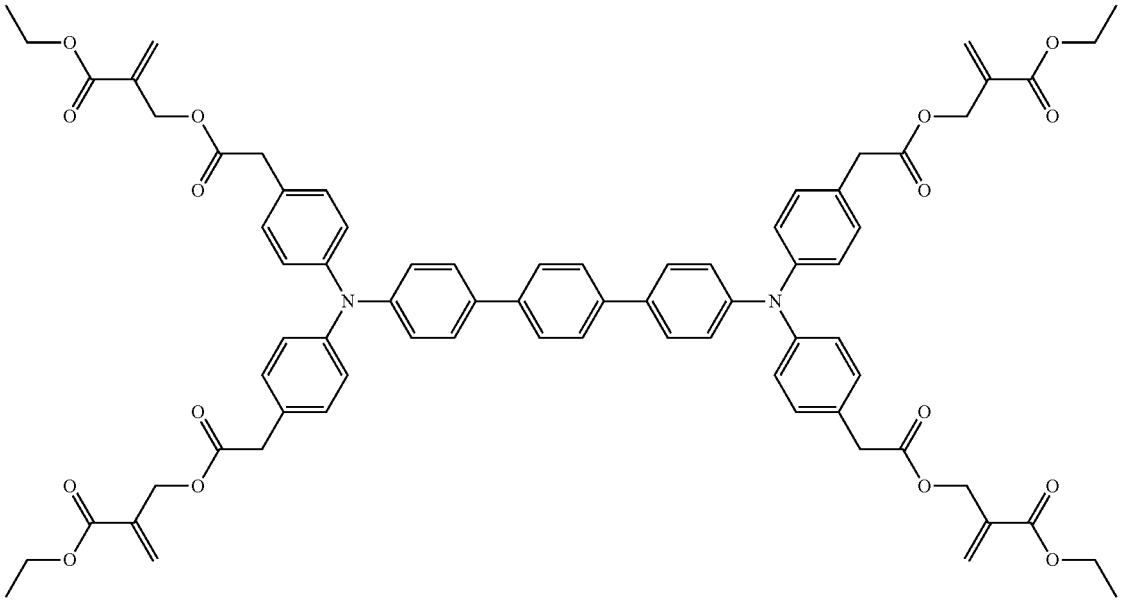 |
| iv-43 | 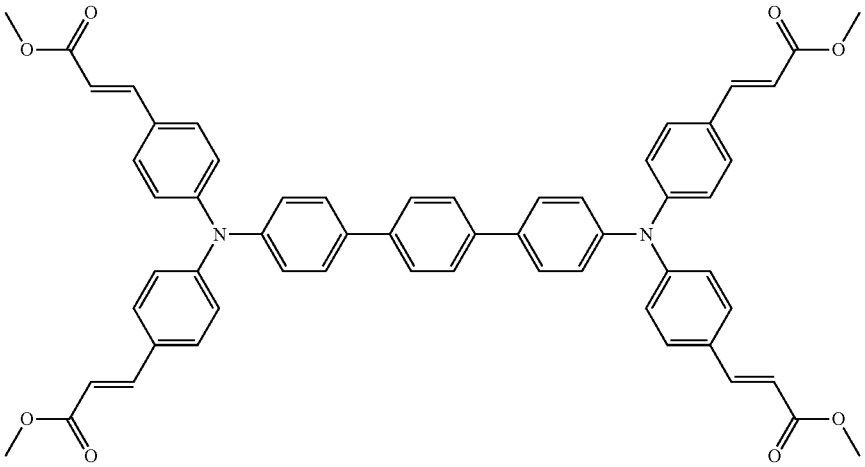 |
| iv-44 | 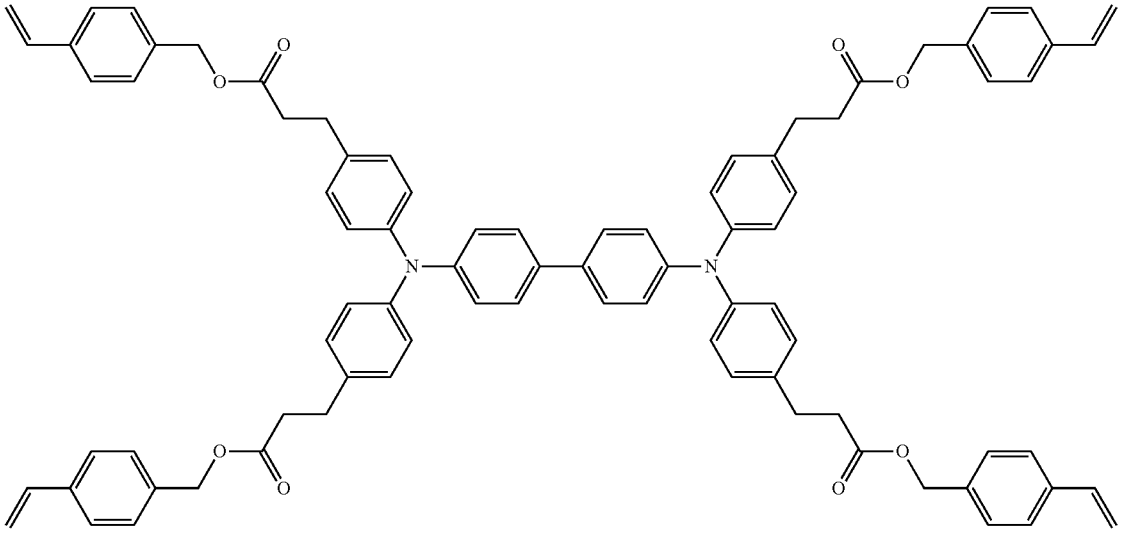 |

-continued
| No. | |
|---|---|
| iv-45 | 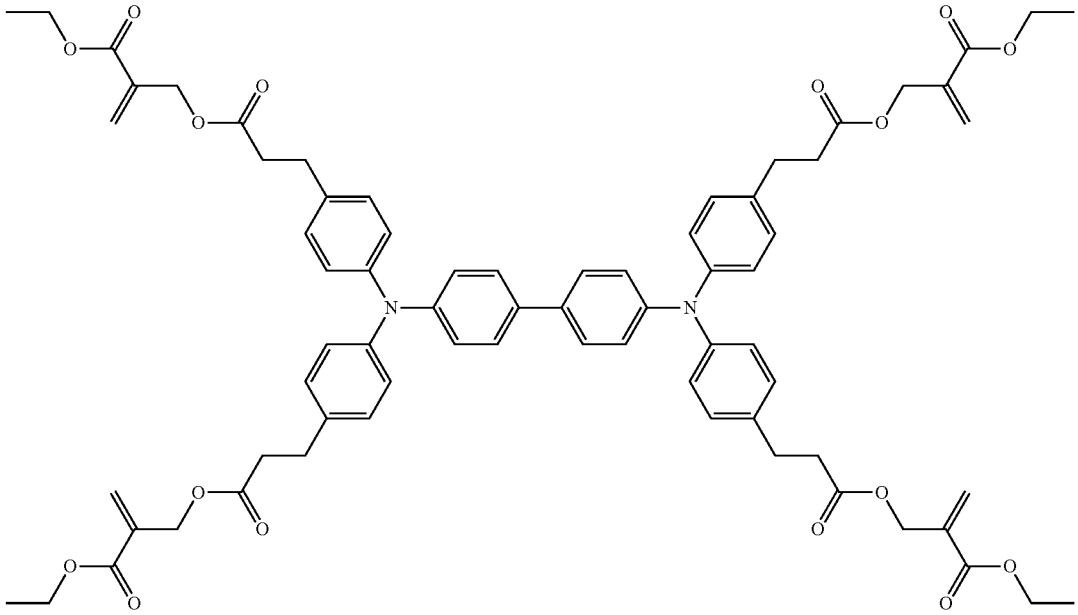 |
| iv-46 | 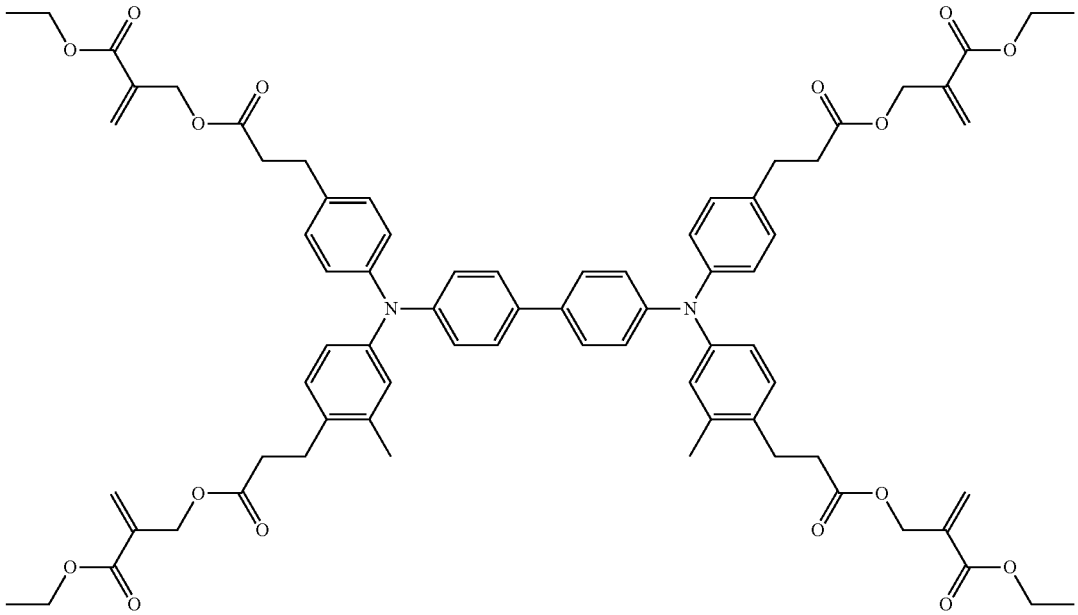 |

-continued
No.
iv-47
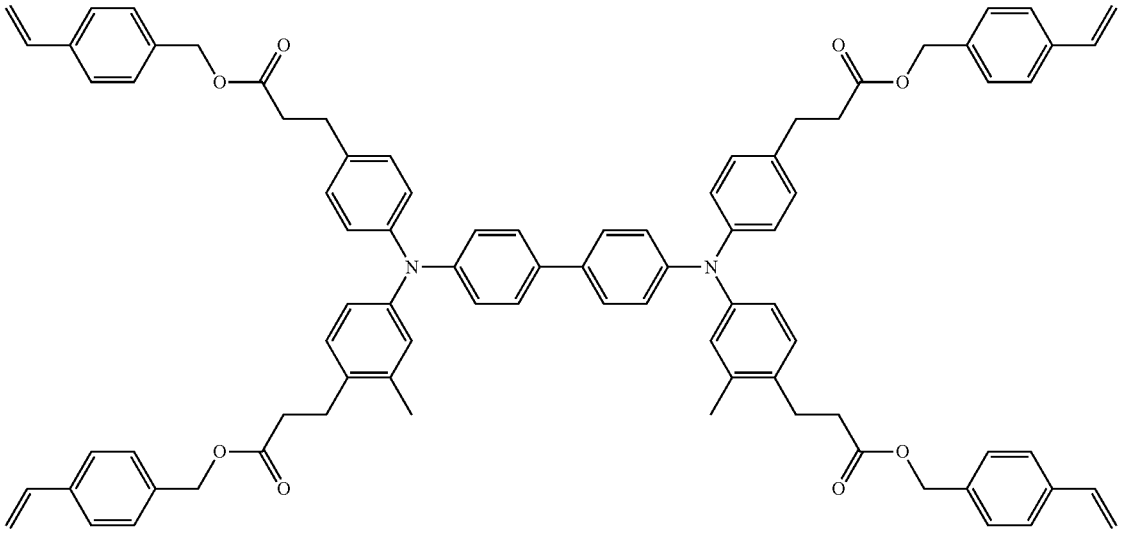
iv-48
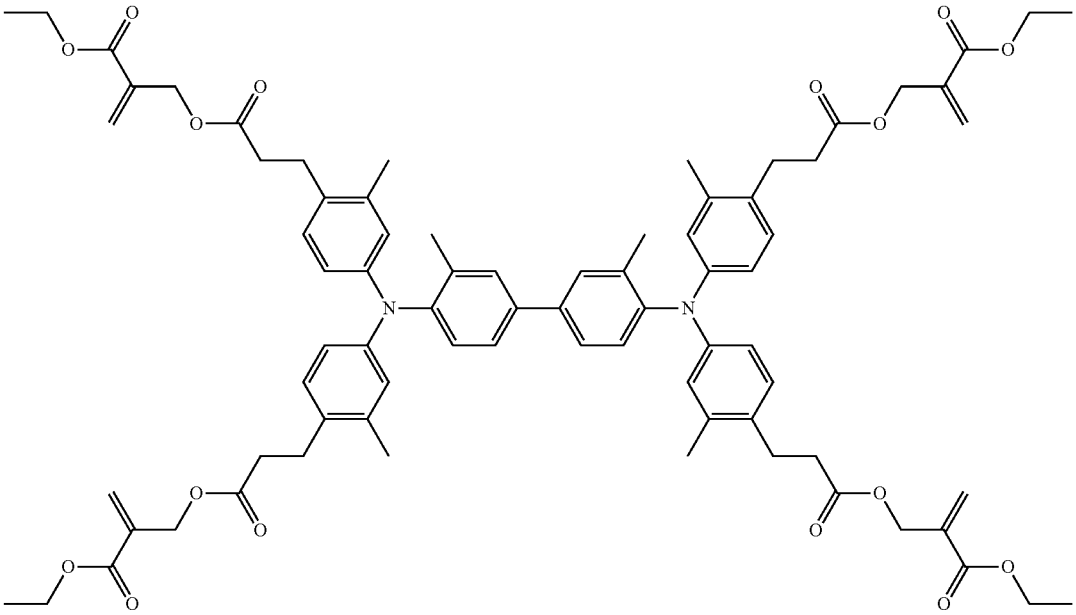

-continued
| No. | |
|---|---|
| iv-49 | 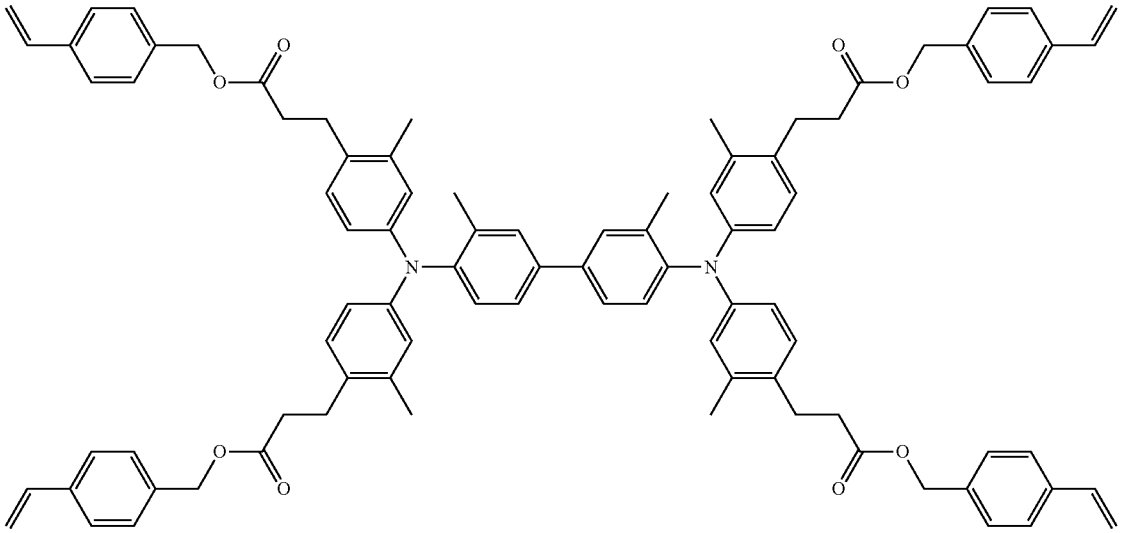 |
Specific examples of a specific charge transportable material having five chain polymerizable functional groups are shown but are not limited thereto.
| No. | |
|---|---|
| v-1 | 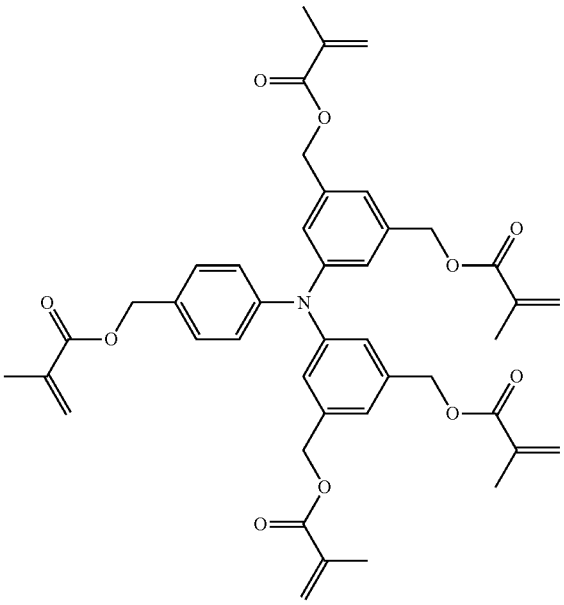 |

-continued
| No. | |
|---|---|
| v-2 | 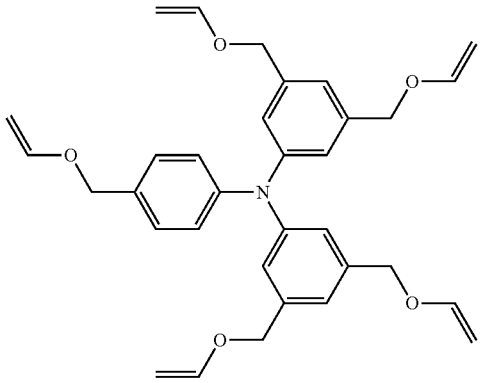 |
| v-3 | 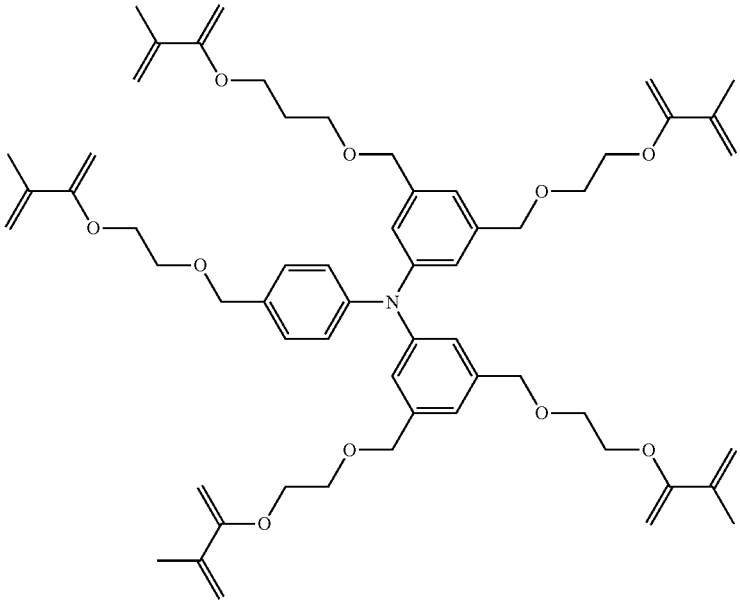 |
Specific examples of a specific charge transportable material having six chain polymerizable functional groups are shown but are not limited thereto.

No.
vi-1
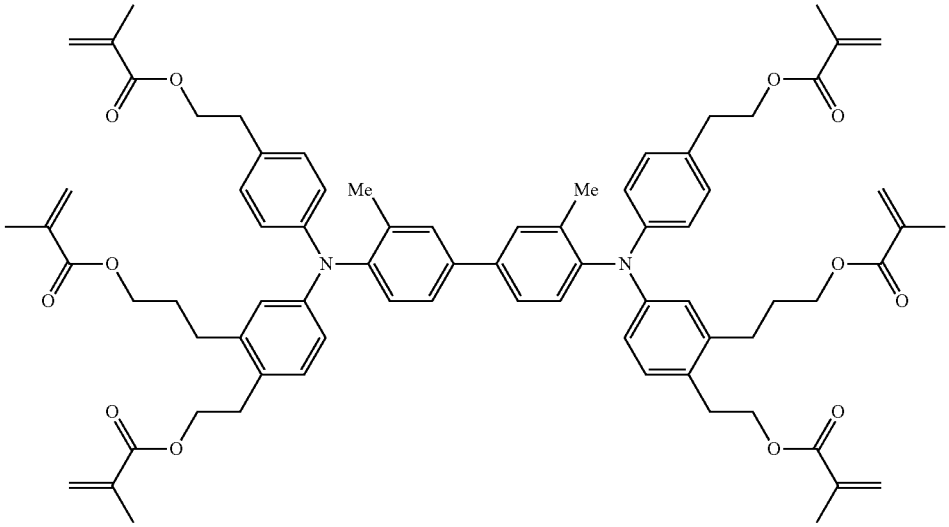
vi-2
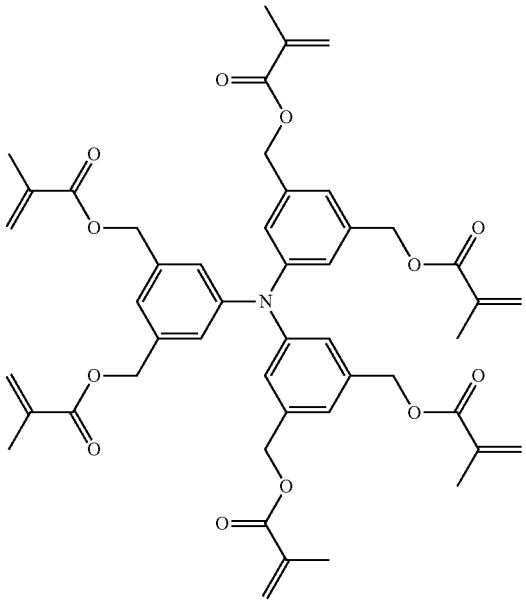
vi-3
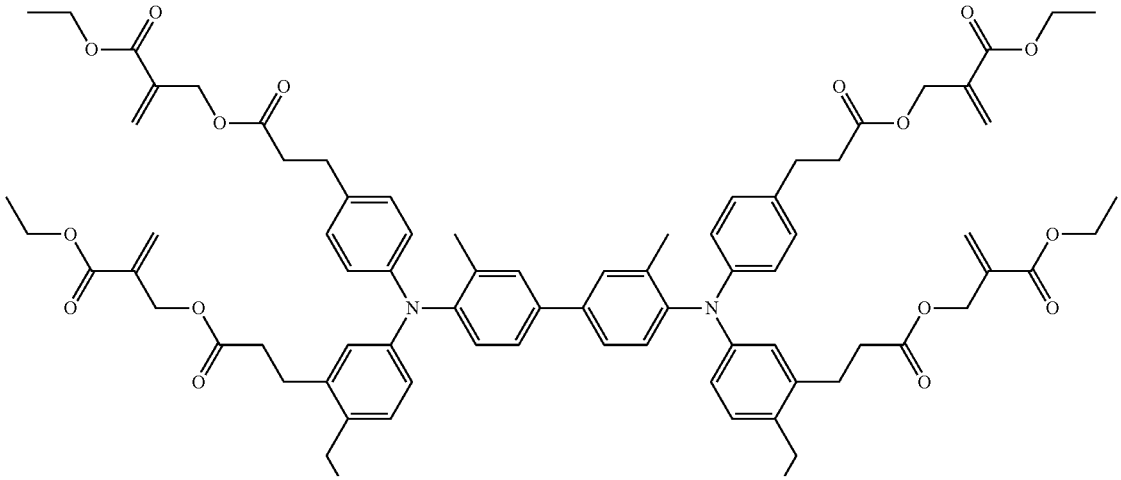

-continued
| No. | |
|---|---|
| | 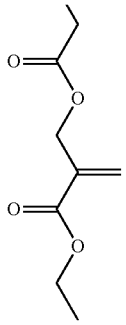 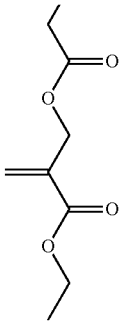 |
| vi-4 | 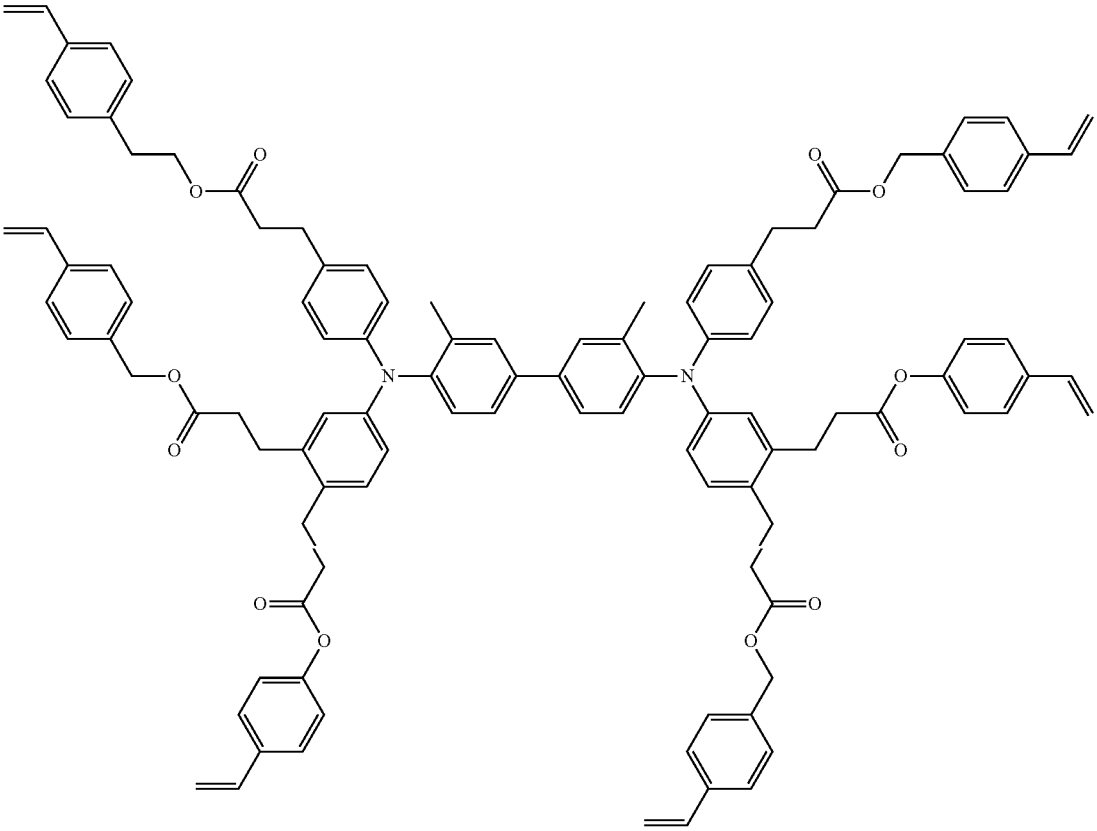 |

-continued
| No. | |
|---|---|
| vi-5 | 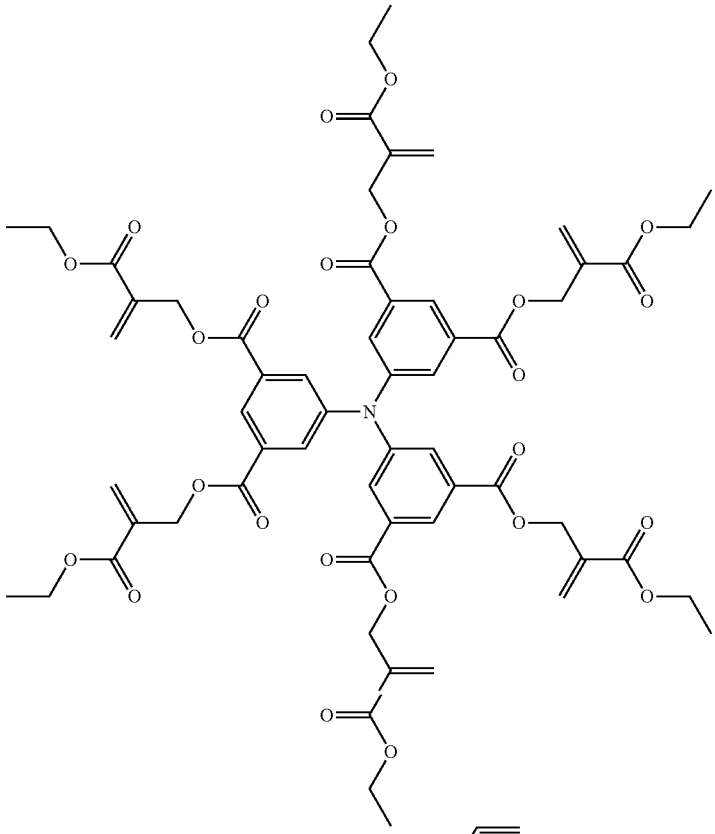 |
| vi-6 | 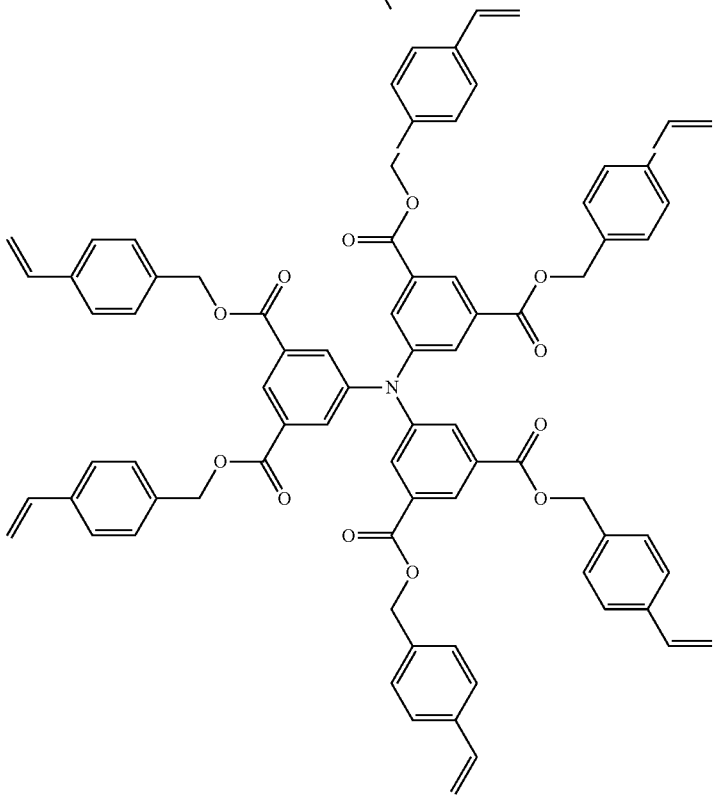 |

The specific charge transportable materials are synthesized as follows, for example.

More specifically, the specific charge transportable materials are synthesized by, for example, condensing alcohol, which is a precursor, with the corresponding methacrylic acid or methacrylic acid halide. When alcohol, which is a precursor, has a benzyl alcohol structure, for example, the specific charge transportable material may be synthesized by, for example, dehydration and etherification of alcohol and a methacrylic acid derivative having a hydroxyl group, such as hydroxyethyl methacrylate.

The synthesis routes of a compound iv-4 and a compound iv-17 for use in this exemplary embodiment are shown below as an example.

Compound iv-4

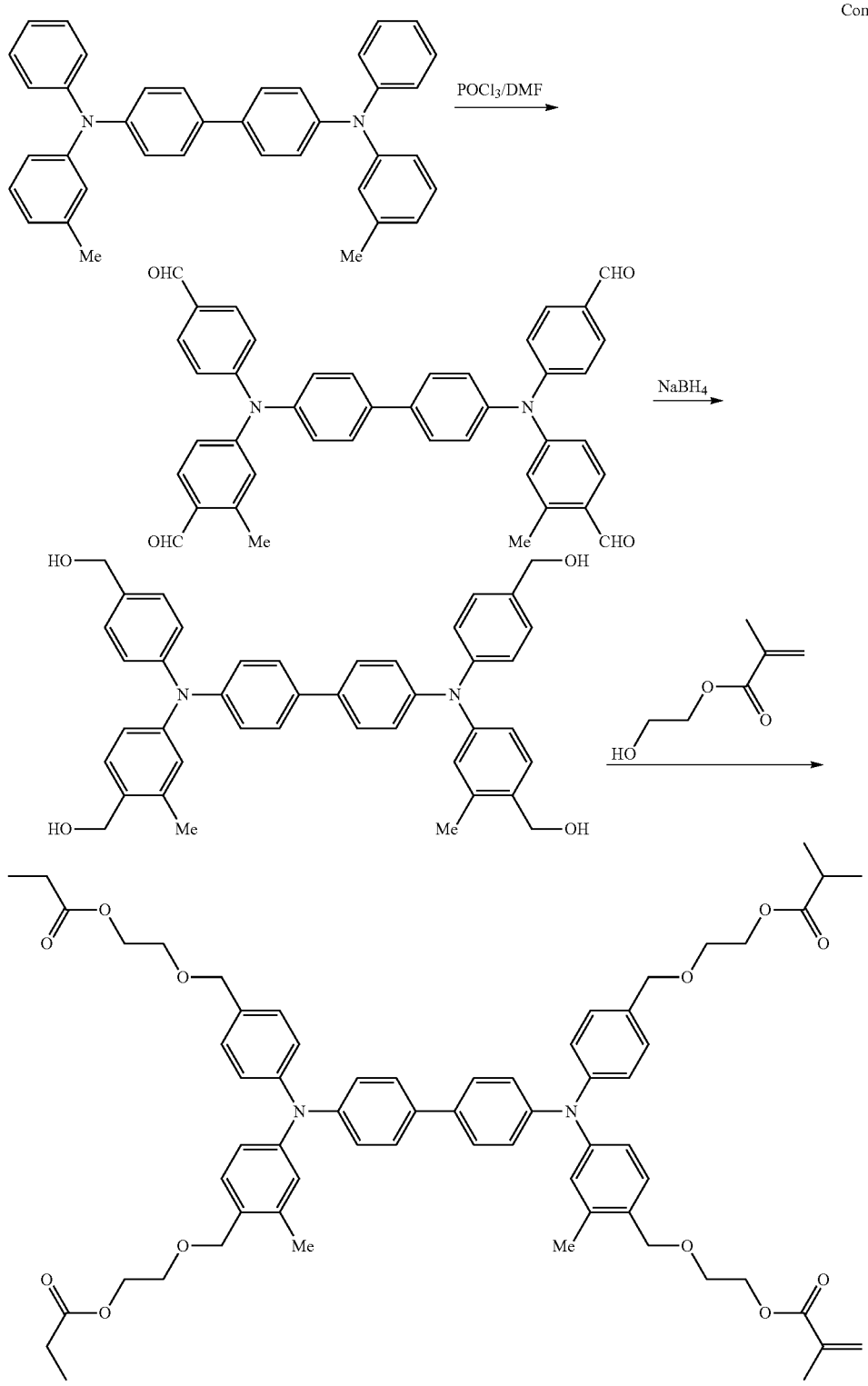

-continued
Compound v-17
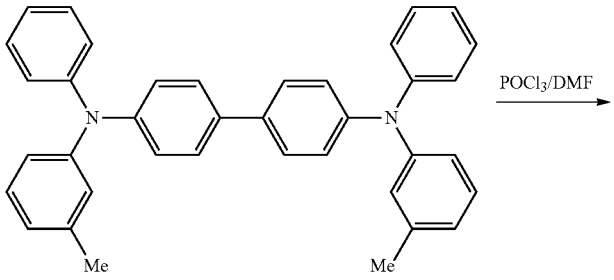
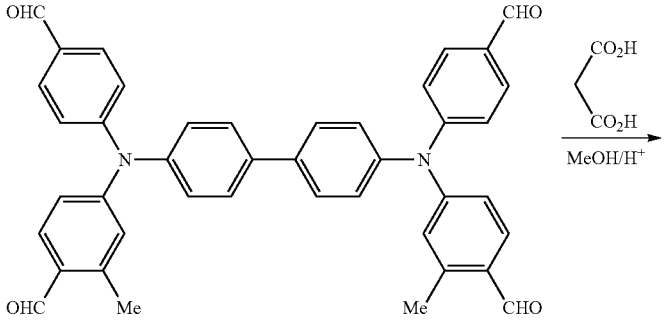
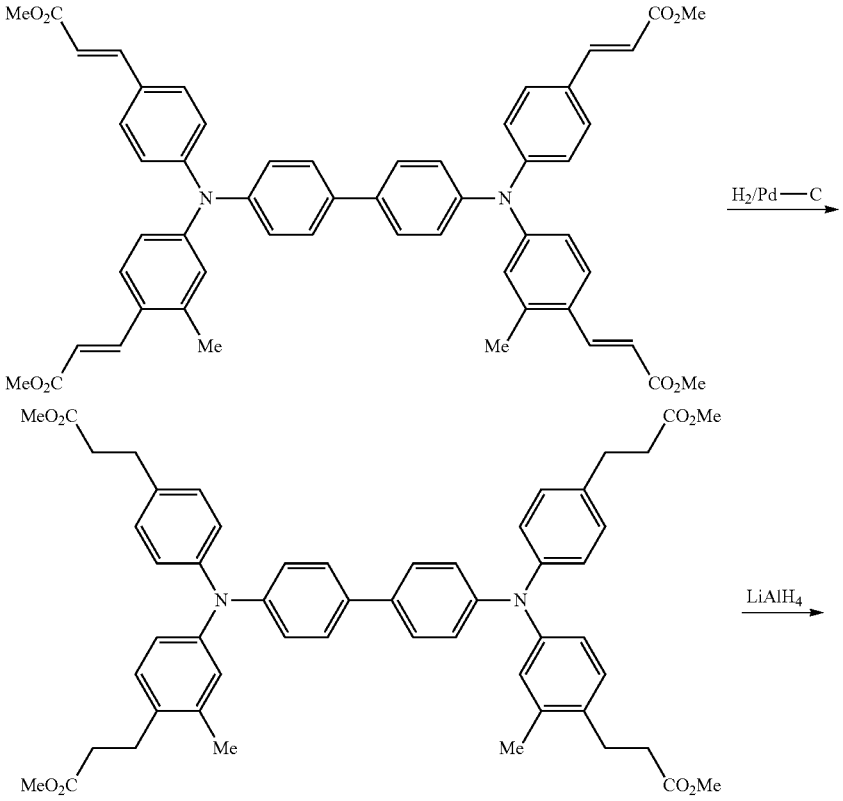

-continued

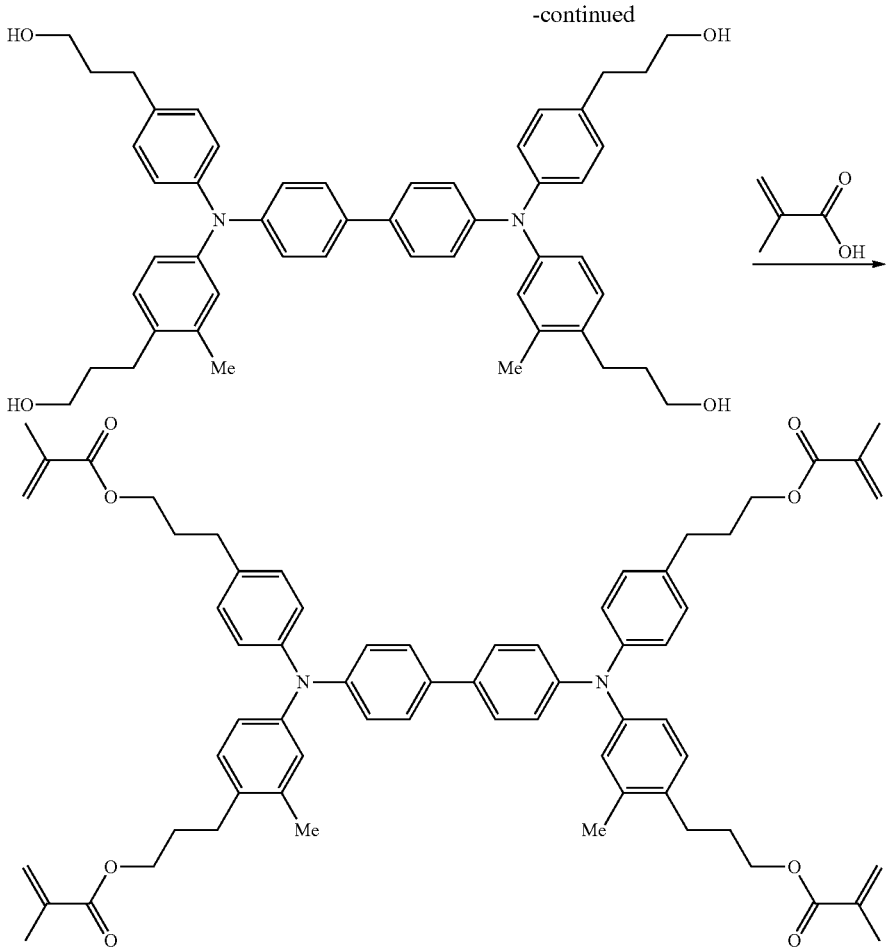

Other specific charge transportable materials are synthesized in the same manner as in the synthetic route of the compound iv-4 and the synthetic route of the compound iv-17 described above, for example.

In this exemplary embodiment, as the specific charge transportable material, the compounds containing two or more chain polymerizable functional groups are preferably used and the compounds containing four or more chain polymerizable functional groups are particularly preferably used as described above.

In addition, as the specific charge transportable material, the compound containing four or more chain polymerizable functional groups and the compound containing 1 to 3 chain polymerizable functional groups may be used in combination. The combined use adjusts the strength of the cured film while suppressing a reduction in charge transportation performance.

When the compound containing four or more chain polymerizable functional groups and the compound containing 1 to 3 chain polymerizable functional groups are used in combination as the specific charge transportable material, the content of the compound having four or more chain polymerizable functional groups is preferably 5% by weight or more and particularly preferably 20% by weight or more based on the total content of the specific charge transportable materials.

The total content of the specific charge transportable materials is, for example, in the range of 30% by weight to 100% by weight, in the range of 30% by weight to 99% by weight, or in the range of 30% by weight to 95% by weight based on the total solid weight of the charge transportable compositions.

—Chain Transfer Agent Having Sulfur Atom in a Molecule—

A chain transfer agent having sulfur atoms in a molecule will be described.

The chain transfer agent having sulfur atoms in a molecule is a compound having a group or a skeleton containing sulfur atoms in such a manner as to have a site of a hydrogen-sulfur bond, a sulfur-sulfur bond, or a carbon-sulfur bond in a molecule and capable of generating sulfur radicals by a cleavage reaction of the hydrogen-sulfur bond, the sulfur-sulfur bond, or the carbon-sulfur bond in a molecule.

The chain transfer agent having sulfurs atoms in a molecule is not particularly limited insofar as the chain transfer agent is a known chain transfer agent for use in polymerization, processing, or vulcanization of known resin, rubber, or the like, a plasticizer, and the like and has sulfur atoms. Examples include one described in, for example, "Radical Jugo Handbook Kiso kara Shintenkai made" (Radical Polymerization Handbook From Basis to New development), Kanji KAMACHI and Tsuyoshi ENDO, NTS, August, 1999.

Specific examples of the chain transfer agent having sulfur atoms in a molecule include compounds containing a thiol group and compounds containing a disulfide group.

Examples of compounds containing one thiol group include alkane thiols (e.g., 1-propanethiol, 1-butanethiol, 1-decanethiol, 1-dodecanethiol, 1-heptanethiol, and 1-octadecanethiol), structural isomers of alkane thiol (e.g., 2-dodenacethiol and t-dodecyl mercaptan), thiobenzoic acid, thioglycolic acid, ammonium thioglycolate, monoethanolamine thioglycolate, β-mercapto propionic acid, methyl-3-mercapto propionate, 2-ethylhexyl-3-mercapto propionate, n-octyl-3-mercapto propionate, methoxy butyl-3-mercapto propionate, and stearyl-3-mercapto propionate.

Examples of compounds containing two or more thiol groups include alkane dithiols (e.g., 1,10-decanedithiol, 1,2-benzenedithiol, 1,2-ethanedithiol, and 1,2-propanedithiol), structural isomers of alkane dithiol (e.g., 2-methyl-2-octyl-1, 3-propane dithiol), mercaptopropionic acid 2-ethylhexyl ester, mercaptopropionic acid trimethylolpropane ester, mercaptopropionic acid pentaerythritol ester, tris-[(3-mercapto propionyloxy-ethyl)]-isocyanurate, tetraethylene glycol bis (3-mercapto propionate), and dipentaerythritol hexakis(3-mercapto propionate).

Examples of compounds containing a disulfide group include diphenyl sulfide, tetraethylthiuram disulfide, tetraethylthiuram disulfide, and diethyldithiocarbamic acid ester.

These chain transfer agents having sulfur atoms in a molecule may be one for use in a so-called living radical polymerization.

Among the chain transfer agents having sulfur atoms in a molecule, the compounds containing one or more thiol groups are preferable. When the compounds containing one or more thiol groups are applied, the electrical characteristics (e.g., charge transportability, chargeability, and residual potential) of the cured film are improved, these characteristics are easily maintained even when repeatedly used, and the generation of image density unevenness due to repeated use is easily suppressed.

Among the chain transfer agents having sulfur atoms in a molecule, compounds containing two or more thiol groups are preferable from the viewpoint that the mechanical strength of the cured film increases.

The chain transfer agents having sulfur atoms in a molecule may be used by singly or in combination of two or more kinds thereof.

The content of the chain transfer agents having sulfur atoms in a molecule is, for example, in the range of 0.1 part by weight (or about 0.1 part by weight) to 30 parts by weight (or about 30 parts by weight), in the range of 1 part by weight (or about 1 part by weight) to 15 parts by weight (or about 15 parts by weight), or in the range of 2 parts by weight (or about 2 parts by weight) to 10 parts by weight (or about 10 parts by weight) based on 100 parts by weight of the compound having a chain polymerizable functional group and a charge transportable skeleton in a molecule from the viewpoint of improving the electrical characteristics (e.g., (e.g., charge transportability, chargeability, and residual potential) or the mechanical strength in the outermost surface layer (e.g., the charge transporting layer or the protective layer). —Other Additives: Polymerization Initiator—

Next, other additives of the charge transportable composition will be described.

To the charge transportable composition, known polymerization initiators that generate radicals, for example, may be added in order to further increase the reaction efficiency of chain polymerization reactive groups. More specifically, polymerization initiators may be used in combination with the chain transfer agents having sulfur atoms in a molecule. In that case, the polymerization initiators are preferably polymerization initiators that generate radicals by heat in terms of achieving the objects of this exemplary embodiment.

Examples of the polymerization initiators that generate radicals by heat include azo initiators, such as V-30 (10 hour half-life temperature: 104° C.), V-40 (same as above: 88° C.), V-59 (same as above: 67° C.), V-601 (same as above: 66° C.), V-65 (same as above: 51° C.), V-70 (same as above: 30° C.), VF-096 (same as above: 96° C.), Vam-110 (same as above: 111° C.), Vam-111 (same as above: 111° C. (all trade names, manufactured by Wako Pure Chemical Industries, Ltd.), OTAZO-15 (same as above: 61° C.), OTAZO-30, AIBM (same as above: 65° C.), AMBN (same as above: 67° C.), ADVN (same as above: 52° C.), or ACVA (same as above: 68° C.) (all trade names, manufactured by Otsuka Chemical Co., Ltd.);

PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PERROYL IB, PERROYL 355, PERROYL L, PERROYL SA, NYPER BW, NYPER BMT-K40/M, PERROYL IPP, PERROYL NPP, PERROYL TCP, PERROYL OPP, PERROYL SBP, PERCUMYL ND, PEROCTA ND, PERHEXYL ND, PERBUTYL ND, PERBUYTL NHP, PERHEXYL PV, PERBUTYL PV, PERHEXA 250, PEROCTA 0, PERHEXYL 0, PERBUTYL 0, PERBUTYL L, PERBUTYL 355, PERHEXYL I, PERBUTYL I, PERBUTYL E, PERHEXA 25Z, PERBUTYL A, PERHEXYL Z, PERBUTYL ZT, PERBUTYL Z (all trade names, manufactured by NOF Corp.), KAYAKETAL AM-055, TRIGONOX 36-C75, RAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER 0, KAYAESTER HTP-65W, KAYAESTER AN, TRIGONOX 42, TRIGONOX F-050, KAYABUTYL B, KAYACARBON EH-C70, KAYACARBON EH-W60, KAYACARBON I-20, KAYACARBON BIC-75, TRIGONOX 117, KAYARENE 6-70 (all trade names, manufactured by Kayaku Akzo Corp.), LUPEROX LP (10 hour half-life temperature: 64° C.), LUPEROX 610 (same as above: 37° C.), LUPEROX 188 (same as above: 38° C.), LUPEROX 844 (same as above: 44° C.), LUPEROX 259 (same as above: 46° C.), LUPEROX 10 (same as above: 48° C.), LUPEROX 701 (same as above: 53° C.), LUPEROX 11 (same as above: 58° C.), LUPEROX 26 (same as above: 77° C.), LUPEROX 80 (same as above: 82° C.), LUPEROX 7 (same as above: 102° C.), LUPEROX 270 (same as above: 102° C.), LUPEROX P (same as above: 104° C.), LUPEROX 546 (same as above: 46° C.), LUPEROX 554 (same as above: 55° C.), LUPEROX 575 (same as above: 75° C.), LUPEROX TANPO (same as above: 96° C.), LUPEROX 555 (same as above: 100° C.), LUPEROX 570 (same as above: 96° C.), LUPEROX TAP (same as above: 100° C.), LUPEROX TBIC (same as above: 99° C.), LUPEROX TBEC (same as above: 100° C.), LUPEROX TW (same as above: 100° C.), LUPEROX TAIC (same as above: 96° C.), LUPEROX TAEC (same as above: 99° C.), LUPEROX DC (same as above: 117° C.), LUPEROX 101 (same as above: 120° C.), LUPEROX F (same as above: 116° C.), LUPEROX DI (same as above: 129° C.), LUPEROX 130 (same as above: 131° C.), LUPEROX 220 (same as above: 107° C.), LUPEROX 230 (same as above: 109° C.), LUPEROX 233 (same as above: 114° C.), and LUPEROX 531 (same as above: 93° C.) (all trade names, manufactured by ARKEMA YOSHITOMI, LTD.).

The polymerization initiators may be used singly or as a mixture of two or more kinds thereof.

The content of the polymerization initiator is, for example, in the range of 0.01 part by weight to 10 parts by weight, in the range of 0.05 part by weight to 8 parts by weight, or in the range of 0.1 part by weight to 5 parts by weight based on 100 parts by weight of the specific charge transportable material from the viewpoints that a chain polymerization reaction proceeds and the mechanical strength of a film after curing is excellent.

—Other Additives: Various Compounds and Resins—

The charge transportable composition may contain at least one selected from compounds having no chain polymerizable reactive group and having a charge transportable skeleton, compounds having a chain polymerizable reactive group and having no charge transportable skeleton, and binder resin for the purposes of adjusting the electrical characteristics and the mechanical strength of a cured film.

—Compound Having No Chain Polymerizable Reactive Group and Having Charge Transportable Skeleton—

The compounds having no chain polymerizable reactive group and having a charge transportable skeleton are not particularly limited insofar as the compounds are known. Examples of the compounds include electron transporting compounds, such as quinone compounds, such as p-benzoquinone, chloranil, bromanil, or anthraquinone, tetracyanoquinodimethane compounds, fluorenone compounds, such as, 2,4,7-trinitrofluorenone, xanthone compounds, benzophenone compounds, cyanovinyl compounds, ethylene compounds and known electron hole transportable compounds, such as triarylamine compounds, benzidine compounds, arylalkane compounds, aryl-substituted ethylene compounds, stylbene compounds, anthracene compounds, and hydrazone compounds.

From the viewpoint of charge mobility, the compounds having no chain polymerizable reactive group and having a charge transportable skeleton are preferably triarylamine derivatives represented by the following Structural Formula (a-1) or benzidine derivatives represented by the following Structural Formula (a-2).

(a-1)

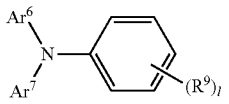

In Structural Formula (a-1), $R^9$ represent a hydrogen atom or a methyl group. 1 represents 1 or 2. $Ar^6$ and $Ar^7$ each independently represent a substituted or unsubstituted aryl group, $—C_6H_4—C(R^{10})=C(R^{11})(R^{12})$, or $—C_6H_4—CH=CH—CH=C(R^{13})(R^{14})$. $R^{10}$ to $R^{14}$ each independently represent a hydrogen atom, a substituted or unsubstituted alkyl group, or a substituted or unsubstituted aryl group.

Examples of the substituent of each of the groups include halogen atoms, alkyl groups having 1 to 5 carbon atoms, alkoxy groups having 1 to 5 carbon atoms, and substituted amino groups each substituted with an alkyl group having 1 to 3 carbon atoms.

(a-2)

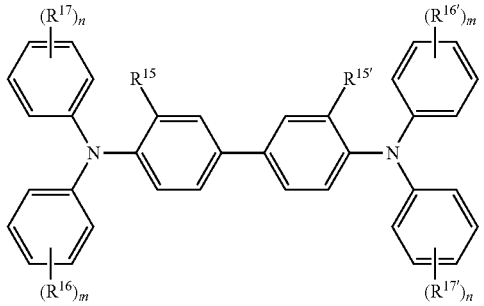

In Structural Formula (a-2), $R^{15}$ and $R^{15'}$ each independently represent a hydrogen atom, a halogen atom, an alkyl group having 1 to 5 carbon atoms, or an alkoxy group having 1 to 5 carbon atoms. $R^{16}$, $R^{16'}$, $R_{17}$, and $R^{17'}$ each independently represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{18})=C(R^{19})(R^{20})$, or $—CH=CH—CH=C(R^{21})(R^{22})$. $R^{18}$ to $R^{22}$ each independently represent a hydrogen atom, a substituted or unsubstituted alkyl group, or a substituted or unsubstituted aryl group. m and n each independently represent an integer of 0 to 2.

Herein, among the triarylamine derivatives represented by Structural Formula (a-1) and the benzidine derivatives represented by Structural Formula (a-2), triarylamine derivatives each having "$—C_6H_4—CH=CH—CH=C(R^{13})(R^{14})$" and benzidine derivatives each having $—CH=CH—CH=C(R^{21})(R^{22})$ are preferable.

Examples of the compound having no chain polymerizable reactive group and having a charge transportable skeleton include known non-crosslinked polymer charge transportable materials having no reactivity (e.g., poly-N-vinylcarbazole and polysilan). Among the known non-crosslinked polymer charge transportable materials, polyester polymer charge transportable materials described in JP-A Nos. 8-176293 and 8-208820 particularly have high charge transportability.

The compound having no chain polymerizable reactive group and having a charge transportable skeleton may be used singly or as a mixture of two or more kinds thereof.

The content of the compound having no chain polymerizable reactive group and having a charge transportable skeleton is not particularly limited and is, for example, in the range of 0.1 part by weight to 100 parts by weight, in the range of 1 part by weight to 50 parts by weight or in the range of 3 parts by weight to 30 parts by weight based on 100 parts by weight of the specific charge transportable material from the viewpoint that the mechanical strength of a film after curing is excellent and the electrical characteristics (charge transportability) of a cured film is more excellent.

—Compound Having Chain Polymerizable Reactive Group and Having No Charge Transportable Skeleton—

Examples of the compound having a chain polymerizable reactive group and having no charge transportable skeleton include organic compounds having a carbon unsaturated bond and having chain polymerizability and having no charge transportable skeleton. Examples of the compounds include one used as raw materials of general-purpose resin, such as styrene, acrylic acid, methacrylic acid, acrylonitrile, or butadiene.

In addition thereto, examples of the compound having a chain polymerizable reactive group and having no charge transportable skeleton include monofunctional compounds, such as isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, and o-phenylphenol glycidyl ether acrylate; bifunctional compounds, such as 1,4-butanediol diacrylate, 1,6-hexanediol diacrylate, 1,9-nonanediol diacrylate, 2-n-butyl-2-ethyl-1,3-propane dioldiacrylate, tripropylene glycol diacrylate, tetraethylene glycol diacrylate, dioxane glycol diacrylate, polytetramethylene glycol diacrylate, ethoxized bisphenol A diacrylate, ethoxized bisphenol A dimethacrylate, tricyclodecane methanol diacrylate, and tricyclodecane methanol dimethacrylate; and trifunctional compounds, such as trimethylolpropane triacrylate, trimethylolpropane trimethacrylate, pentaerythritol acrylate, EO adduct trimethylolpropane triacrylate, PO adduct glycerin triacrylate, trisacryloyloxyethyl phosphate, pentaerythritol tetraacrylate, and ethoxized isocyanuric triacrylate.

Examples of the compound having a chain polymerizable reactive group and having no charge transportable skeleton include polyfunctional acrylate having an isocyanuric acid skeleton, such as tris(2-hydroxyethyl)isocyanurate triacrylate, tris(2-hydroxyethyl)isocyanurate trimethacrylate, bis(2-hydroxyethyl)isocyanurate triacrylate, bis(2-hydroxyethyl) isocyanurate trimethacrylate, caprolactone-modified acrylate of bis(acryloxyethyl)isocyanurate, caprolactone-modified methacrylate of bis(acryloxyethyl)isocyanurate, caprolactone-modified acrylate of bis(metacryloxyethyl)isocyanurate, and caprolactone-modified metacrylate of bis(metacryloxyethyl)isocyanurate.

The compound having a chain polymerizable reactive group and having no charge transportable skeleton may be used singly or as a mixture of two or more kinds thereof.

The content of the compound having a chain polymerizable reactive group and having no charge transportable skeleton is not particularly limited and is, for example, in the range of 0.01 part by weight to 100 parts by weight, in the range of 0.1 part by weight to 50 parts by weight, or in the range of 1 part by weight to 30 parts by weight based on 100 parts by weight of the specific charge transportable material from the viewpoint of improvement of the mechanical strength of a cured film after curing.

—Binder Resin—

Examples of binder resin include known binder resins. Examples of the binder resins include polycarbonate resin, polyester resin, polyarylate resin, methacrylic resin, acrylic resin, polyvinyl chloride resin, polyvinylidene chloride resin, polystyrene resin, polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, silicone resin, silicone alkyd resin, phenol formaldehyde resin, styrene-alkyd resin, poly-N-vinylcarbazole, and polysilan.

The binder resin may be used singly or as a mixture of two or more kinds thereof.

The content of the binder resin is, for example, in the range of 1 part by weight to 1000 parts by weight, in the range of 5 parts by weight to 500 parts by weight, or in the range of 10 parts by weight to 100 parts by weight based on 100 parts by weight of the specific charge transportable material from the viewpoints of stability of the viscosity of the charge transportable composition (coating solution), improvement of processability of a coat film or the like, and improvement of the mechanical strength of a cured film after curing.

—Other Additives—

To the charge transportable composition, coupling agents, hard coat agents, and fluorine containing compounds, for example, may be added for the purpose of adjusting the film formability, flexibility, lubricity, and adhesiveness of a film. Specific examples of the additives include various silane coupling agents and commercially-available silicone hard coat agents.

Examples of the silane coupling agents include vinyltrichlorosilane, vinyltrirnethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyl triethoxysilane, tetramethoxysilane, methyltrimethoxysilane, and dimethyldimethoxysilane.

Examples of the commercially available hardcoat agents include KP-85, X-40-9740, and X-8239 (all trade names, manufactured by Shin-Etsu Silicones), and AY42-440, AY42-441, and AY49-208 (all trade names, manufactured by Dow Corning Toray Co., Ltd.).

To the charge transportable composition, fluorine-containing compounds, such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, or 1H,1H,2H,2H-perfluorooctyltriethoxysilane, may be added in order to impart water-repellency or the like. Furthermore, reactive fluorine compounds and the like described in JP-A No. 2001-166510 may be blended.

The content of the silane coupling agents is not particularly limited. The content of the fluorine-containing compounds is preferably 0.25 times or lower, in terms of weight, the content of compounds containing no fluorine. When the content exceeds the content mentioned above, a problem may arise in the film formability of a cured film.

To the charge transportable composition, resin that dissolves in alcohol may be added, for example, for the purpose of regulating discharge gas resistance, mechanical strength, scratch resistance, reduction in torque, and wear amount, extending life (pot life), or the like or regulating particle dispersibility and viscosity of a film.

Moreover, to the charge transportable composition, an antioxidant, for example, is preferably added for the purpose of preventing degradation caused by oxidative gases, such as ozone, generated in a charging device in the charge transporting layer. This is because when the mechanical strength of the photoreceptor surface is increased and the life of the photoreceptor is extended, the photoreceptor is exposed to oxidative gases over a long time, and thus stronger oxidation resistance as compared before is desired.

As the antioxidant, hindered phenol antioxidants or hindered amine antioxidants are preferable, for example. Known antioxidants, such as organic sulfur-based antioxidants, phosphite-based antioxidants, dithiocarbarnate-based antioxidants, thiourea-based antioxidants, or benzimidazole-based antioxidants, may be used. The content of the antioxidant is, for example, in the range of 20% by weight or lower or in the range of 10% by weight or lower based on the total solid weight in the charge transportable composition.

Examples of the hindered phenol antioxidant include "IRGANOX 1076", "IRGANOX 1010", "IRGANOX 1098", "IRGANOX 245", "IRGANOX 1330", "IRGANOX 3114", and "IRGANOX 1076" (all trade names, manufactured by Ciba Japan), and "3,5-di-t-butyl-4-hydroxybiphenyl".

Examples of the hindered amine antioxidants include "SANOL LS2626", "SANOL LS765", "SANOL LS770", and "SANOL LS744" (all trade names, manufactured by Sankyo Lifetech Co., Ltd), "TINUVIN 144" and "TINUVIN 622LD" (all trade names, manufactured by Ciba Japan), and "MARK LA57", "MARK LA67", "MARK LA62", "MARK LA68", and "MARK LA63" (all trade names, manufactured by Adeka Corporation). Examples of thioether-based antioxidants include "SUMILIZER TPS" and "SUMILIZER TP-D" (all trade names) manufactured by Sumitomo Chemical Co., Ltd. Examples of the phosphite-based antioxidants include "MARK 2112", "MARK PEP-8", "MARK PEP-24G", "MARK PEP-36", "MARK 329K", and "MARK HP-10" (all trade names) manufactured by Adeka Corporation.

Further, for the purpose of lowering the residual potential or improving the strength of the charge transporting layer, various particles, for example, may be added to the charge transporting layer.

As an example of the particles, silicon-containing particles are mentioned. The silicon-containing particles are, for example, particles in which silicon is contained as the constitutional elements, and specific examples include colloidal silica and silicone particles. The colloidal silica used as the silicon-containing particles is selected from acidic or alkaline aqueous dispersion liquid, or dispersion in an organic solvent, such as alcohol, ketone, or ester, of silica having an average particle diameter of 1 nm to 100 nm (particularly from 10 nm to 30 nm), and commercially available products may be used.

The content of the colloidal silica is not particularly limited. The content is, for example, in the range of 0.1% by weight to 50% by weight or in the range of 0.1% by weight to 30% by weight based on the total solid weight of the charge transportable composition in terms of film formability, electrical characteristics, and strength.

The silicone particles used as the silicon-containing particles are selected from, for example, silicone resin particles, silicone rubber particles, and silica particles surface treated with silicone, and commercially available products are generally used. These silicone particles are preferably particles having a spherical shape and having an average particle diameter of 1 nm to 500 nm (particularly from 10 nm to 100 nm).

The content of the silicone particles is, for example, in the range of 0.1% by weight to 30% by weight or in the range of 0.5% by weight to 10% by weight based on the total solid weight of the charge transportable composition.

Examples of other particles include fluorine-based particles, such as particles of ethylene tetrafluoride, ethylene trifluoride, propylene hexafluoride, vinyl fluoride, and vinylidene fluoride, particles containing resin obtained by copolymerization of fluororesin with a monomer having a hydroxyl group as shown in "Proceeding of $8^{th}$ Polymer Material Forum, Lecture, pp. 89 to 90", and semiconductor metal oxides, such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, or MgO (Herein, the semiconductor metal oxides preferably have a volume resistivity of $10^3$ Ωcm to $10^{10}$ Ωcm.).

Further, for the purpose of lowering the residual potential or improving the strength of the charge transporting layer, oils, such as silicone oil, for example, may be added to the charge transporting layer. Examples of the silicone oil include ordinary silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbitol-modified polysiloxane, methacrylic modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl-group-containing cyclosiloxanes such as a methylhydrosiloxane mixture, pentamethylcyclopentasiloxane, and phenylhydrocyclosiloxane; and vinyl-group-containing cyclosiloxanes such as pentavinylpentamethylcyclopentasiloxane.

To the charge transportable composition, metals, metal oxides, carbon black, and the like may be added. Examples of the metals include aluminum, zinc, copper, chromium, nickel, silver, stainless steel, and resin particles the surface of which is deposited with these metals. Examples of the metal oxides include zinc oxide, titanium oxide, tin oxide, antimony oxide, indium oxide, bismuth oxide, indium oxide doped with tin, tin oxide doped with antimony or tantalum, and zirconium oxide doped with antimony. These metals and metal oxides may be used singly or in combination of two or more kinds thereof. When two or more kinds thereof are used in combination, they may be simply mixed or may be formed into a solid solution or fusion. The average particle diameter of conductive particles is, for example, in the range of 0.3 μm or lower or in the range of 0.1 μm or lower in terms of transparency of a cured film.

—Method for Forming Charge Transporting Layer"

A method for forming the charge transporting layer will be described.

First, a coating solution for forming a charge transporting layer containing the charge transportable composition is applied onto the charge generating layer.

The coating solution for forming a charge transporting layer containing the charge transportable composition is obtained by, for example, mixing the materials mentioned above, and forming the same into a solution with a solvent, for example. The coating solution for forming a charge transporting layer containing the charge transportable composition is preferably formed into a slurry-like coating solution by adding various particles in terms of film formation. Herein, examples of a method for obtaining a slurry-like coating solution by adding various particles include methods utilizing a stirring method using a stirring blade, a wet dispersion method (e.g., jet mill and beads mill), and the like.

Examples of coating methods include usual methods, such as a ring coating method, a blade coating method, a wire bar coating method, a spray coating method, a dip coating method, a bead coating method, an air knife coating method, or a curtain coating method.

Next, by curing the formed coating film by heat treatment, a cured film is formed to be used as the charge transporting layer.

Examples of methods for heat treatment include methods for performing heat treatment with known heat treatment devices, such as a hot wind drying furnace.

In the heat treatment, i.e., curing by heat, the reaction temperature is, for example, in the range of 30° C. to 180° C., in the range of 80° C. to 170° C., or in the range of 100° C. to 160° C. from the viewpoints of manufacturing efficiency, regulation of a side reaction, and suppressing of degradation of the charge transportable composition.

The reaction time is selected depending on the reaction temperature and is, for example, in the range of 5 minutes to 1000 minutes, in the range of 15 minutes to 500 minutes, or in the range of 30 minutes to 120 minutes.

In order to let radicals generated from the polymerization initiator contribute to a polymerization reaction (chain polymerization reaction) of the chain polymerizable functional group without deactivating, the heat treatment, i.e., curing by heat, is preferably carried out under a vacuum or inactive gas atmosphere (e.g., under an atmosphere in which the oxygen volume concentration is in the range of 1 ppm to 5%, in the range of 5 ppm to 3%, or in the range of 10 ppm to 500 ppm).

The film thickness of the charge transporting layer is, for example, in the range of 5 μm to 50 μm or in the range of 10 μm to 40 μm.

In the description above, an example of the function-separated type electrophotographic photoreceptor is described as an electrophotographic photoreceptor but in the case of the layer structure of the electrophotographic photoreceptor illustrated in FIG. 2, a single-layer photosensitive layer (Charge generating/Charge transporting layer) located at the outermost surface in the layer structure serves as the outermost surface layer, and a layer containing a cured film of the charge transportable composition is applied to the single-layer photosensitive layer. In this case, charge generating materials are contained in the charge transportable composition and the content thereof is, for example, in the range of 10% by weight to 85% by weight or in the range of 20% by weight to 50% by weight based on the total solid weight. The film thickness of the single-layer photosensitive layer (Charge generating/Charge transporting layer) is, for example, in the range of 5 μm to 50 μm or in the range of 10 μm to 40 μm.

In this exemplary embodiment, the aspect in which the outermost surface layer containing the cured film of the charge transportable composition described above is the charge transporting layer but in the case of the layer structure having a protective layer as in the electrophotographic photoreceptors illustrated in FIGS. 3 and 4, the protective layer located at the outermost surface in the layer structure serves as the outermost surface layer and a layer containing the cured film of the charge transportable composition is applied to the protective layer. The film thickness of the protective layer is, for example, in the range of 1 μm to 15 μm or in the range of 3 μm to 10 μm.

For the structures of the charge transporting layer and the single-layer photosensitive layer in the case of having a protective layer, known structures are employed.

[Image Forming Apparatus/Process Cartridge]

Figure 5:
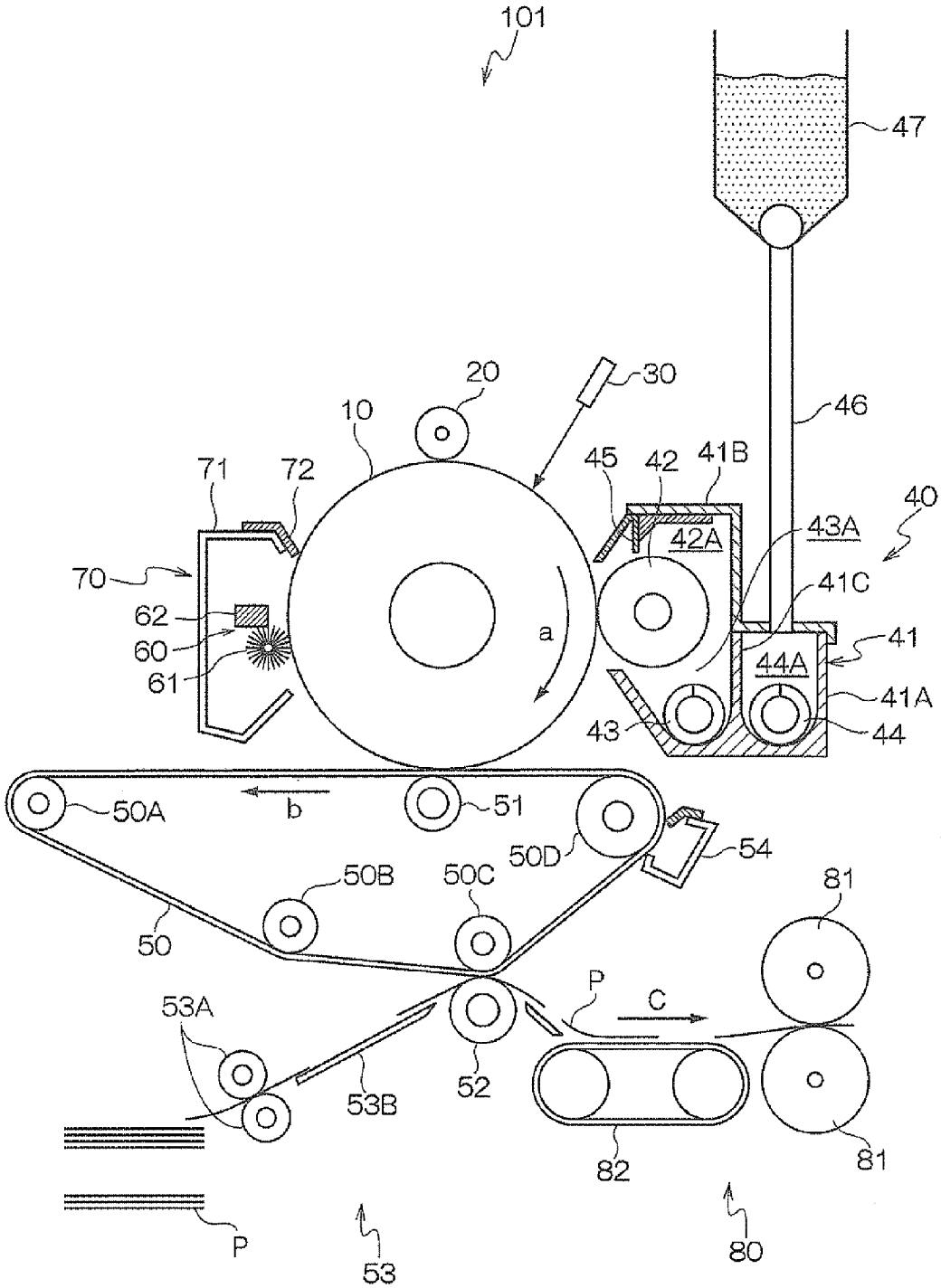
FIG. 5 is a diagram illustrating a schematic configuration view of an image forming apparatus of an exemplary embodiment of the present invention.

FIG. 5 is a schematic configuration diagram illustrating an example of an image forming apparatus according to this exemplary embodiment.

As illustrated in FIG. 5, an image forming apparatus 101 according to this exemplary embodiment has, for example, an electrophotographic photoreceptor 10 (electrophotographic photoreceptor according to this exemplary embodiment) that rotates in the clockwise direction as indicated by the arrow a, a charging device 20 (an example of a charging unit) that is provided above the electrophotographic photoreceptor 10 in such a manner as to face the electrophotographic photoreceptor 10 and charges the surface of the electrophotographic photoreceptor 10, an exposure device 30 (an example of an electrostatic latent image formation unit) that exposes the surface of the electrophotographic photoreceptor 10 charged with the charging device 20 and forms an electrostatic latent image, a development device 40 (an example of a development unit) that accommodates a developer containing a toner and develops the electrostatic latent image formed on the electrophotographic photoreceptor 10 as a toner image with the developer, a belt-like intermediate transfer medium 50 that runs in the direction indicated by the arrow b contacting the electrophotographic photoreceptor 10 and transfers the toner image formed on the surface of the electrophotographic photoreceptor 10, and a cleaning device 70 (an example of a cleaning unit) that cleans the surface of the electrophotographic photoreceptor 10.

The charging device 20, the exposure device 30, the development device 40, the intermediate transfer medium 50, a lubricant supply device 60, and the cleaning device 70 are provided in the clockwise direction on the circumference surrounding the electrophotographic photoreceptor 10. This exemplary embodiment describes an aspect in which the lubricant supply device 60 is disposed in the cleaning device 70 but is not limited thereto. An aspect may be acceptable in which the lubricant supply device 60 is separately disposed from the cleaning device 70. It is a matter of course that an aspect in which the lubricant supply device 60 is not provided may be acceptable.

The intermediate transfer medium 50 is held under tension given from the inside by support rolls 50A and 50B, a back roll 50C, and a drive roll 50D and is driven in the direction indicated by the arrow b with the rotation of the drive roll 50D. At the position facing the electrophotographic photoreceptor 10 inside the intermediate transfer medium 50, a primary transfer device 51 is provided that charges the intermediate transfer medium 50 with a polarity different from the charge polarity of a toner and attaches the toner on the electrophotographic photoreceptor 10 to the outer surface of the intermediate transfer medium 50. At the outside in the lower portion of the intermediate transfer medium 50, a secondary transfer device 52 that charges a recording paper P (an example of the transfer apparatus) with a polarity different from the charge polarity of a toner and transfers a toner image formed on the intermediate transfer medium 50 onto the recording paper P is provided facing the back roll 50C. The members for transferring the toner image formed on the electrophotographic photoreceptor 10 to the recording paper P are equivalent to one example of a transfer unit.

Under the intermediate transfer medium 50, a recording paper feed device 53 that supplies the recording paper P to the secondary transfer device 52 and a fixing device 80 that fixes the toner image while conveying the recording paper P on which the toner image is formed in the secondary transfer device 52 are provided.

The recording paper feed device 53 has a pair of conveyance rolls 53A and a guide plate 53B that guides the recording paper P that is conveyed by the conveyance rolls 53A toward the secondary transfer device 52. In contrast, the fixing device 80 has fixing rolls 81 that are a pair of heat rolls that fix the toner image by heating and pressurizing the recording paper P to which the toner image is transferred by the secondary transfer device 52 and a conveying rotor 82 that conveys the recording paper P toward the fixing rolls 81.

The recording paper P is conveyed in the direction indicated by the arrow c by the recording paper feed device 53, the secondary transfer device 52, and the fixing device 80.

The intermediate transfer medium 50 is further provided with an intermediate transfer medium cleaning device 54 having a cleaning blade that removes the toner remaining on the intermediate transfer medium 50 after transferring the toner image to the recording paper P in the secondary transfer device 52.

Hereinafter, the details of the main constituent members in the image forming apparatus 101 according to this exemplary embodiment will be described.

—Charging Device—

Examples of the charging device 20 include contact type charging devices using a conductive charging roll, a charging brush, a charging film, a charging rubber blade, a charging tube, and the like. Examples of the charging device 20 include known charging devices, such as non-contact roll charging devices and a scorotron charging device or a corotron charging device utilizing corona discharge. The charging device 20 is preferably the contact type charging device.

—Exposure Device—

Examples of the exposure device 30 include optical apparatuses that expose the surface of the electrophotographic photoreceptor 10 by light, such as a semiconductor laser light, an LED light, or a liquid crystal shutter light, in an image pattern. The wavelength of a light source is preferably in the spectral sensitivity region of the electrophotographic photoreceptor 10. As the wavelength of the semiconductor laser light, near-infrared rays having an oscillation wavelength around 780 nm are preferable, for example. The wavelength is not limited to the wavelength mentioned above, and, a laser light having an oscillation wavelength of about 600 nm or a laser light having an oscillation wavelength in the range of 400 nm to 450 nm as a blue laser light may also be utilized. As the exposure device 30, a surface-emitting laser light source that carries out multi-beam output for color image formation is also effective, for example.

—Development Device—

The development device 40 has, for example, a development container 41 (development device body) that is disposed facing the electrophotographic photoreceptor 10 in a development region and accommodates, for example, a two-component developer containing a toner and a carrier and a supply developer storage container 47 (toner cartridge). The development container 41 has a development container body 41A and a development container cover 41B that closes the upper end.

The developer container body 41A has, for example, a development roll chamber 42A for accommodating a development roll 42 inside thereof, and has a first stirring chamber 43A and a second stirring chamber 44 A adjacent to the first stirring chamber 43 A, adjacent to the development roll chamber 42A. In the development roll chamber 42A, a layer thickness regulating member 45 is provided for regulating the layer thickness of a developer on the surface of the development roll 42 when the developer container cover 41B is fitted to the developer container body 41A.

The first stirring chamber 43A and the second stirring chamber 44A are partitioned with a partition wall 41C, for example. Although not illustrated in the drawings, opening portions are provided at both ends in a longitudinal direction (longitudinal direction of the development device) of the partition wall 41C so that the first stirring chamber 43A and the second stirring chamber 44A communicate with each other. The first stirring chamber 43A and the second stirring chamber 44A constitute a circulation stirring chamber (43A+44A).

In the development roll chamber 42A, the development roll 42 is disposed in such a manner as to face the electrophotographic photoreceptor 10. Although not illustrated in the drawings, the development roll 42 is configured by providing a sleeve to the outer side of a magnetic roll (fixed magnet) having magnetism. The developer of the first stirring chamber 43A is adsorbed onto the surface of the development roll 42 with a magnetic force of the magnetic roll, and is conveyed to the development region. The roll axis of the development roll 42 is rotatably supported by the developer container body 41A. Herein, the development roll 42 and the electrophotographic photoreceptor 10 are rotated in reverse directions and, at the facing portion, the developer adsorbed onto the surface of the development roll 42 is conveyed to the development region in the same direction as the traveling direction of the electrophotographic photoreceptor 10.

A bias power source, which is not illustrated in the drawings, is connected to the sleeve of the development roll 42, so that a development bias is applied thereto (in this exemplary embodiment, a bias in which an alternating current component (AC) is superimposed on a direct current component (DC) is applied so that an alternating electric field is applied to the development region).

In the first stirring chamber 43 A and the second stirring chamber 44 A, a first stirring member 43 (stirring and conveyance member) and a second stirring member 44 (stirring and conveyance member) for conveying the developer under stirring are disposed, respectively. The first stirring member 43 is constituted by a first rotation axis extending in the axial direction of the development roll 42 and a stirring conveyance blade (projection portion) that is spirally fixed to the outer periphery of the rotation axis. The second stirring member 44 is also similarly constituted by a second rotation axis and a stirring conveyance blade (projection portion). The stirring members are rotatably supported by the developer container body 41A. The first stirring member 43 and the second stirring member 44 are provided so that the developer in the first stirring chamber 43A and the developer in the second stirring chamber 44A are conveyed in reverse directions.

To one end side in the longitudinal direction of the second stirring chamber 44, one end of a supply conveyance path 46 for supplying a supply developer containing a supply toner and a supply carrier to the second stirring chamber 44 A is connected and, to the other end of the supply conveyance path 46, a supply developer storage container 47 for accommodating a supply developer is connected.

Thus, the development device 40 supplies the supply developer to the development device 40 (second stirring chamber 44A) through the supply conveyance path 46 from the supply developer storage container 47 (toner cartridge).

Herein, the developer for use in the development device 40 will be described.

As the developer, a two-component developer containing a toner and a carrier is employed, for example.

First, the toner will be described.

The toner contains toner particles containing a binder resin, a coloring agent and, as required, other additives, such as a mold release agent and, as required, external additives, for example.

The toner particles preferably have an average shape factor (Average shape factor=Number average shape factor represented by $ML^2/A\times(\pi/4)\times100$, where ML represents the maximum length of the toner particles and A represents a projection area of the toner particles) in the range of 100 to 150, 105 to 145, or 110 to 140, for example. The toner particles preferably have a volume average particle diameter in the range of 3 μm to 12 μm, 3.5 μm to 10 μm, or 4 μm to 9 μm, for example.

The toner particles are not particularly limited by the method for manufacturing the same. For example, toner particles are used that are manufactured by a kneading and grinding method in which a binder resin, a coloring agent, a releasing agent, and, as required, a charge regulating agent or the like are mixed and kneaded, ground, and classified; a method for changing the shape of the particles obtained by the kneading and grinding method with mechanical shock power or heat energy; an emulsion polymerization aggregation method in which a dispersion liquid obtained by emulsifying and polymerizing a polymerizable monomer of a binder resin is mixed with a dispersion liquid containing a coloring agent, a releasing agent, and, as required, a charge regulating agent or the like, and then the mixture is subjected to aggregation, heating, and fusing to obtain toner particles; a suspension polymerization method in which a polymerizable monomer for obtaining a binder resin and a solution containing a coloring agent, a releasing agent, and, as required, a charge regulating agent or the like are suspended in an aqueous medium and subjecting the suspension to polymerization; and a dissolution-suspension method in which a binder resin and a solution containing a coloring agent, a releasing agent, and, as required, a charge regulating agent or the like are suspended in an aqueous medium to form particles.

In addition, known methods, such as a method for producing toner particles having a core-shell structure in which aggregated particles are further attached to a core formed from the toner particles obtained by the above-described methods, and then heated and fused, are used. As the method for manufacturing the toner particles, methods for manufacturing the toner particles in an aqueous medium, such as a suspension-polymerization method, an emulsion polymerization aggregation method, or a dissolution suspension method, are preferable, and an emulsion polymerization aggregation method is particularly preferable from the viewpoint of regulating the shape and the particle diameter distribution of the toner particles.

The toner is manufactured by mixing the toner particles and the external additives with a Henschel mixer, a V-blender mixer, or the like. When the toner particles are manufactured in a wet process, the external additives may also be externally added in a wet process.

As the carrier, iron powder, glass beads, ferrite powder, nickel powder, or a carrier having a surface coating of resin on the surface of the powders are used. The mixing ratio of the carrier and the toner is not particularly limited and is set in well-known ranges.

—Transfer Device—

Examples of the primary transfer device 51 and the secondary transfer device 52 include known transfer charging devices, such as contact type transfer charging devices using a belt, a roll, a film, a rubber blade, or the like, or a scorotron transfer charging device or a corotron transfer charging device utilizing corona discharge.

As the intermediate transfer medium 50, a belt-like one (intermediate transfer belt) is used that contains polyimide, polyamideimide, polycarbonate, polyarylate, polyester, rubber, or the like containing a conducting material. As the shape of the intermediate transfer medium 50, a cylindrical shape is also used in addition to the belt shape.

—Cleaning Device—

The cleaning device 70 contains a case 71, a cleaning blade 72 provided in such a manner as to project from the case 71, and a lubricant supply device 60 that is disposed at the downstream side of the rotation direction of the electrophotographic photoreceptor 10 of the cleaning blade 72.

The cleaning blade 72 may be supported at the end of the case 71 or may be separately supported by a support member (holder). This exemplary embodiment describes an aspect in which the cleaning blade 72 is supported at the end of the case 71.

First, the cleaning blade 72 will be described.

Examples of materials constituting the cleaning blade 72 include urethane rubber, silicon rubber, fluororubber, propylene rubber, and butadiene rubber. Among the above, urethane rubber is preferable.

The urethane rubber (polyurethane) is not particularly limited insofar as it is generally used for the formation of polyurethane, for example. Examples include urethane prepolymers containing polyols (e.g., polyester polyols, such as polyethylene adipate or polycaprolactone) and isocyanates (e.g., diphenylmethane diisocyanate). The urethane rubber (polyurethane) may also be one containing crosslinking agents, such as 1,4-butanediol, trimethylolpropane, ethyleneglycols, or a mixture thereof, as raw materials, for example.

Next, the lubricant supply device 60 will be described.

The lubricant supply device 60 is provided at the inside of the cleaning device 70 and at the upstream side of the rotation direction of the electrophotographic photoreceptor 10 respective to the cleaning blade 72, for example.

The lubricant supply device 60 is constituted by, for example, a rotation brush 61 that is disposed contacting the electrophotographic photoreceptor 10 and a solid lubricant 62 that is disposed contacting the rotation brush 61. In the lubricant supply device 60, by rotating the rotation brush 61 in contact with the solid lubricant 62, a lubricant 62 adheres to the rotation brush 61 and the adhering lubricant 62 is supplied to the surface of the electrophotographic photoreceptor 10, and thus a film of the lubricant 62 is formed.

The lubricant supply device 60 is not limited to the aspect described above and an aspect employing a rubber roll for the rotation brush 61 may be acceptable.

Next, the operation of an image forming apparatus 101 according to this exemplary embodiment will be described. First, the electrophotographic photoreceptor 10 rotates along the direction indicated by the arrow a and, simultaneously therewith, is negatively charged by the charging device 20.

The electrophotographic photoreceptor 10 whose surface is negatively charged by the charging device 20 is exposed by the exposure device 30, and a latent image is formed on the surface.

When the portion where the latent image is formed in the electrophotographic photoreceptor 10 approaches the development device 40, the toner adheres to the latent image by the development device 40 (development roll 42) and a toner image is formed.

When the electrophotographic photoreceptor 10 on which the toner image is formed further rotates in the direction indicated by the arrow a, the toner image is transferred to the outer surface of the intermediate transfer medium 50.

When the toner image is transferred to the intermediate transfer medium 50, the recording paper P is supplied to the secondary transfer device 52 by the recording paper feed device 53, and the toner image transferred to the intermediate transfer medium 50 is transferred onto the recording paper P by the secondary transfer device 52. Thus, the toner image is formed on the recording paper P.

To the recording paper P on which the image is formed, the toner image is fixed by the fixing device 80.

Herein, after the toner image is transferred to the intermediate transfer medium 50, with respect to the electrophotographic photoreceptor 10, the lubricant 62 is supplied to the surface of the electrophotographic photoreceptor 10 by the lubricant supply device 60 after transfer, and then a coat film of the lubricant 62 is formed on the surface of the electrophotographic photoreceptor 10. Thereafter, the toner or discharge products remaining on the surface are removed by the cleaning blade 72 of the cleaning device 70. Then, the electrophotographic photoreceptor 10 from which the toner and discharge products remaining after transfer are removed in the cleaning device 70 is charged again by the charging device 20 and exposed in the exposure device 30, and thus a latent image is formed.

Figure 6:
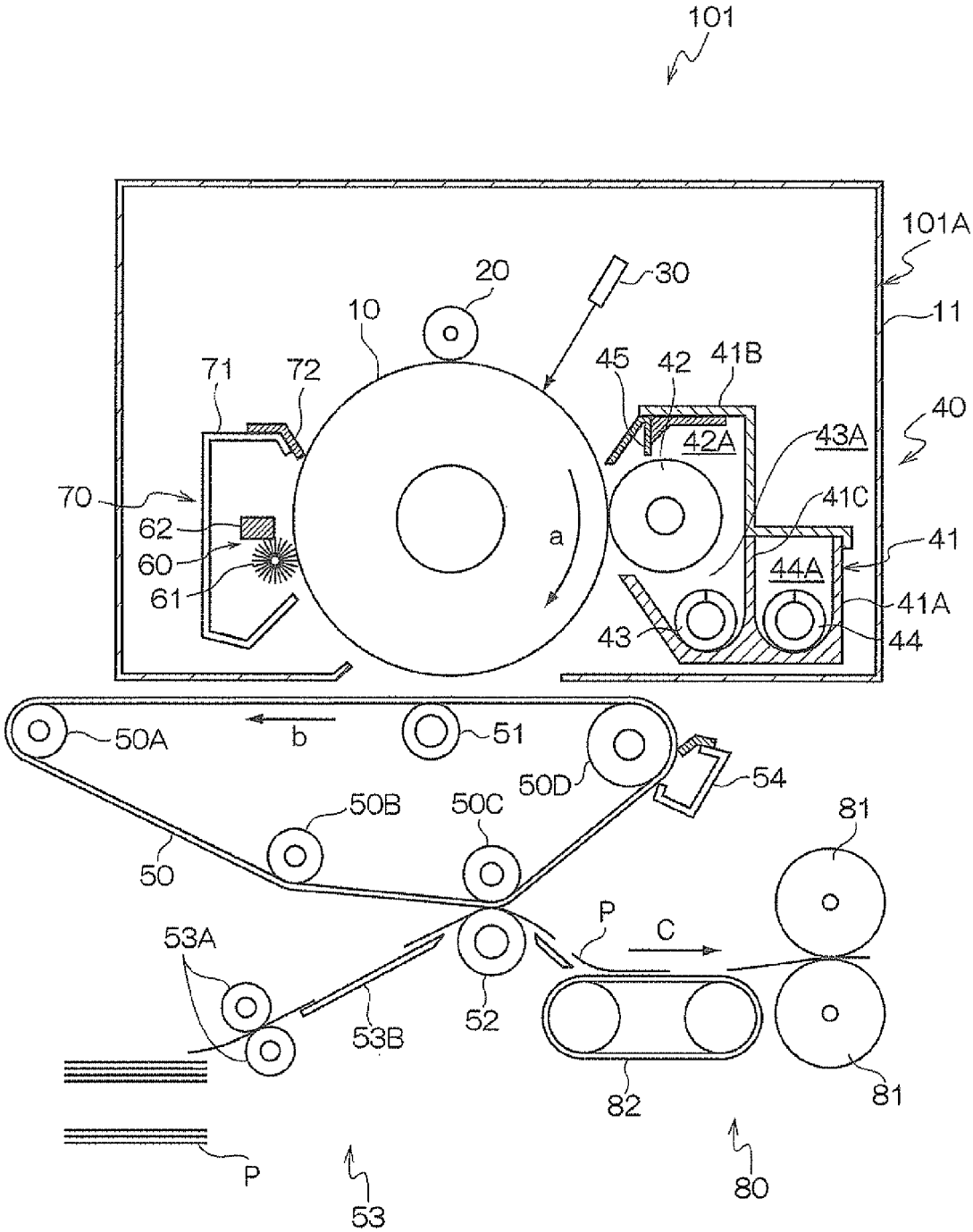
FIG. 6 is a diagram illustrating a schematic configuration view of an image forming apparatus of another exemplary embodiment of the present invention.

In addition, the image forming apparatus 101 according to this exemplary embodiment may have, for example, an aspect of having a process cartridge 101A in which the electrophotographic photoreceptor 10, the charging device 20, the development device 40, the lubricant supply device 60, and the cleaning device 70 are integrally accommodated in a case 11 as illustrated in FIG. 6. This process cartridge 101A integrally accommodates plural components and is detachably attached to the image forming apparatus 101. In the image forming apparatus 101 illustrated in FIG. 6, an aspect is illustrated in which the supply developer storage container 47 is not provided in the development device 40.

The structure of the process cartridge 101A is not limited thereto and, for example, may at least have the electrophotographic photoreceptor 10 and, in addition thereto, may have at least one selected from the charging device 20, the exposure device 30, the development device 40, the primary transfer device 51, the lubricant supply device 60, and the cleaning device 70, for example.

The image forming apparatus 101 according to this exemplary embodiment is not limited to the structure described above and may have, for example, an aspect in which a first static eliminator that equalizes the polarity of the remaining toner and facilitates the removement thereof by a cleaning brush is provided at the circumference of the electrophotographic photoreceptor 10 and at the upstream side of the rotation direction of the electrophotographic photoreceptor relative to the primary transfer device 51 or may have an aspect in which a second static eliminator that eliminates the charges on the surface of the electrophotographic photoreceptor 10 is provided at the downstream side of the rotation direction of the electrophotographic photoreceptor relative to the cleaning device 70 and at the upstream side of the rotation direction of the electrophotographic photoreceptor relative to the charging device 20.

Moreover, the image forming apparatus 101 according to this exemplary embodiment is not limited to the structure described above and may employ a system for directly transferring the toner image formed on the electrophotographic photoreceptor 10 to the recording paper P or a tandem type image forming apparatus.

EXAMPLES

Hereinafter, the present invention will be more specifically described with reference to Examples but is not limited thereto.

Example 1

(Formation of Electrophotographic Photoreceptor)

—Production of Undercoat Layer—

100 parts by weight of zinc oxide (average particle diameter of 70 nm, specific surface area of 15 $m^2/g$, manufactured by TAYCA Corp.) and 500 parts by weight of toluene are mixed under stirring, 1.3 parts by weight of a silane coupling agent (trade name: KBM503, manufactured by Shin-Etsu Chemical Co., Ltd.) is added; and then the resultant mixture is stirred for 2 hours. Thereafter, the toluene is distilled off by vacuum distillation, and then baking is performed at 120° C. for 3 hours to obtain zinc oxide surface-treated with the silane coupling agent. 110 parts by weight of the surface-treated zinc oxide and 500 parts by weight tetrahydrofuran are mixed under stirring, a solution in which 0.6 parts by weight of alizarin is dissolved in 50 parts by weight of tetrahydrofuran is added, and then the resultant mixture is stirred at 50° C. for 5 hours. Thereafter, zinc oxide to which alizarin is applied is filtered off by vacuum filtration, and further dried under reduced pressure at 60° C. to obtain zinc oxide having alizarin applied thereto is obtained.

38 parts by weight of a solution in which 60 parts by weight of the zinc oxide having alizarin applied thereto, 13.5 parts by weight of a curing agent (blocked isocyanate, SUMIDULE 3175, trade name, manufactured by Sumitomo Bayer Urethane Co., Ltd.), and 15 parts by weight of butyral resin (S-LEC BM-1, trade name, manufactured by Sekisui Chemical Co., Ltd.) are dissolved in 85 parts by weight of methyl ethyl ketone is mixed with 25 parts by weight of methyl ethyl ketone, and then the resultant mixture is dispersed using a sand mill with 1 mmϕ glass beads for 2 hours to obtain a dispersion liquid.

To the obtained dispersion liquid, 0.005 part by weight of dioctyl tin dilaurate as a catalyst and 40 parts by weight of silicone resin particles (TOSPEARL 145, trade name, manufactured by GE Toshiba Silicone Corp.) are added to obtain a coating solution for forming an undercoat layer.

A cylindrical aluminum base having a diameter of 30 mm, a length of 340 mm, and a thickness of 1 mm is prepared as a conductive base. Then, the obtained coating solution for forming an undercoat layer is applied onto the cylindrical aluminum base by dip coating, and then dried and cured at 170° C. for 40 minutes to obtain a 18 μm thick undercoat layer.

(Formation of Charge Generating Layer)

A mixture including 15 parts by weight of hydroxy gallium phthalocyanine having the diffraction peaks at least at 7.3°, 16.0°, 24.9° and 28.0° of Bragg angles (2θ±0.2°) in an X-ray diffraction spectrum of Cukα characteristic X ray as a charge generating substance, 10 parts by weight of vinyl chloride-vinyl acetate copolymer resin (trade name: VMCH, manufactured by Nippon Unicar Co., Ltd.) as a binder resin, and 200 parts by weight of n-butyl acetate is dispersed using a sand mill with the glass beads of 1 mmϕ diameter for 4 hours. 175 parts by weight of n-butyl acetate and 180 parts by weight of methyl ethyl ketone are added to the obtained dispersion, then stirred to obtain a coating solution for a charge generating layer.

The obtained coating solution for forming a charge generating layer is applied onto the undercoat layer formed beforehand on the cylindrical aluminum base by dip coating, and dried at ordinary temperature (25° C.) to form a 0.2 μm thick charge generating layer.

—Production of Charge Transportable Composition—

100 parts by weight of the compound represented by (i-11) above as a compound having a chain polymerizable functional group and a charge transportable skeleton in a molecule and 5 parts by weight of 1-dodecanethiol (manufactured by Tokyo Chemical Industry Co., Ltd.) which is a chain transfer agent having sulfur atoms in a molecule are dissolved in 315 parts by weight of a mixed solvent of tetrahydrofuran (containing no stabilizer, manufactured by Tokyo Chemical Industry Co., Ltd.) and toluene (manufactured by Kanto Kagaku) with a weight ratio of 50:50. Thereafter, 2 parts by weight of V-65 (trade name, manufactured by Wako Pure Chemical Industries, Ltd.) as a polymerization initiator is added to the obtained solution, and then dissolved therein to produce a charge transportable composition.

—Formation of Charge Transporting Layer—

The obtained charge transportable composition is used as a coating solution for forming a charge transporting layer, and then the coating solution for forming a charge transporting layer is applied onto the charge generating layer formed beforehand on the cylindrical aluminum base by a ring coating method at a push-up rate of 150 mm/min. Thereafter, a curing reaction of a temperature of 150±5° C. and a time of 60 minutes is carried out in a state of an oxygen volume concentration of 300 ppm or lower with a nitrogen drier having an oxygen concentration meter to form a charge transporting layer. In this case, the film thickness is 12 μm.

Thus, an electrophotographic photoreceptor is produced.

Examples 2 to 69, Comparative Examples 1 to 10

An undercoat layer and a charge generating layer are applied to a cylindrical aluminum base by the method described in Example 1. Thereafter, a charge transporting layer is formed by the method described in Example 1, except changing the charge transportable composition as shown in Tables 1 to 5 to produce electrophotographic photoreceptors.

Comparative Example 11

—Formation of Undercoat Layer and Charge Generating Layer—

An undercoat layer and a charge generating layer are formed on a cylindrical aluminum base by the method described in Example 1.

—Production of Charge Transportable Composition—

100 parts by weight of the compound represented by (i-11) above as a compound having a chain polymerizable functional group and a charge transportable skeleton in a molecule and 5 parts by weight of 1-dodecanethiol (manufactured by Tokyo Chemical Industry Co., Ltd.) which is a chain transfer agent having sulfur atoms in a molecule are dissolved in 315 parts by weight of a mixed solvent of tetrahydrofuran (containing no stabilizer, manufactured by Tokyo Chemical Industry Co., Ltd.) and toluene (manufactured by Kanto Kagaku) with a weight ratio of 50:50. Thereafter, 2 parts by weight of IRGACURE 651 (trade name, manufactured by Ciba Specialty Chemicals) as a polymerization initiator is added and dissolved in the obtained solution to produce a charge transportable composition.

—Formation of Charge Transporting Layer—

The obtained charge transportable composition is used as a coating solution for forming a charge transporting layer, and then the coating solution for forming a charge transporting layer is applied onto the charge generating layer formed beforehand on the cylindrical aluminum base by a ring coating method at a push-up rate of 150 mm/min. Thereafter, a curing reaction is carried out by emitting UV light for 60 seconds using a Uni-Cure System (trade name, manufactured by Ushio Inc.) at a temperature of 30±5° C. under an environment of nitrogen flow, and the remaining solvent is dried at a temperature 120±5° C. for 10 minutes to form a charge transporting layer (cured film). In this case, the film thickness is 19.85 μm.

Examples 70 to 76, Comparative Examples 12 to 17

An undercoat layer and a charge generating layer are applied to a cylindrical aluminum base by the method described in Comparative Example 11. Thereafter, a charge transporting layer is formed by the method described in Comparative Example 11, except changing the charge transportable composition as shown in Tables 4 and 5 to produce electrophotographic photoreceptors.

[Evaluation 1]

From the outermost surface layer (charge transporting layer) of the electrophotographic photoreceptor obtained in each example, samples are collected, and then the curing reaction rate and the charge mobility of the compound having a chain polymerizable functional group and a charge transportable skeleton in a molecule are analyzed. The results are shown in Tables 6 to 10.

The curing reaction rate is calculated as follows: the extracted cured films are immersed in tetrahydrofuran at 55° C. for 3 hours, unreacted materials among these compounds are extracted, qualitative analysis and quantitative determination of the compound are performed using an HLC-8120GPC (trade name) manufactured by Tosoh Corporation, columns of TSK guard column Super H-T, TSK gel Super H 2000, TSK gel Super H 2500, and TSK gel Super H 3000, and a developing solvent tetrahydrofuran, and then the reaction rate is calculated on the basis of the compounding ratio of the compound having a chain polymerizable functional group and a charge transportable skeleton in a molecule contained in the charge transportable composition before curing.

The charge mobility is measured using a XTOF (Xerographic Time Of Flight) method under the conditions of 40% RH at 24° C. Specifically, a voltage is applied to the electrophotographic photoreceptor using a scorotron charging device in such a manner as to achieve an electric field intensity of $1\times10^5$ V/cm, pulsed light irradiation by a xenon flash lamp is performed to generate charges from the charge generating layer, and then changes in photoreceptor surface potential are measured using a potential probe, an electrometer amplifier, and a digital oscilloscope. For the determination of traveling time, a method for determining the same from the bending point of a waveform obtained by logarithmically transforming the relationship between time change and time differentiation of surface potential is used.

[Evaluation 2]

The electrophotographic photoreceptor obtained in each example is placed on DocuCentre Color 450 (trade name) manufactured by Fuji Xerox Co., Ltd., and then a printed image having a solid image portion with an image density of 100% and a halftone image portion with an image density of 20% is continuously printed to 5000 sheets of A4 paper under an environment of 85% RH at 28° C.

The following image evaluation test is performed for the printed images of the 100th paper at an early stage and 5000th paper after passage of time. The electrophotographic photoreceptor is also evaluated for the scratch resistance. The results are shown in Tables 6 to 10.

For the image formation test, P paper (A4 size, short side direction feed) manufactured by Fuji Xerox Co., Ltd is used.

The evaluation results are shown in Tables 6 to 10.

—Evaluation of Initial Image Density Unevenness—

For evaluation of the initial image density unevenness, the solid image portion of the printed image of the 100th paper is visually observed, and then is judged based on the following criteria.

A: No image density unevenness occurs.

B: Image density unevenness partially occurs.

C: Image density unevenness causing problems on image quality occurs.

—Evaluation of Initial Resolution—

For evaluation of the initial resolution, 5 portions of the halftone image portion of the printed image of the 100th paper are observed under an optical microscope (magnification 100 times), and judged under the following criteria.

A: Halftone dots are observed.

B: Some halftone dots are not developed.

C: Halftone dots are not developed.

—Evaluation of Image Density Unevenness after Passage of Time—

For evaluation of the density unevenness after passage of time, the solid image portion of the printed image of the 5000th paper is visually observed, and then judged under the following criteria.

A: No image density unevenness occurs.

B: Image density unevenness partially occurs.

C: Image density unevenness causing problems on image quality occurs.

—Evaluation of Resolution after Passage of Time—

For evaluation of the resolution after passage of time, 5 portions of the halftone image portion of the printed image of the 5000th paper are observed under an optical microscope (magnification 100 times), and judged under the following criteria.

A: Halftone dots are observed.

B: Some halftone dots are not developed.

C: Halftone dots are not developed.

—Evaluation of Scratch Resistance—

The electrophotographic photoreceptor surface after 5000-paper printing is visually observed, and is judged under the following criteria.

A: No scratch occurs.

B: Scratch slightly occurs.

C: Scratch partially occurs.

D: Scratch entirely occurs.

[Evaluation 3]

The electrophotographic photoreceptors obtained in Examples 1, 2, 7, 9, 12 to 17, and 71 and Comparative Examples 2 and 12 are further subjected to 5000-paper printing after the termination of Evaluation 2, the conditions are changed to severer conditions, and then evaluation (image density unevenness evaluation, resolution evaluation, and scratch resistance evaluation) is performed by the method described in Evaluation 2. The results are shown in Table 11.

[Table 1]

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Ex. 1 | a-1 | 100 | b-1 | 5 | c-1 | 2 | — | — | — | — | — | — |
| Ex. 2 | a-1 | 100 | b-2 | 5 | c-1 | 2 | — | — | — | — | — | — |
| Ex. 3 | a-1 | 100 | b-3 | 5 | c-1 | 2 | — | — | — | — | — | — |
| Ex. 4 | a-1 | 100 | b-4 | 5 | c-1 | 2 | — | — | — | — | — | — |
| Ex. 5 | a-1 | 100 | b-5 | 5 | c-1 | 2 | — | — | — | — | — | — |
| Ex. 6 | a-1 | 100 | b-6 | 5 | c-1 | 2 | — | — | — | — | — | — |
| Ex. 7 | a-1 | 100 | b-7 | 5 | c-1 | 2 | — | — | — | — | — | — |
| Ex. 8 | a-2 | 100 | b-1 | 2 | c-2 | 2 | — | — | — | — | — | — |
| Ex. 9 | a-2 | 100 | b-1 | 5 | c-2 | 2 | — | — | — | — | — | — |
| Ex. 10 | a-2 | 100 | b-1 | 10 | c-2 | 2 | — | — | — | — | — | — |
| Ex. 11 | a-2 | 100 | b-1 | 15 | c-2 | 2 | — | — | — | — | — | — |
| Ex. 12 | a-2 | 100 | b-2 | 5 | c-2 | 2 | — | — | — | — | — | — |
| Ex. 13 | a-2 | 100 | b-3 | 5 | c-2 | 2 | — | — | — | — | — | — |
| Ex. 14 | a-2 | 100 | b-4 | 5 | c-2 | 2 | — | — | — | — | — | — |
| Ex. 15 | a-2 | 100 | b-5 | 5 | c-2 | 2 | — | — | — | — | — | — |
| Ex. 16 | a-2 | 100 | b-6 | 5 | c-2 | 2 | — | — | — | — | — | — |
| Ex. 17 | a-2 | 100 | b-7 | 5 | c-2 | 2 | — | — | — | — | — | — |
| Ex. 18 | a-2 | 100 | b-7 | 10 | c-2 | 2 | — | — | — | — | — | — |
| Ex. 19 | a-2 | 100 | b-7 | 15 | c-2 | 2 | — | — | — | — | — | — |
| Ex. 20 | a-2 | 100 | b-1 | 5 | c-3 | 2 | — | — | — | — | — | — |

TABLE 2

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Ex. 21 | a-2 | 100 | b-5 | 5 | c-3 | 2 | — | — | — | — | — | — |
| Ex. 22 | a-2 | 100 | b-6 | 5 | c-3 | 2 | — | — | — | — | — | — |
| Ex. 23 | a-2 | 100 | b-7 | 5 | c-3 | 2 | — | — | — | — | — | — |
| Ex. 24 | a-3 | 100 | b-1 | 5 | c-2 | 2 | — | — | — | — | — | — |

TABLE 2-continued

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Ex. 25 | a-3 | 100 | b-2 | 5 | c-2 | 2 | — | — | — | — | — | — |
| Ex. 26 | a-3 | 100 | b-3 | 5 | c-2 | 2 | — | — | — | — | — | — |
| Ex. 27 | a-3 | 100 | b-4 | 5 | c-2 | 2 | — | — | — | — | — | — |
| Ex. 28 | a-3 | 100 | b-5 | 2 | c-2 | 2 | — | — | — | — | — | — |
| Ex. 29 | a-3 | 100 | b-6 | 5 | c-2 | 2 | — | — | — | — | — | — |
| Ex. 30 | a-3 | 100 | b-7 | 5 | c-2 | 2 | — | — | — | — | — | — |
| Ex. 31 | a-4 | 100 | b-1 | 2 | c-2 | 2 | — | — | — | — | — | — |
| Ex. 32 | a-4 | 100 | b-1 | 5 | c-2 | 2 | — | — | — | — | — | — |
| Ex. 33 | a-4 | 100 | b-1 | 10 | c-2 | 2 | — | — | — | — | — | — |
| Ex. 34 | a-4 | 100 | b-1 | 15 | c-2 | 2 | — | — | — | — | — | — |
| Ex. 35 | a-4 | 100 | b-2 | 5 | c-2 | 2 | — | — | — | — | — | — |
| Ex. 36 | a-4 | 100 | b-3 | 5 | c-2 | 2 | — | — | — | — | — | — |
| Ex. 37 | a-4 | 100 | b-4 | 5 | c-2 | 2 | — | — | — | — | — | — |
| Ex. 38 | a-4 | 100 | b-5 | 2 | c-2 | 2 | — | — | — | — | — | — |
| Ex. 39 | a-4 | 100 | b-5 | 5 | c-2 | 2 | — | — | — | — | — | — |
| Ex. 40 | a-4 | 100 | b-5 | 10 | c-2 | 2 | — | — | — | — | — | — |

TABLE 3

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Ex. 41 | a-4 | 100 | b-5 | 15 | c-2 | 2 | — | — | — | — | — | — |
| Ex. 42 | a-4 | 100 | b-6 | 2 | c-2 | 2 | — | — | — | — | — | — |
| Ex. 43 | a-4 | 100 | b-6 | 5 | c-2 | 2 | — | — | — | — | — | — |
| Ex. 44 | a-4 | 100 | b-6 | 10 | c-2 | 2 | — | — | — | — | — | — |
| Ex. 45 | a-4 | 100 | b-6 | 15 | c-2 | 2 | — | — | — | — | — | — |
| Ex. 46 | a-4 | 100 | b-7 | 2 | c-2 | 2 | — | — | — | — | — | — |
| Ex. 47 | a-4 | 100 | b-7 | 5 | c-2 | 2 | — | — | — | — | — | — |
| Ex. 48 | a-4 | 100 | b-7 | 10 | c-2 | 2 | — | — | — | — | — | — |
| Ex. 49 | a-4 | 100 | b-7 | 15 | c-2 | 2 | — | — | — | — | — | — |
| Ex. 50 | a-4 | 100 | b-1 | 5 | c-3 | 2 | — | — | — | — | — | — |
| Ex. 51 | a-4 | 100 | b-5 | 5 | c-3 | 2 | — | — | — | — | — | — |
| Ex. 52 | a-4 | 100 | b-6 | 5 | c-3 | 2 | — | — | — | — | — | — |
| Ex. 53 | a-4 | 100 | b-7 | 5 | c-3 | 2 | — | — | — | — | — | — |
| Ex. 54 | a-2 | 100 | b-1 | 5 | c-2 | 2 | d-1 | 25 | — | — | — | — |
| Ex. 55 | a-2 | 100 | b-5 | 5 | c-2 | 2 | d-1 | 25 | — | — | — | — |
| Ex. 56 | a-2 | 100 | b-6 | 5 | c-2 | 2 | d-1 | 25 | — | — | — | — |
| Ex. 57 | a-2 | 100 | b-7 | 5 | c-2 | 2 | d-1 | 25 | — | — | — | — |
| Ex. 58 | a-2 | 100 | b-1 | 5 | c-2 | 2 | d-1 | 25 | e-1 | 10 | — | — |
| Ex. 59 | a-2 | 100 | b-1 | 5 | c-2 | 2 | d-1 | 25 | e-2 | 10 | — | — |
| Ex. 60 | a-2 | 100 | b-1 | 5 | c-2 | 2 | d-1 | 25 | e-3 | 10 | — | — |

TABLE 4

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Ex. 61 | a-2 | 100 | b-1 | 5 | c-2 | 2 | d-1 | 25 | e-1 | 10 | f-1 | 10 |
| Ex. 62 | a-4 | 100 | b-1 | 5 | c-2 | 2 | d-1 | 25 | — | — | — | — |
| Ex. 63 | a-4 | 100 | b-5 | 5 | c-2 | 2 | d-1 | 25 | — | — | — | — |
| Ex. 64 | a-4 | 100 | b-6 | 5 | c-2 | 2 | d-1 | 25 | — | — | — | — |
| Ex. 65 | a-4 | 100 | b-7 | 5 | c-2 | 2 | d-1 | 25 | — | — | — | — |
| Ex. 66 | a-4 | 100 | b-1 | 5 | c-2 | 2 | d-1 | 25 | e-1 | 10 | — | — |
| Ex. 67 | a-4 | 100 | b-1 | 5 | c-2 | 2 | d-1 | 25 | e-2 | 10 | — | — |
| Ex. 68 | a-4 | 100 | b-1 | 5 | c-2 | 2 | d-1 | 25 | e-3 | 10 | — | — |
| Ex. 69 | a-4 | 100 | b-1 | 5 | c-2 | 2 | d-1 | 25 | e-1 | 10 | f-1 | 10 |
| Ex. 70 | a-1 | 100 | b-6 | 5 | c-5 | 8 | — | — | — | — | — | — |
| Ex. 71 | a-2 | 100 | b-6 | 5 | c-5 | 8 | — | — | — | — | — | — |
| Ex. 72 | a-3 | 100 | b-6 | 5 | c-5 | 8 | — | — | — | — | — | — |
| Ex. 73 | a-4 | 100 | b-6 | 5 | c-5 | 8 | — | — | — | — | — | — |
| Ex. 74 | a-2 | 100 | b-6 | 5 | c-5 | 8 | d-1 | 25 | — | — | — | — |
| Ex. 75 | a-4 | 100 | b-6 | 5 | c-5 | 8 | d-1 | 25 | — | — | — | — |
| Ex. 76 | a-4 | 100 | b-6 | 5 | c-5 | 8 | d-1 | 25 | e-1 | 10 | f-1 | 10 |

TABLE 5

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Comp. Ex. 1 | a-1 | 100 | — | — | c-2 | 2 | — | — | — | — | — | — |
| Comp. Ex. 2 | a-2 | 100 | — | — | c-2 | 2 | — | — | — | — | — | — |
| Comp. Ex. 3 | a-3 | 100 | — | — | c-2 | 2 | — | — | — | — | — | — |
| Comp. Ex. 4 | a-4 | 100 | — | — | c-2 | 2 | — | — | — | — | — | — |
| Comp. Ex. 5 | a-4 | 100 | — | — | c-3 | 2 | — | — | — | — | — | — |
| Comp. Ex. 6 | a-4 | 100 | — | — | c-4 | 2 | — | — | — | — | — | — |
| Comp. Ex. 7 | a-2 | 100 | — | — | c-3 | 2 | d-1 | 25 | — | — | — | — |
| Comp. Ex. 8 | a-4 | 100 | — | — | c-3 | 2 | d-1 | 25 | — | — | — | — |
| Comp. Ex. 9 | a-2 | 100 | — | — | c-3 | 2 | d-1 | 25 | e-1 | 10 | f-1 | 10 |
| Comp. Ex. 10 | a-4 | 100 | — | — | c-3 | 2 | d-1 | 25 | e-1 | 10 | f-1 | 10 |
| Comp. Ex. 11 | a-1 | 100 | b-1 | 5 | c-5 | 2 | — | — | — | — | — | — |
| Comp. Ex. 12 | a-2 | 100 | b-1 | 5 | c-5 | 2 | — | — | — | — | — | — |
| Comp. Ex. 13 | a-3 | 100 | b-1 | 5 | c-5 | 2 | — | — | — | — | — | — |
| Comp. Ex. 14 | a-4 | 100 | b-1 | 5 | c-5 | 2 | — | — | — | — | — | — |
| Comp. Ex. 15 | a-2 | 100 | b-1 | 5 | c-5 | 2 | d-1 | 25 | — | — | — | — |
| Comp. Ex. 16 | a-4 | 100 | b-1 | 5 | c-5 | 2 | d-1 | 25 | — | — | — | — |

TABLE 5-continued

| | (a) Compound having a chain polymerizable functional group and a charge transportable skeleton | | (b) Chain transfer agent | | (c) Polymerization initiator | | (d) Compound having no chain polymerizable reactive group and having a charge transportable skeleton | | (e) Compound having a chain polymerizable reactive group and having no charge transportable skeleton | | (f) Binder resin | |
|---|---|---|---|---|---|---|---|---|---|---|---|---|
| | Type | Part by weight | Type | Part by weight | Type | Part by weight | Type | Part by weight | Type | Part by weight | Type | Part by weight |
| Comp. Ex. 17 | a-4 | 100 | b-1 | 5 | c-5 | 2 | d-1 | 25 | e-1 | 10 | f-1 | 10 |

TABLE 6

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Ex. 1 | 90.2 | 0.8 | Used | A | A | B | B | B |
| Ex. 2 | 91.8 | 0.6 | Used | B | B | B | B | B |
| Ex. 3 | 91.4 | 0.5 | Used | B | B | B | B | B |
| Ex. 4 | 91.3 | 0.5 | Used | B | B | B | B | B |
| Ex. 5 | 90.1 | 0.7 | Used | A | A | B | B | B |
| Ex. 6 | 92.9 | 0.9 | Used | A | A | B | B | B |
| Ex. 7 | 93.7 | 1.0 | Used | A | A | B | B | B |
| Ex. 8 | 93.7 | 0.8 | Used | A | A | B | B | B |
| Ex. 9 | 95.1 | 0.9 | Used | A | A | A | A | A |
| Ex. 10 | 95.2 | 0.9 | Used | A | A | A | A | A |
| Ex. 11 | 95.2 | 1.0 | Used | A | A | B | A | B |
| Ex. 12 | 93.9 | 0.5 | Used | B | B | B | B | B |
| Ex. 13 | 93.4 | 0.6 | Used | B | B | B | B | B |
| Ex. 14 | 92.9 | 0.6 | Used | B | B | B | B | B |
| Ex. 15 | 95.1 | 1.1 | Used | B | B | A | B | A |
| Ex. 16 | 97.1 | 1.3 | Used | B | B | A | B | A |
| Ex. 17 | 98.8 | 1.5 | Used | B | B | A | B | A |
| Ex. 18 | 99.0 | 1.7 | Used | B | B | A | B | A |
| Ex. 19 | 99.0 | 1.8 | Used | B | B | A | B | A |
| Ex. 20 | 98.9 | 0.9 | Used | B | B | A | B | A |

TABLE 7

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Ex. 21 | 98.5 | 0.9 | Used | B | B | A | B | A |
| Ex. 22 | 99.7 | 1.0 | Used | B | B | A | B | A |
| Ex. 23 | 99.8 | 1.0 | Used | B | B | A | B | A |
| Ex. 24 | 97.5 | 0.7 | Used | A | A | A | A | A |
| Ex. 25 | 96.4 | 0.6 | Used | B | B | B | B | B |
| Ex. 26 | 96.7 | 0.6 | Used | B | B | B | B | B |
| Ex. 27 | 96.9 | 0.6 | Used | B | B | B | B | B |
| Ex. 28 | 95.8 | 0.7 | Used | A | A | A | A | A |
| Ex. 29 | 98.8 | 0.9 | Used | A | A | A | A | A |
| Ex. 30 | 99.1 | 0.9 | Used | A | A | A | A | A |
| Ex. 31 | 98.0 | 0.5 | Used | A | A | A | A | A |
| Ex. 32 | 98.5 | 0.5 | Used | A | A | A | A | A |
| Ex. 33 | 99.2 | 0.7 | Used | A | A | A | A | A |
| Ex. 34 | 99.7 | 0.8 | Used | A | A | A | A | A |
| Ex. 35 | 97.4 | 0.5 | Used | B | B | B | B | B |
| Ex. 36 | 96.9 | 0.5 | Used | B | B | B | B | B |
| Ex. 37 | 97.1 | 0.5 | Used | B | B | B | B | B |
| Ex. 38 | 97.9 | 0.6 | Used | A | A | A | A | A |

TABLE 7-continued

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Ex. 39 | 97.9 | 0.6 | Used | A | A | A | A | A |
| Ex. 40 | 98.1 | 0.7 | Used | A | A | A | A | A |

TABLE 8

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Ex. 41 | 98.1 | 0.7 | Used | A | A | B | B | B |
| Ex. 42 | 99.1 | 1.0 | Used | A | A | A | A | A |
| Ex. 43 | 99.2 | 1.2 | Used | A | A | A | A | A |
| Ex. 44 | 99.6 | 1.8 | Used | A | A | A | A | A |
| Ex. 45 | 99.7 | 2.0 | Used | A | A | B | B | A |
| Ex. 46 | 98.3 | 1.0 | Used | A | A | A | A | A |
| Ex. 47 | 99.4 | 1.1 | Used | A | A | A | A | A |
| Ex. 48 | 99.5 | 1.5 | Used | A | A | B | B | A |
| Ex. 49 | 99.6 | 2.2 | Used | A | A | B | B | A |
| Ex. 50 | 99.0 | 0.8 | Used | A | A | A | B | A |
| Ex. 51 | 98.9 | 0.8 | Used | A | A | A | B | A |
| Ex. 52 | 99.8 | 1.0 | Used | A | A | A | B | A |
| Ex. 53 | 99.8 | 0.9 | Used | A | A | A | B | A |
| Ex. 54 | 99.8 | 1.3 | Used | A | A | A | A | B |
| Ex. 55 | 99.8 | 2.0 | Used | A | A | A | A | B |
| Ex. 56 | 99.9 | 2.5 | Used | A | A | A | A | A |
| Ex. 57 | 99.9 | 3.0 | Used | A | A | A | A | A |
| Ex. 58 | 99.8 | 0.8 | Used | A | A | A | A | B |
| Ex. 59 | 99.8 | 0.9 | Used | A | A | A | A | B |
| Ex. 60 | 99.8 | 0.9 | Used | A | A | A | A | B |

TABLE 9

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Ex. 61 | 99.4 | 0.9 | Used | A | A | A | A | B |
| Ex. 62 | 98.8 | 1.5 | Used | A | A | A | A | A |
| Ex. 63 | 98.7 | 1.5 | Used | A | A | A | A | A |
| Ex. 64 | 99.5 | 2.0 | Used | A | A | A | A | A |
| Ex. 65 | 99.6 | 1.9 | Used | A | A | A | A | A |
| Ex. 66 | 99.3 | 0.7 | Used | A | A | A | A | A |
| Ex. 67 | 99.2 | 0.7 | Used | A | A | A | A | A |
| Ex. 68 | 99.2 | 0.8 | Used | A | A | A | A | A |
| Ex. 69 | 99.2 | 0.8 | Used | A | A | A | A | A |
| Ex. 70 | 90.4 | 0.7 | Used | B | B | B | B | B |
| Ex. 71 | 94.2 | 0.7 | Used | B | B | B | B | B |
| Ex. 72 | 94.4 | 0.7 | Used | B | B | B | B | B |
| Ex. 73 | 95.0 | 0.7 | Used | B | B | B | B | B |
| Ex. 74 | 95.8 | 0.7 | Used | B | B | B | B | B |
| Ex. 75 | 96.5 | 0.7 | Used | B | B | B | B | B |
| Ex. 76 | 94.1 | 0.7 | Used | B | B | B | B | B |

TABLE 10

| | Evaluation 1 | | | Evaluation 2 | | | | |
|---|---|---|---|---|---|---|---|---|
| | Curing reaction rate (%) | Charge mobility ($\times 10^{-6}$ $cm^2/Vs$) | Use or no use of charge transfer agent having sulfur atoms in a molecule | Evaluation of initial image density unevenness | Evaluation of initial resolution | Evaluation of image density unevenness after passage of time | Evaluation of resolution after passage of time | Evaluation of scratch resistance |
| Comp. Ex. 1 | 78.0 | Unmeasurable | Non-used | A | A | C | C | D |
| Comp. Ex. 2 | 85.0 | Unmeasurable | Non-used | B | B | C | C | D |
| Comp. Ex. 3 | 88.0 | Unmeasurable | Non-used | A | A | C | C | D |
| Comp. Ex. 4 | 85.0 | Unmeasurable | Non-used | B | B | C | C | C |
| Comp. Ex. 5 | 91.0 | Unmeasurable | Non-used | B | B | C | C | B |
| Comp. Ex. 6 | 87.0 | Unmeasurable | Non-used | B | B | C | C | C |
| Comp. Ex. 7 | 91.0 | 0.6 | Non-used | B | B | C | C | C |
| Comp. Ex. 8 | 92.0 | 0.7 | Non-used | B | B | C | C | C |
| Comp. Ex. 9 | 91.0 | 0.7 | Non-used | B | B | C | C | C |
| Comp. Ex. 10 | 93.0 | 0.7 | Non-used | B | B | C | C | C |
| Comp. Ex. 11 | 77.0 | 0.5 | Used | B | B | C | C | D |
| Comp. Ex. 12 | 85.0 | 0.5 | Used | B | B | C | C | D |
| Comp. Ex. 13 | 87.0 | 0.6 | Used | B | B | C | C | D |
| Comp. Ex. 14 | 87.0 | 0.6 | Used | B | B | C | C | C |
| Comp. Ex. 15 | 85.0 | 0.7 | Used | B | B | C | C | C |
| Comp. Ex. 16 | 88.0 | 0.7 | Used | B | B | C | C | C |
| Comp. Ex. 17 | 89.0 | 0.7 | Used | B | B | C | C | C |

TABLE 11

| | Evaluation 3 | | |
|---|---|---|---|
| | Evaluation of image density unevenness | Evaluation of resolution | Evaluation of scratch resistance |
| Ex. 1 | B | B | C |
| Ex. 2 | C | C | C |
| Ex. 7 | B | B | C |
| Ex. 9 | B | A | B |
| Ex. 12 | B | B | C |
| Ex. 13 | B | B | C |
| Ex. 14 | B | B | C |
| Ex. 15 | B | A | B |
| Ex. 16 | A | A | A |
| Ex. 17 | A | A | A |
| Ex. 71 | B | B | C |
| Comp. Ex. 2 | C | C | D |
| Comp. Ex. 12 | C | C | D |

The results of Evaluation 2 and Evaluation 3 above show that the Examples obtain favorable results for the initial image density unevenness and the image density unevenness after passage of time, the initial resolution and the resolution after passage of time, and the scratch resistance compared with the Comparative Examples.

The details of each material shown in Tables above will be described below.

[Compound Having Chain Polymerizable Functional Group and Charge Transportable Skeleton in a Molecule]

(a-1): Compound represented by (i-11)

(a-2): Compound represented by (ii-18)

(a-3): Compound represented by (ii-19)

(a-4): Compound represented by (iv-16)

[Chain Transfer Agent]

(b-1): 1-dodecanethiol (manufactured by Tokyo Chemical Industry Co., Ltd.)

(b-2): Diphenyl sulfide (manufactured by Tokyo Chemical Industry Co., Ltd.)

(b-3): Tetraethylthiuram disulfide (manufactured by Tokyo Chemical Industry Co., Ltd.)

(b-4): Diethyldithiocarbamic acid benzyl (manufactured by Tokyo Chemical Industry Co., Ltd.)

(b-5): 2-ethylhexyl mercaptopropionate (manufactured by Sakai Chemical Industry Co., Ltd.)

(b-6): Trimethylolpropane mercaptopropionate (manufactured by Sakai Chemical Industry Co., Ltd.)

(b-7): Pentaerythritol mercapto propionate (manufactured by Sakai Chemical Industry Co., Ltd.)

[Polymerization Initiator]

(c-1) V-65 (trade name, manufactured by Wako Pure Chemical Industries, Ltd.)

(c-2): V-70 (trade name, manufactured by Wako Pure Chemical Industries, Ltd.)

(c-3): OTAZO-15 (trade name, manufactured by Otsuka Chemical Co., Ltd.)

(c-4): PERHEXYL 0 (trade name, manufactured by NOF Corporation)

(c-5): IRGACURE 651 (trade name, manufactured by Ciba Specialty Chemicals)

[Compound Having No Chain Polymerizable Reactive Group and Having Charge Transportable Skeleton]

(d-1) N,N'-diphenyl-N,N'-bis(3-methylphenyl)-[1,1]biphenyl-4-4'-diamine

[Compound Having Chain Polymerizable Reactive Group and Having No Charge Transportable Skeleton]

(e-1): IBA (isobutyl acrylate, trade name, manufactured by Wako Pure Chemical Industries, Ltd.)

(e-2): ABE-300 (Ethoxized bisphenol diacrylate, trade name, manufactured by Shin-Nakamura Chemical Co., Ltd.)

(e-3): THE330 (trimethylolpropane triacrylate, trade name, manufactured by Nippon Kayaku Co., Ltd. make)

[Binder Resin]

(f-1): PCZ-400 (bisphenol (Z) polycarbonate, trade name, manufactured by Mitsubishi Gas Chemical Co., Inc.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor, comprising an outermost surface layer formed from a cured film of a composition containing a component (A) and a component (B), wherein:

the component (A) is a compound having a chain polymerizable functional group and a charge transportable skeleton in a molecule; and the component (B) is a chain transfer agent having one or more thiol groups or a disulfide group;

a reaction ratio of the compound having a chain polymerizable functional group and a charge transportable skeleton in a molecule being about 90% to about 100%; and a charge mobility of the cured film at an electric field intensity of $1.0\times10^5$ v/cm being from about $5.0\times10^{-7}$ $cm^2/Vs$ to about $1.0\times10^{-4}$ $cm^2/Vs$.

2. The electrophotographic photoreceptor according to claim 1, wherein, in the cured film, the reaction ratio is from about 95% to about 100% and the charge mobility at an electric field intensity of $1.0\times10^5$ V/cm is from about $5.0\times10^{-6}$ $cm^2/Vs$ to about $1.0\times10^{-5}$ $cm^2/Vs$.

3. The electrophotographic photoreceptor according to claim 1, wherein, in the cured film, the reaction ratio is from about 98% to about 100% and the charge mobility at an electric field intensity of $1.0\times10^5$ V/cm is from about $2.0\times10^{-6}$ $cm^2/Vs$ to about $5.0\times10^{-6}$ $cm^2/Vs$.

4. The electrophotographic photoreceptor according to claim 1, wherein the compound having a chain polymerizable functional group and a charge transportable skeleton in a molecule is a compound having two or more of the chain polymerizable functional groups in a molecule.

5. The electrophotographic photoreceptor according to claim 1, wherein the compound having a chain polymerizable functional group and a charge transportable skeleton in a molecule is a compound represented by the following Formula (A):

(A)

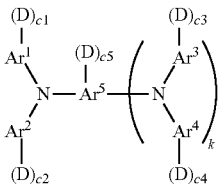

wherein, in Formula (A), $Ar^1$ to $Ar^4$ each independently represents a substituted or unsubstituted aryl group, $Ar^5$ represents a substituted or unsubstituted aryl group or a substituted or unsubstituted arylene group, D represents a group containing at least one selected from the group consisting of an acryloyl group, a methacryloyl group, and a vinylphenyl group at a terminal, c1 to c5 each independently represent 0, 1, or 2, k represents 0 or 1, and a total number of D is 1 or more.

6. The electrophotographic photoreceptor according to claim 5, wherein:

D represents $—(CH_2)_d—(O—CH_2—CH_2)_e—O—CO—C(R')=CH_2$ where

R' represents a hydrogen atom or a methyl group, d represents an integer of 1 to 5, and e represents 0 or 1; and the total number of D is 4 or more.

7. The electrophotographic photoreceptor according to claim 5, wherein the terminal of D is a methacryloyl group.

8. The electrophotographic photoreceptor according to claim 1, wherein the chain transfer agent is a compound having one or more thiol groups.

9. The electrophotographic photoreceptor according to claim 1, wherein the chain transfer agent is a compound having two or more thiol groups.

10. The electrophotographic photoreceptor according to claim 1, wherein the chain transfer agent is contained in a proportion of about 0.1 parts by weight to about 30 parts by weight based on 100 parts by weight of the compound having a chain polymerizable functional group and a charge transportable skeleton in a molecule.

11. The electrophotographic photoreceptor according to claim 1, wherein the chain transfer agent is contained in a proportion of about 1 part by weight to about 15 parts by weight based on 100 parts by weight of the compound having a chain polymerizable functional group and a charge transportable skeleton in a molecule.

12. The electrophotographic photoreceptor according to claim 1, wherein the chain transfer agent is contained in a proportion of about 2 parts by weight to about 10 parts by weight based on 100 parts by weight of the compound having a chain polymerizable functional group and a charge transportable skeleton in a molecule.

13. The electrophotographic photoreceptor according to claim 1, wherein the cured film further contains a compound having no chain polymerizable reactive groups and having a charge transportable skeleton.

14. A process cartridge, comprising the electrophotographic photoreceptor according to claim 1, the process cartridge being detachably attached to an image forming apparatus.

15. An image forming apparatus, comprising:

electrophotographic photoreceptor according to claim 1;

a charging unit that charges the electrophotographic photoreceptor;

an electrostatic latent image formation unit that forms an electrostatic latent image on the charged electrophotographic photoreceptor;

a development unit that accommodates a developer containing a toner and develops the electrostatic latent image formed on the electrophotographic photoreceptor as a toner image with the developer; and a transfer unit that transfers the toner image onto a transfer apparatus.

16. The electrophotographic photoreceptor according to claim 1, wherein the chain transfer agent is a compound selected from the group consisting of 1-propanethiol, 1-butanethiol, 1-decanethiol, 1-dodecanethiol, 1-heptanethiol, 1-octadecanethiol, 2-dodenacethiol, t-dodecyl mercaptan, thiobenzoic acid, thioglycolic acid, ammonium thioglycolate, monoethanolamine thioglycolate, β-mercapto propionic acid, methyl-3-mercapto propionate, 2-ethylhexyl-3-mercapto propionate, n-octyl-3-mercapto propionate, methoxy butyl-3-mercapto propionate, stearyl-3-mercapto propionate, 1,10-decanedithiol, 1,2-benzenedithiol, 1,2-ethanedithiol, 1,2-propanedithiol, 2-methy1-2-octyl-1, 3-propane dithiol, mercaptopropionic acid 2- ethylhexyl ester, mercaptopropionic acid trimethylolpropane ester, mercaptopropionic acid pentaerythritol ester, tris-[(3-mercapto propionyloxy-ethyl)]-isocyanurate, tetraethylene glycol bis(3-mercapto propionate), dipentaerythritol hexakis(3-mercapto propionate), tetraethylthiuram disulfide, tetraethylthiuram disulfide, and diethyldithiocarbamic acid ester.

17. The electrophotographic photoreceptor according to claim 1, wherein the chain transfer agent comprises a disulfide group.

18. The electrophotographic photoreceptor according to claim 17, wherein the chain transfer agent is a compound selected from the group consisting of tetraethylthiuram disulfide, tetraethylthiuram disulfide, and diethyldithiocarbamic acid ester.

* * * * *